US007984708B2

(12) United States Patent
Pedicni et al.

(10) Patent No.: US 7,984,708 B2
(45) Date of Patent: Jul. 26, 2011

(54) PROJECTILE LAUNCHING APPARATUS

(75) Inventors: Christopher Pedicni, Nashville, TN (US); John Witzigreuter, Canton, GA (US)

(73) Assignee: Impulse Solutions, LLC, Flagstaff, AZ (US)

( * ) Notice: Subject to any disclaimer, the term of this patent is extended or adjusted under 35 U.S.C. 154(b) by 315 days.

(21) Appl. No.: 12/187,618

(22) Filed: Aug. 7, 2008

(65) Prior Publication Data

US 2009/0056693 A1 Mar. 5, 2009

Related U.S. Application Data

(60) Provisional application No. 60/966,337, filed on Aug. 27, 2007.

(51) Int. Cl.
*F41B 11/00* (2006.01)

(52) U.S. Cl. ..... 124/65; 124/70; 124/77

(58) Field of Classification Search ..... 124/65, 124/66, 67, 70, 71, 72, 73, 77
See application file for complete search history.

(56) References Cited

U.S. PATENT DOCUMENTS

| | | | | |
|---|---|---|---|---|
| 5,261,384 | A * | 11/1993 | Hu | 124/66 |
| 6,857,422 | B2 * | 2/2005 | Pedicini et al. | 124/63 |
| 2005/0000505 | A1 * | 1/2005 | Pedicini et al. | 124/63 |
| 2005/0188974 | A1 * | 9/2005 | Pedicini et al. | 124/65 |
| 2005/0235975 | A1 * | 10/2005 | Pedicini et al. | 124/67 |
| 2006/0231083 | A1 * | 10/2006 | Tsurumoto | 124/66 |
| 2006/0243263 | A1 * | 11/2006 | Tsurumoto | 124/66 |
| 2007/0000483 | A1 * | 1/2007 | Tsurumoto | 124/73 |
| 2007/0289586 | A1 * | 12/2007 | Tsurumoto | 124/73 |

* cited by examiner

*Primary Examiner* — Troy Chambers
(74) *Attorney, Agent, or Firm* — Jay Schloff

(57) ABSTRACT

Disclosed is a projectile launching apparatus capable of launching a projectile, such as a pellet, a BB, an arrow, a dart and a paintball. The projectile launching apparatus includes a motor driven linear motion converter, a cylinder, a breech assembly and a compression valve arrangement. The linear motion converter converts a rotational movement of a motor into a linear movement of a piston by a gear reduction mechanism. The linear movement of the piston within the cylinder compresses a gas with a high compression exponent. The compressed gas is further released into a barrel of the breech assembly through the compression valve arrangement. The compressed gas expands in the barrel causing a projectile to be launched from the barrel with a force of the compressed gas.

21 Claims, 28 Drawing Sheets

PROJECTILE LAUNCHING APPARATUS

CROSS REFERENCE TO RELATED APPLICATIONS

The present invention claims priority under 35 United States Code, Section 119 on the provisional application No. 60/966,337, filed on Aug. 27, 2007, the disclosure of which is incorporated by reference.

FIELD OF THE INVENTION

The present invention relates generally to mechanical projectile launching apparatuses, and more particularly, to projectile launching apparatuses operated by gas compressed by electrical motor driven linear motion converters.

BACKGROUND OF INVENTION

Developments have been seen in the field of projectile launching apparatuses, such as air rifles, pneumatic guns, pellet rifles, paintball guns and the like. Paintball guns have been around for many years and have seen numerous evolutionary changes over the years. The most common mechanisms for launching projectiles, such as pellets, BB bullets and paintballs use energy of a compressed gas or a spring. However, there are variety of mechanisms described in the prior art for launching these projectiles. Such mechanisms include use of a stored compressed gas in a form of carbon dioxide cylinders or other high pressure storage tanks, use of a powerful spring to push a piston which compresses air to push a projectile, use of a hand pump to pressurize the air for subsequent release, and use of a direct acting means such as a solenoid plunger or a centrifugal force to push the projectile out of a barrel. The above mentioned mechanisms generally suffer from a number of disadvantages as explained below.

The mechanism of using stored compressed gas, such as carbon dioxide requires a storage means, such as a tank, a gas chamber, or a canister. The use of the storage means involves a cumbersome method of filling a gas in the storage means and transporting of the storage means based projectile launching apparatus. Additionally, the use of such storage means require additional equipments such as regulators, evaporation chambers, and other controls to reduce the pressure of the stored compressed gas for a safe launching of the projectiles. The requirement of such additional equipments increases the cost and the complexity of a projectile launching apparatus. In a typical projectile launching apparatus, which uses the storage means, velocity of the projectile varies significantly depending on the temperature of the storage means. For example, a pressure of the carbon dioxide gas depends upon the temperature of the canister, containing the carbon dioxide gas. Furthermore, the storage means stored with a large amount of compressed gas may cause potential safety hazard by a sudden release of compressed gas due to a fault in the storage means.

U.S. Pat. Nos. 6,516,791, 6,474,326, 5,727,538 and 6,532,949 describe various ways of porting and controlling of high pressure gas supply to improve the reliability of projectile launching apparatuses, specifically, guns. The controlling of the high pressure gas supply is achieved by differentiating air streams, such as an air stream which is delivered to a bolt to facilitate the chambering of the projectile in a barrel and an air stream which pushes the projectile out of the barrel. However, all the above listed US patents suffer from major inconvenience and potential safety hazard of storing a large volume of a highly compressed gas within the guns. Additionally, these guns combine an electronic control coupled with the propulsion method driving mechanism of stored compressed gas, which tend to increase the inherent complexity of the mechanism used in the gun, as well as, increase the cost and reliability issues.

The another mechanism which has been used for quite a few years in many different types of pellet, "BB bullets" or air guns has a basic principle of storing energy in a spring, which is subsequently released to rapidly compress gas, especially air present in the atmosphere. The highly compressed gas is generated by the spring acting on a piston to push the projectile out of the barrel at a high velocity. Problems with such mechanism include the need to "cock" the spring between successive shots and thereby limiting such guns to be a single shot device or a gun with a low rate of firing. Further, unwinding of the spring results in a double recoil effect. The first recoil is from the initial forward movement of the spring and the second recoil when the spring slams the piston into an end of a cylinder (i.e. forward recoil).

A typical gun including the spring requires a significant amount of maintenance and, if dry-fired (without projectile), the mechanism is easily damaged. Finally, the effort required for such "cocking" is often substantial and can be difficult for many individuals. References to these guns are found in U.S. Pat. Nos. 3,128,753, 3,212,490, 3,523,538, and 1,830,763. Additional variation on the above mechanism has been attempted through the years including using an electric motor to cock the spring that drives the piston. This variation is introduced in U.S. Pat. Nos. 4,899,717 and 5,129,383. While this variation solves the problem of cocking effort, the resulting air gun still suffers from a complicated mechanism, the double recoil effect and the maintenance issues associated with such a spring piston system. A further mechanism which uses a motor to wind the spring is described in U.S. Pat. Nos. 5,261,384 and 6,564,788, issued to Hu.

Hu's patents disclose a motor for compressing a spring, where the motor is connected to a piston. The spring is quickly released such that the spring drives the piston to compress the air, which pushes the projectile out the barrel. This implementation still suffers from similar limitations inherent in the spring piston systems. Hu describes the use of the motor to wind the spring in the above listed patents. Specifically, the spring must quickly compress the air against the projectile to force the projectile out of the barrel at a high velocity. This requires a strong spring to rapidly compress the air when the piston releases. Springs in such systems are highly stressed mechanical element which are prone to breakage and also increase the weight of the air gun. A further disadvantage of Hu's patents is that the spring is released from a rack pinion under full load causing tips of gear teeth to undergo severe tip loading. This causes high stress and wear on the mechanism especially on the gear teeth. This is a major complaint for those guns in the commercial market and is a major reliability issue with this mechanism.

A further disadvantage of this type of mechanism is that for launching a larger projectile or a projectile requiring a high velocity of launch, there occurs much increased wear and forward recoil, which is the result of the piston impacting the front end of the cylinder. In the dry fire, the mechanism can be damaged as the piston slams against the face of the cylinder. Hu describes use of a breech shutoff that is common in virtually all toy guns since the air must be directed down the barrel and the flow into a projectile inlet port must be minimized. Further, Hu specifically does not incorporate an air compression valve in the above listed patents, which is a restrictive valve against which the piston compresses the air for subsequent releases. Thus, forward recoil, high wear and low power are drawbacks in this type of mechanism. A similar reference can be seen in U.S. Pat. No. 1,447,458, which shows a spring winding and then delivery to a piston to compress air and propel a projectile. In this case, the device is for non-portable operation.

The additional mechanism, which uses hand pumps to pressurize the air, is often used in low end devices. The use of such mechanism suffers from a need to pump the air between 2 to 10 times to build up enough air supply for a sufficient projectile launch velocity. This again limits the gun, such as the paintball gun to slow rates of fire. Additionally, because of the delay between as to when the air is compressed and when the compressed air is released to the projectile causes variations in the projectile launch velocity.

Further, U.S. Pat. Nos. 2,568,432 and 2,834,332 describe a mechanism to use a solenoid to directly move the piston, which compresses the air and launches the projectile out of the barrel. While this mechanism solves the obvious problem of manually pumping a chamber up in order to fire a gun, but devices incorporating this mechanism suffer from the inability to store sufficient energy in the compressed air. The solenoid may be an inefficient device and capable of converting a very limited amount of energy in the compressed air due to their operation. Furthermore, since the compressed air is applied directly to the projectile in this mechanism similar to the spring piston mechanism, the projectile begins to move as the air starts being compressed. This limits the ability of the solenoid to store energy in the compressed air to a very short time period and therefore these devices cater to low energy guns.

In order to improve the design, the piston must actuate in an extremely fast time frame in order to prevent significant projectile movement during a compression stroke. This results in a very suitable piston mass similar to the spring piston designs which results in the undesirable double recoil effect as the piston mass must come to a halt. Additionally, when this mechanism suffers from dry-fire the air is communicated to the atmosphere through the barrel causing damage to the mechanism. Another variant of this approach is disclosed in U.S. Pat. No. 1,375,653, which uses an internal combustion engine instead of the solenoid to act against the piston. Although this solves the issue of sufficient power, but the use of the internal combustion engine is no longer considered as an air rifle as it becomes a combustion driven gun. Moreover, the use the internal combustion engine suffers from the aforementioned disadvantages including complexity and difficulty in controlling the firing sequence.

U.S. Pat. Nos. 4,137,893 and 2,398,813 issued to Swisher discloses an air gun using an air compressor coupled to a storage tank, which is then coupled to the air gun. Although this solves the issue of double recoil effect, but is not suitable to a portable system due to inefficiencies of compressing the air and a large tank volume required. This type of air gun is quite similar to an existing paintball gun in which the air is supplied via the air tank and not compressed on demand. Using air in this fashion is inefficient and is not suitable for a portable operation since much of compressed air energy is lost to the environment through the air tank via cooling. Forty percent or more (depending on the compression ratio) of the compressed air energy is stored as heat and is lost to do work when the air is allowed to cool. Furthermore, additional complexity and expenses are required to regulate the air pressure from the air tank so that the projectile launch velocity is controlled. A variation of the above described mechanism is use of a direct air compressor as described in U.S. Pat. No. 1,743,576. Again, due to the large volume of air between compression means and the projectile, much of the compressed air energy especially, a heat of compression, is lost leading to inefficient operation. Additionally, the U.S. Pat. No. 1,743,576 teaches a continuously operating device which suffers from a significant lock time (time between a trigger pull in order to initiate the launch and the projectile leaving the barrel) as well as the inability to run in a semiautomatic or single shot mode. Further, disadvantages of this mechanism include the pulsating characteristics of the compressed air, which are caused by the release and reseating of a check valve during normal operation.

U.S. Pat. Nos. 1,343,127 and 2,550,887 disclose a mechanism to use a direct mechanical action on the projectile. Limitations of this approach include difficulty in achieving high projectile velocity since the transfer of energy must be done extreme rapidly between an impacting hammer and the projectile. Further limitations of this mechanism include a need of absorbing a significant impact as a solenoid plunger must stop and return for the next projectile. This causes the double-recoil or the forward recoil. Since the solenoid plunger represents a significant fraction of the moving mass (i.e. solenoid plunger often exceeds the projectile weight), this type of apparatus is very inefficient and limited to low velocity, such as required in low energy air guns for the purpose of toys and the like. Variations of this method include those disclosed in U.S. Pat. No. 4,694,815 in which the impact hammer is driven by a spring that contacts the projectile. The spring is "cocked" via an electric motor, but again, this does not overcome the prior mentioned limitations.

All of the currently available projectile launching apparatuses suffer from one or more of the following disadvantages. These disadvantages include, but are limited to, a manual operation by cocking a spring or pumping up an air chamber, difficulty to selectively perform single fire, semiautomatic mechanism, burst or automatic modes in these projectile launching apparatuses. Further, inconvenience, safety and consistency issues associated with refilling, transport and the use of high-pressure gas or carbon dioxide cylinders being the safety hazard. Furthermore, disadvantages include non-portability and low efficiency of these projectile launching apparatuses, which are associated with compressed air supplied from a typical air compressor. The forward recoil effects, high wear, and dry fire damage associated with a spring piston such as an electrically actuated spring piston designs. Complicated mechanisms associated with electrically winding and releasing of the spring piston design result in expensive mechanism having reliability issues. Inefficient use and/or coupling of the compressed air to the projectile also restrict their capability to launch the projectile with high velocity.

Accordingly, there exists a need for a projectile launching apparatus which includes all the advantages of the prior art and overcomes the drawbacks inherent therein.

SUMMARY OF THE INVENTION

In view of foregoing disadvantage inherent in the prior art, the general purpose of the present invention is to provide a projectile launching apparatus, to include all the advantages of the prior art, and overcome the drawbacks inherent therein.

In light of the above objects, in one aspect of the present invention, a projectile launching apparatus is provided. The projectile launching apparatus includes a power source, a motor, a control circuit, a cylinder, a slider crank arrangement, a breech assembly and a compression valve arrangement. The motor is electrically connected to the power source. The control circuit is configured to control a power supply to the motor from the power source. The slider crank arrangement is driven by the motor. The slider crank arrangement is operatively coupled to a piston and is configured to cause the piston to reciprocally move within the cylinder for compressing the gas within the cylinder. The piston reciprocally moves within the cylinder to define a gas chamber within the cylinder to accommodate gas therein.

The breech assembly includes a barrel, a projectile inlet port and a bolt. The projectile inlet port is configured on the barrel and is adapted to receive a projectile into the barrel. The bolt includes a front portion and a rear portion. The bolt is operatively coupled to the slider crank arrangement and is capable of reciprocating between a first position and a second position of the bolt. In the first position the bolt is configured to be partially received within the barrel such that the front portion of the bolt shuts off the projectile inlet port and in the second position the bolt is configured to enable the projectile to enter the barrel from the projectile inlet port. Further, the compression valve arrangement is operatively disposed between the cylinder and the barrel. The compression valve arrangement has an open position and a closed position. The open position of the compression valve arrangement allows releasing the compressed gas within the gas chamber into the barrel. Further, the closed position of the compression valve arrangement is configured to seal the compressed gas from the gas chamber to the barrel. The gas received within the gas chamber is compressed by the piston in a single stroke of the slider crank arrangement. The compressed gas is released from the gas chamber into the barrel that causes the compressed gas to expand in the barrel and accordingly, the projectile is launched from the barrel with the single stroke of the slider crank arrangement.

In another aspect, the present invention provides a projectile launching apparatus, which includes a power source, a motor, a control circuit, a cylinder, a crankshaft and connecting rod arrangement, a breech assembly and a compression valve arrangement. The motor is electrically connected to the power source. The control circuit is configured to control a power supply to the motor from the power source. The crankshaft and connecting rod arrangement is driven by the motor. The crankshaft and connecting rod arrangement is operatively coupled to a piston and is configured to cause the piston to reciprocally move within the cylinder for compressing gas within a gas chamber. The piston reciprocally moves within the cylinder to define the gas chamber for storing the compressed gas.

The breech assembly includes a barrel, a projectile inlet port and a bolt. The projectile inlet port is configured on the barrel and is adapted to receive a projectile into the barrel. The bolt includes a front portion and a rear portion. The bolt is operatively coupled to the crankshaft and connecting rod arrangement and is capable of reciprocating between a first position and a second position of the bolt. In the first position the bolt is configured to be partially received within the barrel such that the front portion of the bolt shuts off the projectile inlet port and in the second position the bolt is configured to enable the projectile to enter the barrel from the projectile inlet port. Further, the compression valve arrangement is operatively disposed between the cylinder and the barrel. The compression valve arrangement is capable of attaining an open position or a closed position. The open position of the compression valve arrangement is configured to release the compressed gas within the gas chamber into the barrel. The closed position of the compression valve arrangement is configured to seal the compressed gas within the gas chamber. The gas received within the gas chamber is compressed by the piston in a single stroke of the crankshaft and connecting rod arrangement. The compressed gas is released from the gas chamber into the barrel causing the compressed gas to expand in the barrel and thereby causing the projectile to be launched from the barrel with the single stroke of the crankshaft and connecting rod arrangement.

In yet another aspect of the present invention, the present invention provides a projectile launching apparatus, which includes a power source, a motor, a control circuit, a cylinder, a linear motion converter, a breech assembly and a compression valve arrangement. The motor is electrically connected to the power source. The control circuit is configured to control a power supply to the motor from the power source. The linear motion converter is driven by the motor. The linear motion converter is operatively coupled to a piston and configured to cause the piston to reciprocally move within the cylinder to compress gas therein. The piston, by the reciprocal movement, is capable of defining a gas chamber within the cylinder. The gas chamber further includes a separator dividing the gas chamber into a primary gas chamber and a secondary gas chamber. The primary gas chamber and the secondary gas chamber are capable of accommodating gas therein.

The breech assembly includes a barrel, a projectile inlet port and a bolt. The projectile inlet port is configured on the barrel and adapted to receive a projectile. The bolt includes a front portion and a rear portion. The bolt is operatively coupled to the linear motion converter and is capable of reciprocating between a first position and a second position of the bolt. In the first position the bolt is configured to be partially received within the barrel such that the front portion of the bolt shuts off the projectile inlet port and in the second position the bolt is configured to enable the projectile to enter the barrel from the projectile inlet port. The compression valve arrangement is operatively disposed between the cylinder and the barrel.

The compression valve arrangement is capable of attaining an open position and a closed position. The open position of the compression valve arrangement is configured to release the compressed gas into the barrel from the secondary gas chamber. The closed position of the compression valve arrangement is configured to seal the compressed gas within the secondary gas chamber and prevents releasing of the compressed gas into the barrel. Further, the gas received within the primary gas chamber is compressed by the piston in multiple strokes of the linear motion converter. The compressed gas is released into the secondary gas chamber in less than or equal to about 250 milliseconds and with a compression exponent at least equal to about 1.05. In the multiple strokes of the linear motion converter, the compression valve arrangement is caused to open once in less than or equal to about 250 milliseconds. The compressed gas in the secondary gas chamber is released into the barrel causing the compressed gas to expand in the barrel and thereby causing the projectile to be launched from the barrel with n stroke of the linear motion converter.

In still another aspect of the present invention, the present invention provides a projectile launching apparatus which includes a power source, a motor, a control circuit, a cylinder, a slider crank arrangement, a breech assembly and a compression valve arrangement. The motor is electrically connected to the power source. The control circuit is configured to control a power supply to the motor from the power source. The slider crank arrangement is driven by the motor. The slider crank arrangement is operatively coupled to a piston and configured to cause the piston to reciprocally move within the cylinder to compress gas therein. The piston, by the reciprocal movement, is capable of defining a gas chamber within the cylinder. The gas chamber further includes a separator dividing the gas chamber into a primary gas chamber and a secondary gas chamber. The primary gas chamber and the secondary gas chamber are capable of accommodating gas therein.

The breech assembly includes a barrel, a projectile inlet port and a bolt. The projectile inlet port is configured on the barrel and adapted to receive a projectile. The bolt includes a front portion and a rear portion. The bolt is operatively coupled to the slider crank arrangement and is capable of reciprocating between a first position and a second position of the bolt. In the first position the bolt is configured to be partially received within the barrel such that the front portion of the bolt shuts off the projectile inlet port and in the second position the bolt is configured to enable the projectile to enter the barrel from the projectile inlet port. The compression valve arrangement is operatively disposed between the cylinder and the barrel.

The compression valve arrangement disposed between the cylinder and the barrel and is operatively coupled to the slider crank arrangement. The compression valve arrangement has an open position and a closed position. The open position of the compression valve arrangement is configured to release the compressed gas into the barrel from the secondary gas chamber. The closed position of the compression valve arrangement is configured to seal the compressed gas within the secondary gas chamber and prevents releasing into the barrel. Further, the gas received within the primary gas chamber is compressed by the piston in multiple strokes of the slider crank arrangement. The compressed gas is released into the secondary gas chamber in less than or equal to about 250 milliseconds and with a compression exponent at least equal to about 1.05. In the multiple strokes of the slider crank arrangement, the compression valve arrangement is caused to open once in less than or equal to about 250 milliseconds. The compressed gas in the secondary gas chamber is released into the barrel causing the compressed gas to expand in the barrel and thereby causing the projectile to be launched from the barrel with n stroke of the slider crank arrangement.

In yet another aspect of the present invention, a compression valve arrangement for a motor driven projectile launching apparatus for releasing a compressed gas from a cylinder to a barrel of the projectile launching apparatus is provided. The compression valve arrangement includes a valve body having a groove, a valve spool, a valve return spring and a gas passageway. The valve spool is disposed within the groove. The valve spool includes a front face portion facing the cylinder and a rear face portion opposite to the front face portion. The valve return spring is disposed within the groove and operatively coupled to the rear face portion of the valve spool. The gas passageway extends from the groove to the barrel and configures a duct for releasing the compressed gas from the cylinder to the barrel. The compression valve arrangement is disposed between the cylinder and the barrel. Upon compressing gas by a piston within the cylinder to a compression exponent of at least 1.05, the valve spool snaps open to an open position in less than or equal to about 20 milliseconds. The compressed gas from the cylinder is released through the gas passageway to the barrel. Upon releasing the compressed gas to the barrel, a restoration force is applied by the valve return spring exceeding the pressure of the compressed gas in the gas chamber enabling the valve return spring to restore the valve spool to a closed position to seal the compressed gas within the gas chamber.

These together with other aspects of the present invention, along with the various features of novelty that characterize the present invention, are pointed out with particularity in the claims annexed hereto and form a part of this invention. For a better understanding of the present invention, its operating advantages, and the specific objects attained by its uses, reference should be made to the accompanying drawings and descriptive matter in which there are illustrated exemplary embodiments of the present invention.

BRIEF DESCRIPTION OF THE DRAWING FIGURES

The advantages and features of the present invention will become better understood with reference to the following detailed description and claims taken in conjunction with the accompanying drawings, wherein like elements are identified with like symbols, and in which:

Figure 10:
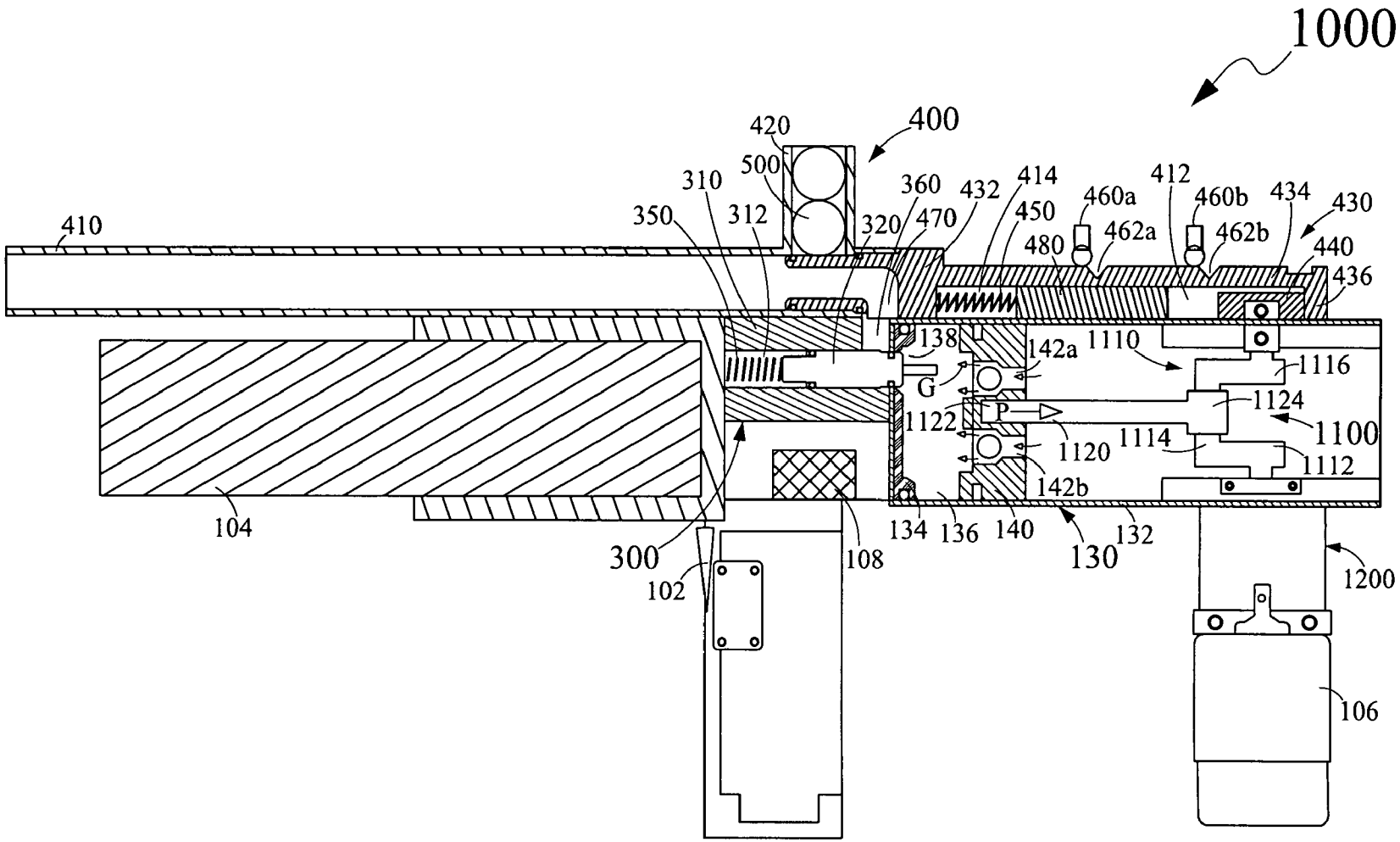
Figure 11:
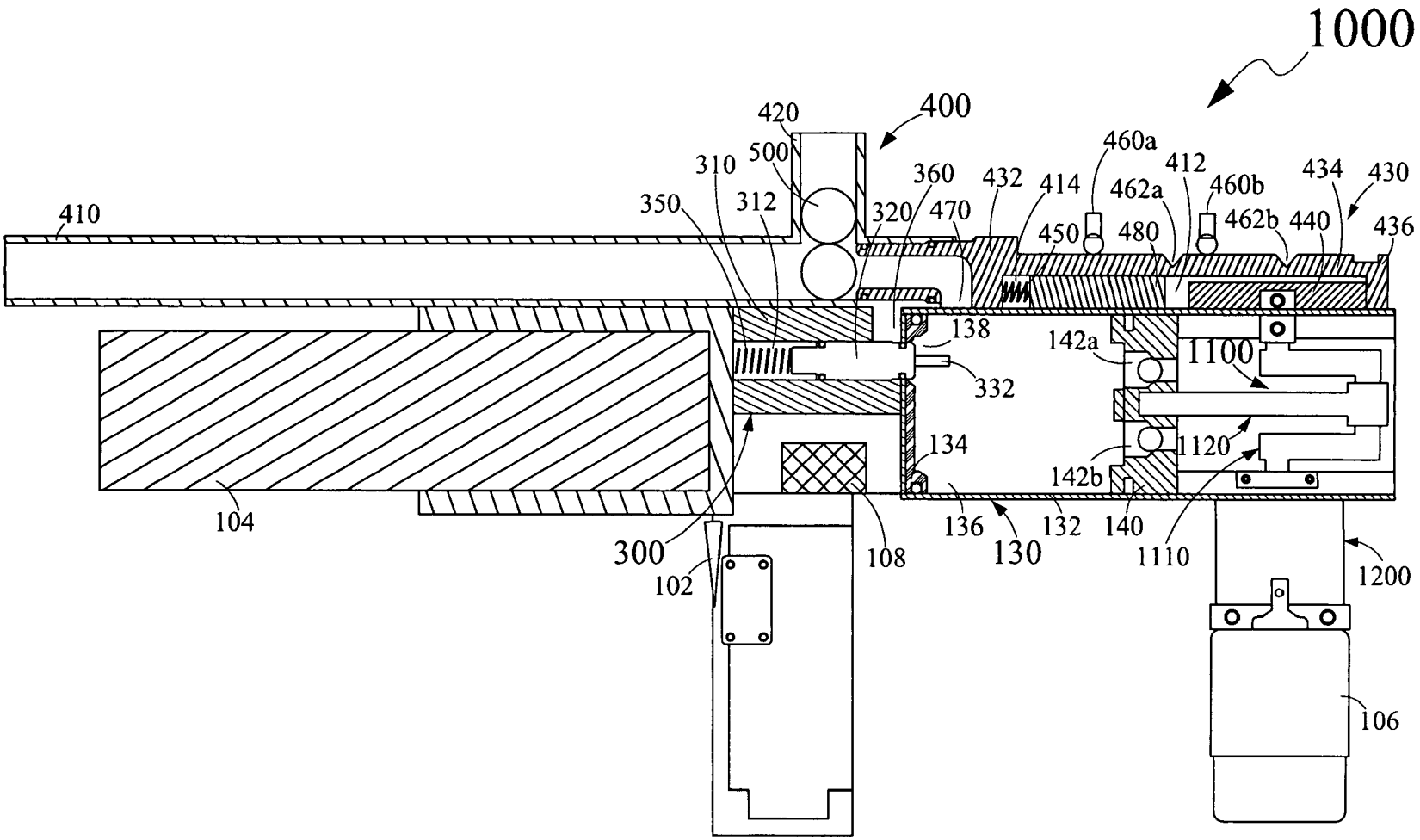
Figure 12:
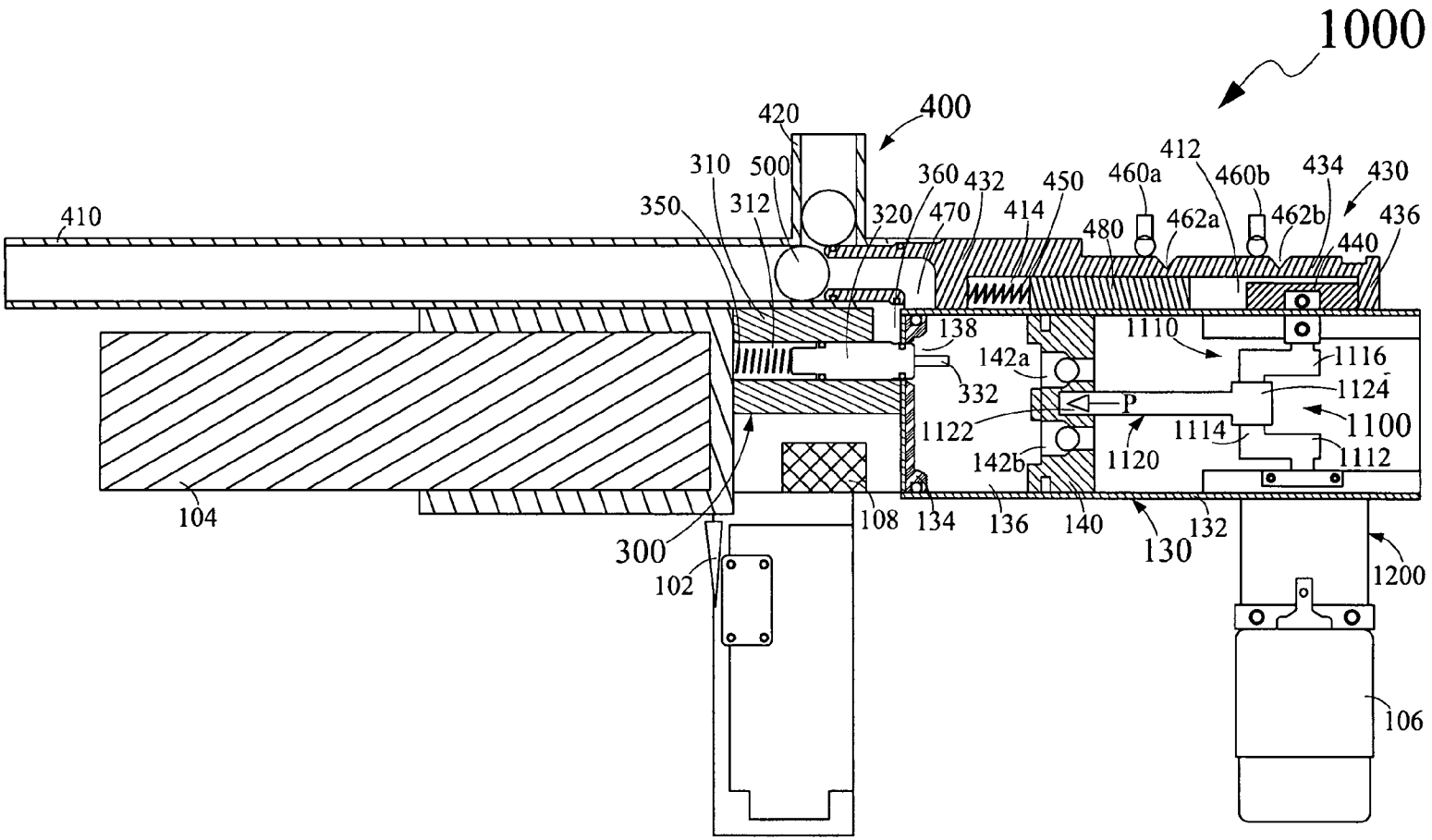
Figure 13:
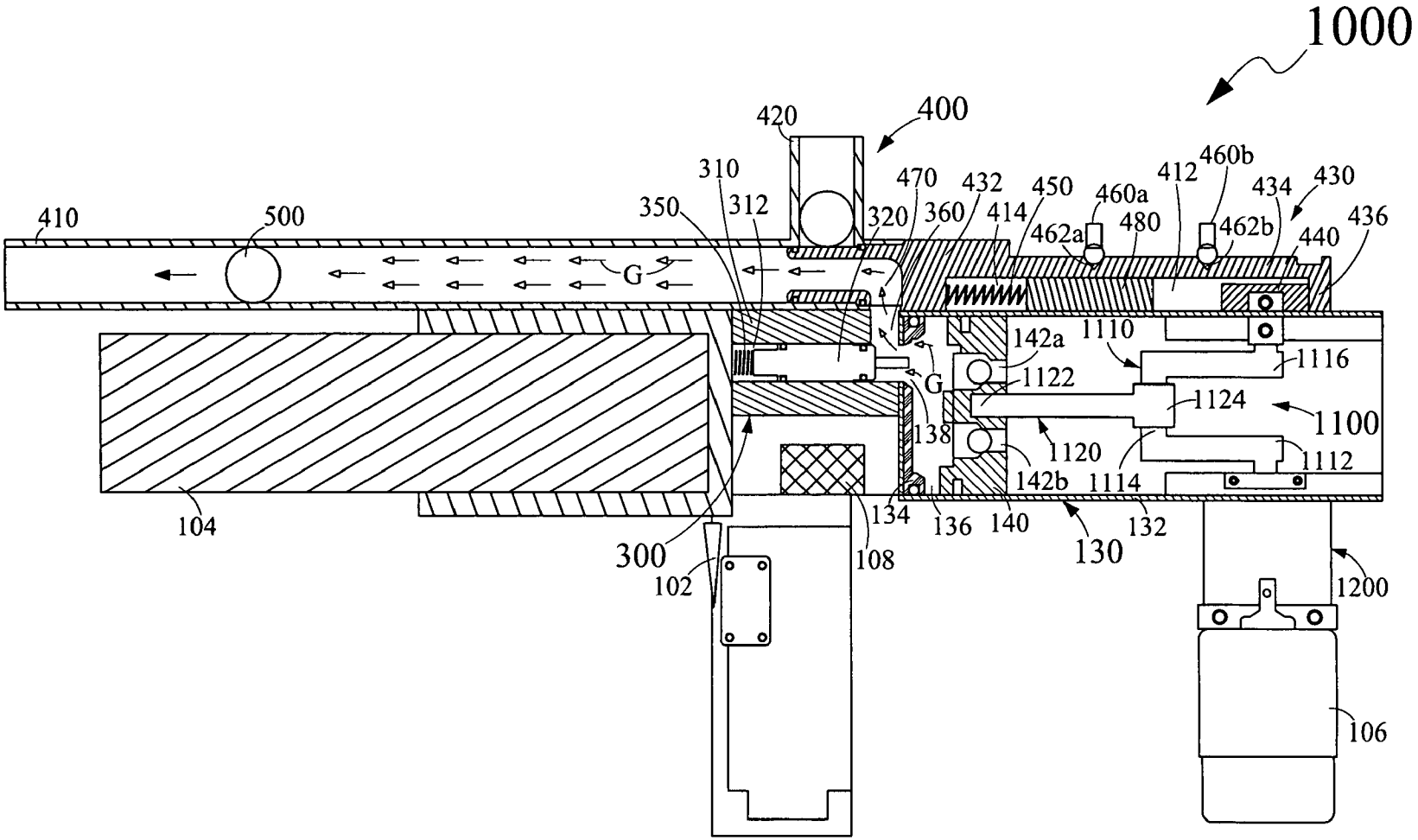
Figure 22:
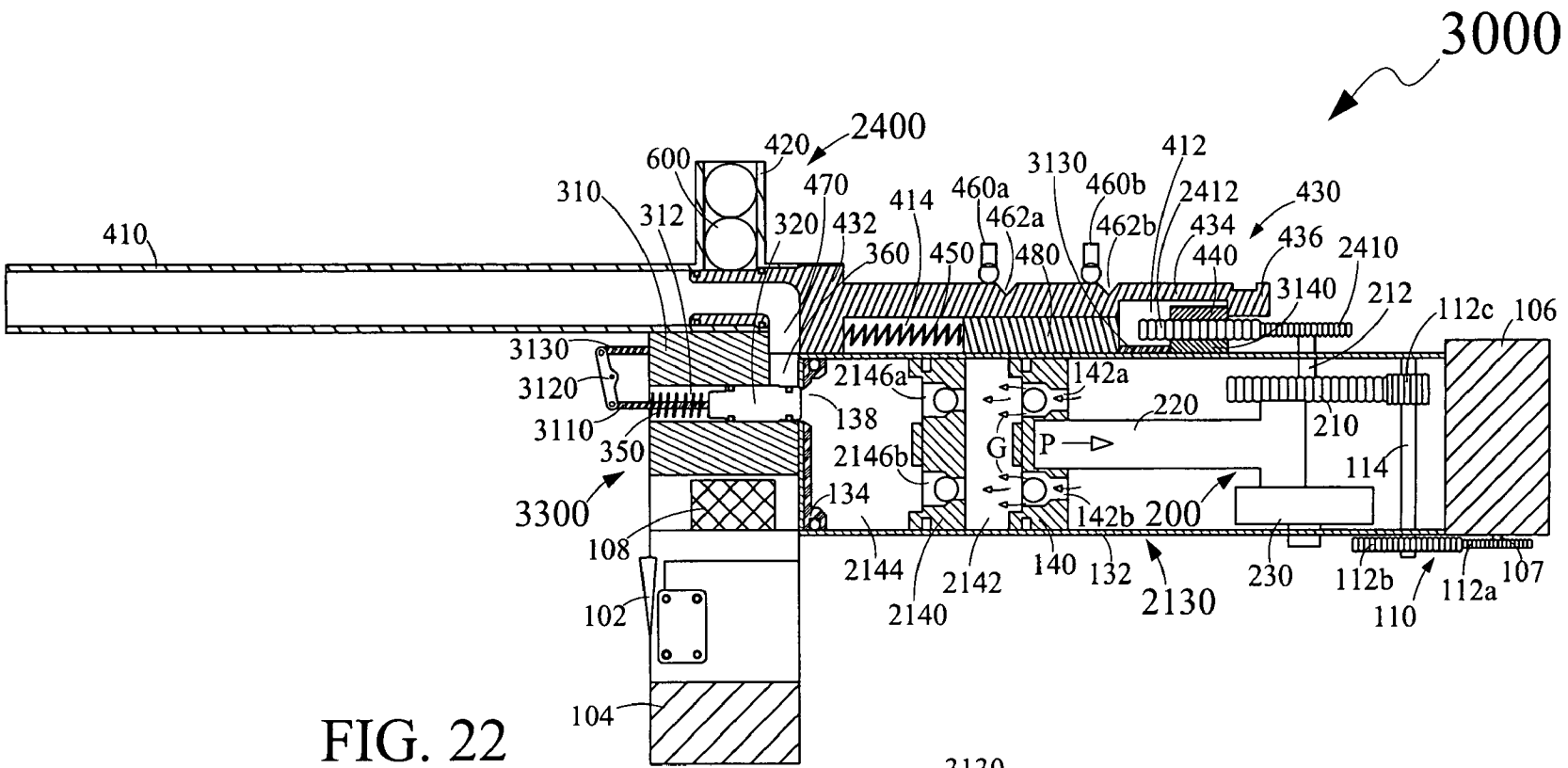
Figure 30:
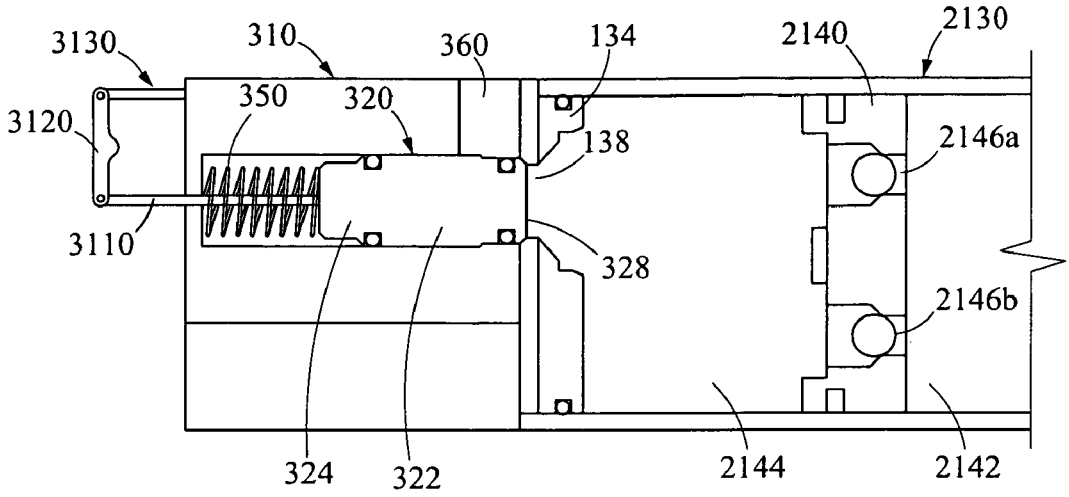
Figure 31:
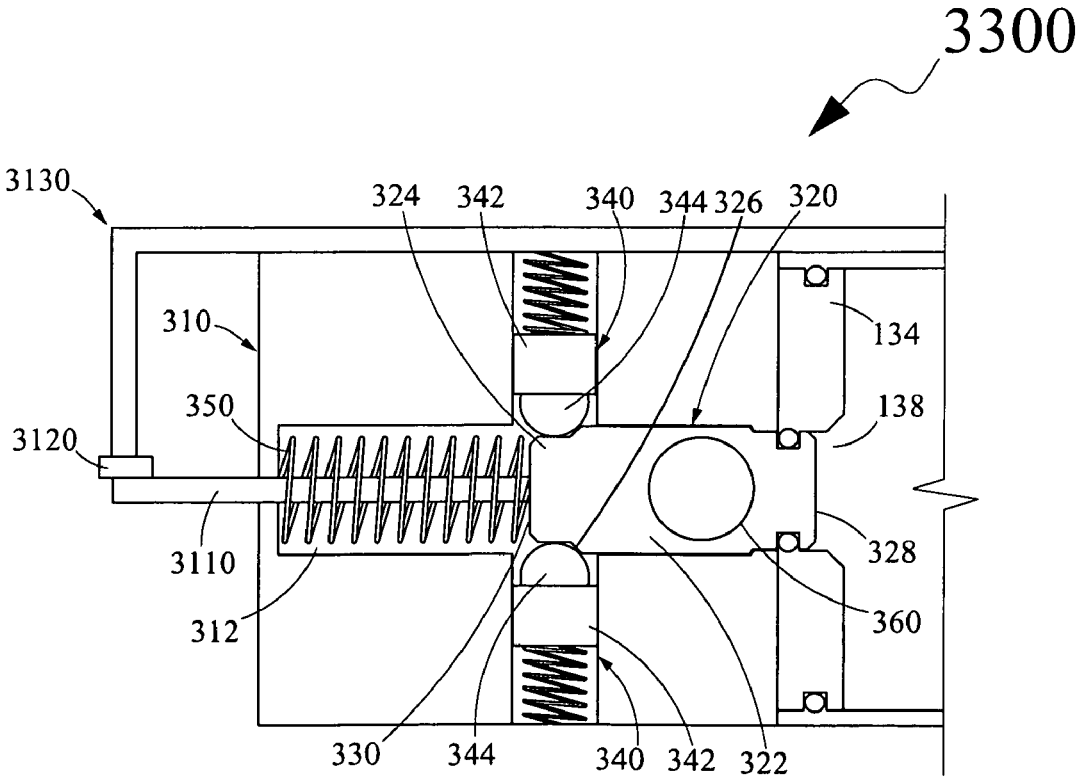

FIGS. 6A, 7A, 8A, and 9A illustrate partial top views of a breech assembly depicting a movement of a bolt of the breech assembly of the projectile launching apparatus illustrated in FIGS. 6, 7, 8 and 9 respectively, according to an exemplary embodiment of the present invention;

FIG. 10 illustrates a longitudinal cross-sectional view of a projectile launching apparatus incorporating a crankshaft and connecting rod arrangement and a cylinder having a piston moving towards a BDC of the cylinder, according to an exemplary embodiment of the present invention;

FIG. 11 illustrates a longitudinal cross-sectional view of the projectile launching apparatus incorporating the crankshaft and connecting rod arrangement with the piston positioned at the BDC of the cylinder, according to an exemplary embodiment of the present invention;

FIG. 12 illustrates a longitudinal cross-sectional view of the projectile launching apparatus incorporating the crankshaft and connecting rod arrangement with the piston moving towards a TDC of the cylinder, according to an exemplary embodiment of the present invention;

FIG. 13 illustrates a longitudinal cross-sectional view of the projectile launching apparatus incorporating the crankshaft and connecting rod arrangement with the piston positioned at the TDC of the cylinder, according to an exemplary embodiment of the present invention;

FIGS. 14, 15, 16 and 17 illustrate longitudinal cross-sectional views of a projectile launching apparatus depicting a first stroke of a piston of the projectile launching apparatus incorporating a slider crank arrangement and a cylinder having a primary gas chamber and a secondary gas chamber, according to an exemplary embodiment of the present invention;

FIGS. 14A 15A, 16A and 17A illustrate partial top views of a breech assembly depicting a movement of a bolt of the breech assembly in the first stroke of the projectile launching apparatus of FIGS. 14, 15, 16 and 17, in accordance with an exemplary embodiment of the present invention;

FIGS. 18, 19, 20 and 21 illustrate longitudinal cross-sectional views of the projectile launching apparatus depicting a second stroke of the projectile launching apparatus incorporating the slider crank arrangement and the cylinder having the primary gas chamber and the secondary gas chamber, according to an exemplary embodiment of the present invention;

FIGS. 18A 19A, 20A and 21A illustrate partial top views of the breech assembly depicting a movement of the bolt of the breech assembly in the second stroke of the projectile launching apparatus of FIGS. 18A 19A, 20A and 21A, in accordance with an exemplary embodiment of the present invention;

FIGS. 22, 23, 24 and 25 illustrate longitudinal cross-sectional views of a projectile launching apparatus depicting a first stroke of the projectile launching apparatus incorporating a slider crank arrangement, a cylinder having a primary gas chamber and a secondary gas chamber, and a compression valve arrangement having a valve driving mechanism, according to an exemplary embodiment of the present invention;

FIGS. 22A, 23A, 24A and 25A illustrate top views of the compression valve arrangement depicting a movement of a valve spool and a valve cam in the first stroke of the projectile launching apparatus of FIGS. 22, 23, 24 and 25, in accordance with an exemplary embodiment of the present invention;

FIGS. 26, 27, 28 and 29 illustrate longitudinal cross-sectional views of the projectile launching apparatus depicting a second stroke of the projectile launching apparatus incorporating the slider crank arrangement, the cylinder having the primary gas chamber and the secondary gas chamber, and the compression valve arrangement having the valve driving mechanism, according to an exemplary embodiment of the present invention;

FIGS. 26A, 27A, 28A and 29A illustrate top views of the compression valve arrangement depicting a movement of the valve spool and the valve cam in the second stroke of the projectile launching apparatus of FIGS. 26, 27, 28 and 29, in accordance with an exemplary embodiment of the present invention;

FIG. 30 illustrates a partial side view of the projectile launching apparatus depicting the compression valve arrangement coupled to a cylinder of the projectile launching apparatus of FIG. 22, according to an exemplary embodiment of the present invention; and FIG. 31 illustrates a partial top view of the compression valve arrangement in a closed position, according an exemplary embodiment of the present invention.

Like reference numerals refer to like parts throughout the description of several views of the drawings.

DETAILED DESCRIPTION OF THE INVENTION

The exemplary embodiments described herein detail for illustrative purposes are subject to many variations in structure and design. It should be emphasized, however, that the present invention is not limited to a particular projectile launching apparatus, as shown and described. It is understood that various omissions and substitutions of equivalents are contemplated as circumstances may suggest or render expedient, but these are intended to cover the application or implementation without departing from the spirit or scope of the claims of the present invention.

The terms "first," "second," and the like, herein do not denote any order, quantity, or importance, but rather are used to distinguish one element from another, and the terms "a" and "an" herein do not denote a limitation of quantity, but rather denote the presence of at least one of the referenced item.

The present invention provides a projectile launching apparatus for launching a projectile, such as a pellet, a BB bullet, an arrow, a dart and a paintball. The projectile launching apparatus is an arrangement of a linear motion converter driven by a motor, a piston coupled to the linear motion converter and reciprocally movable within a cylinder, a compression valve arrangement and a breech assembly. The piston, which is capable of having reciprocal movement caused by the linear motion converter, compresses a gas within the cylinder and the compressed gas is communicated to a barrel of the breech assembly through the compression valve arrangement. The compressed gas expands in the barrel of the breech assembly for launching the projectile, which is chambered in the barrel, with a high velocity.

Figure 1:
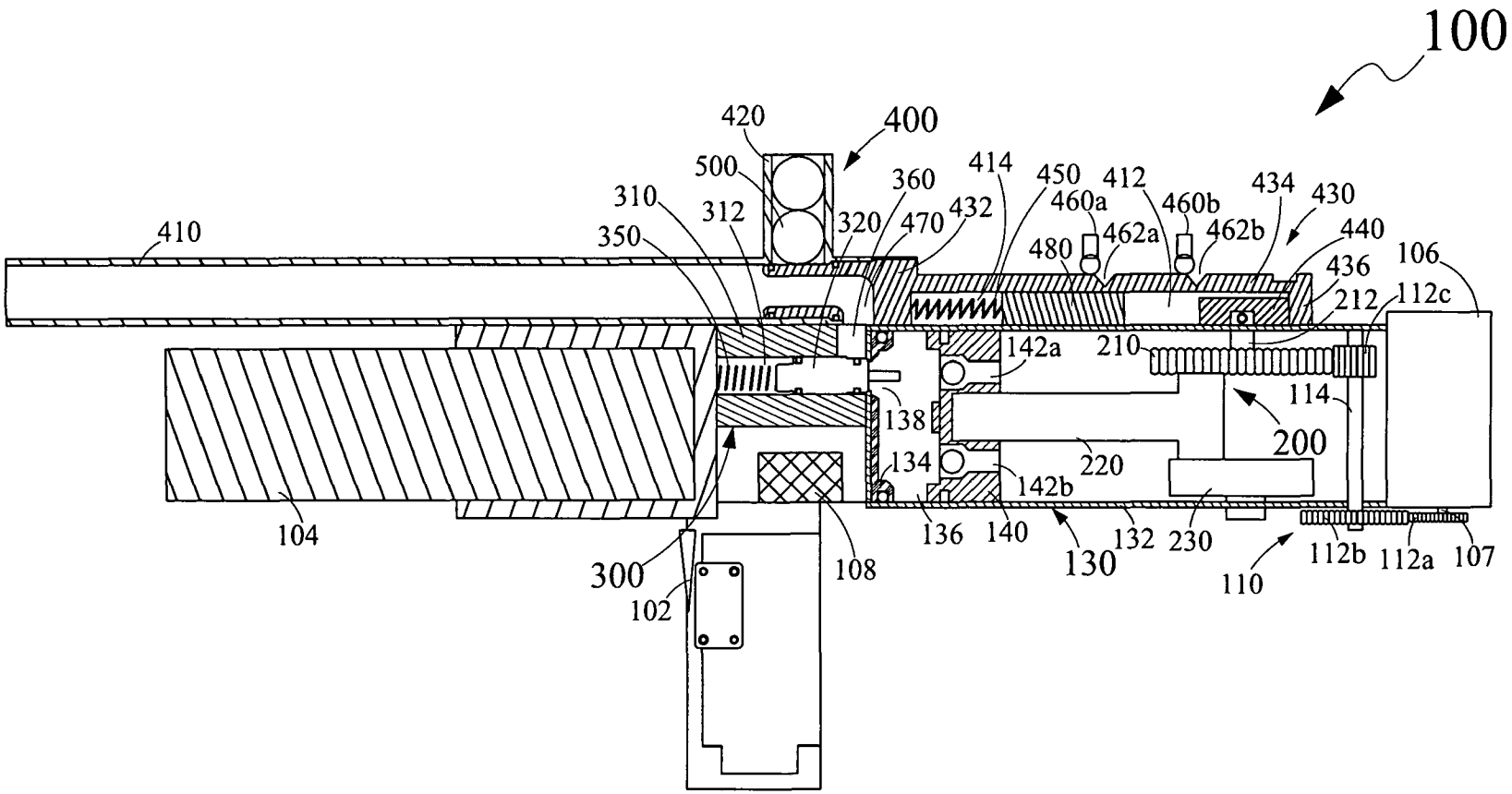
FIG. 1 illustrates a longitudinal cross-sectional view of a projectile launching apparatus, according to an exemplary embodiment of the present invention.

FIG. 1 is a longitudinal cross-sectional view of a projectile launching apparatus 100, according to an exemplary embodiment of the present invention. The projectile launching apparatus 100 includes a start switch 102, a power source 104, a motor 106, a control circuit 108, a gear reduction mechanism 110, a cylinder 130, a linear motion converter 200 (herein the linear motion converter 200 is a slider crank arrangement, so hereinafter the 'linear motion converter 200' is interchangeably referred to as the 'slider crank arrangement 200'), a compression valve arrangement 300 and a breech assembly 400. The projectile launching apparatus 100 is capable of launching a projectile 500 from a barrel 410 of the breech assembly 400 with the help of a gas compressed within the cylinder 130 due to a reciprocal movement of a piston 140 coupled to the linear motion converter 200.

The projectile launching apparatus 100 starts by pressing ON the start switch 102. The power source 104 is configured to supply power to the motor 106 through the control circuit 108. Specifically, the motor 106 is electrically connected to the power source 104 through the control circuit 108. The control circuit 108 may be any electronic based apparatus that is capable of connecting power to the motor 106 for the purpose of initiating an operation cycle of the projectile launching apparatus 100. The control circuit 108 is further capable of disconnecting the power to the motor 106 after the operation cycle of the projectile launching device 100 is completed. Herein, the operation cycle of the projectile launching apparatus 100 denotes an operation involved in launching the projectile 500 from the barrel 410 of the projectile launching apparatus 100 upon once pressing the start switch 102 ON. The motor 106 generates a rotational movement, when the motor 106 is powered ON and the rotational movement of the motor 106 is transferred to a movement of the linear motion converter 200 through the gear reduction mechanism 110.

In the exemplary embodiment of the present invention as shown in FIG. 1, the gear reduction mechanism 110 includes a plurality of gears, such as a gear 112*a*, a gear 112*b* and a gear 112*c* (hereinafter collectively referred to as 'gears 112'). The gears 112 are configured to transfer the rotational movement of the motor 106 into the movement of the linear motion converter 200. Herein, for the purpose of exemplary representation, the gears 112 are represented as spur gears in FIG. 1. However, it will be apparent to a person skilled in the art that the gears 112 may include other type of gears, such as a helical gear, a bevel gear and a face gear. Further, the gear reduction mechanism 110 may include a plurality of such gears or a combination of such gears, which are capable of transferring the rotational movement of the motor 106 to the movement of the linear motion converter 200.

The gear 112*a* is coupled to a motor shaft 107, and accordingly transfers the rotational movement of the motor 106 to the gear 112*b*, which is in mesh with the gear 112*a*. The gear 112*b* is further coupled to the gear 112*c* through a shaft 114, which rotates the gear 112*c* alongwith the rotation of the gear 112*b*. Further, the gear 112*c* is coupled to the linear motion converter 200 and causes the movement in the linear motion converter 200. In this manner, the rotational movement of the motor 106 is transferred into the movement of the linear motion converter 200 through the gears 112*a*, 112*b* and 112*c* of the gear reduction mechanism 110, in a sequence.

Although, herein, the linear motion converter 200 is represented as the slider crank arrangement 200, but it will be apparent to a person skilled in art that the linear motion converter 200 may be any suitable mechanism that converts the rotational movement of the motor 106 into a linear reciprocal movement of any element. For example, the linear motion converter may include other arrangements such as a rack and pinion arrangement, a lead screw arrangement and a crankshaft and connecting rod arrangement.

The slider crank arrangement 200 includes a crank wheel 210, a crank link 220 and a support link 230. The crank wheel 210 is meshed with the gear 112*c*, and the rotational motion of the gear 112*c* causes the crank wheel 210 to rotate. In the present exemplary embodiment of the present invention, the crank wheel 210 is represented as the spur gear and it should not be considered limiting. The crank link 220 is connected at a point (not shown) on a periphery of the crank wheel 210, which enables a combined rotational and reciprocal movement of the crank link 220 with the rotation of the crank wheel 210. The crank link 220 is coupled to the support link 230 which also rotates with the movement of the crank link 220. The support link 230 rotates about a shaft (not shown), which is adjacent to the shaft 114.

The crank link 220 is further coupled to the piston 140, which is functionally disposed within the cylinder 130. The movement of the crank link 220 of the linear motion converter 200 enables the piston 140 to move reciprocally within the cylinder 130. The piston 140 follows a cylinder guide 132, which is configured on an inner surface of the cylinder 130 while reciprocating within the cylinder 130.

The cylinder 130 further includes a cylinder end cap 134. The cylinder end cap 134 is disposed at a first end towards a top dead centre (TDC) of the cylinder 130. The piston 140 reciprocates within the cylinder 130 and accordingly defines a gas chamber 136 within the cylinder 130 between the cylinder end cap 134, the cylinder guide 132 and the piston 140. It will be apparent to a person skilled in the art that the gas chamber 136 is a dynamic component having a length varying with the reciprocal movement of the piston 140. The gas chamber 136 is capable of accommodating gas therein.

Further, the projectile launching apparatus 100 includes at least one check valve, such as a check valve 142*a* and a check valve 142*b* (hereinafter collectively referred to as 'check valves 142') to receive the gas within the gas chamber 136 with the reciprocal movement of the piston 140. Specifically, the check valves 142 are configured to attain an open position and a closed position. The open position of the check valves 142 enables an entry of the gas into the gas chamber 136 of the cylinder 130 and the closed position of the check valves 142 prevents any exit of the gas occupied within the gas chamber 136. In one embodiment of the present invention, the check valves 142 are disposed on the piston 140. However, it will be evident to a person skilled in the art that the check valves 142 may also be positioned at a variety of locations on a body of the cylinder 130. When the piston 140 reciprocates away from the cylinder end cap 134, the check valves 142 adopt the open position to allow the entry of the gas into the gas chamber 136. Further, when the piston 140 reciprocates towards the cylinder end cap 134, the piston 140 tends to compress the gas received within the gas chamber 136. In such as situation, the check valves 142 adopt the closed position to prevent any exit of the gas that is compressed by the piston 140. The gas compressed by the piston 140 may be termed as 'compressed gas' within the gas chamber 136. The compressed gas within the gas chamber 136 is released into the barrel 410 through the compression valve arrangement 300. In one embodiment of the present invention, the cylinder end cap 134 has a hollow portion 138 that may be closed or opened by the compression valve arrangement 300 in order to prevent any exit of the compressed gas or release of the compressed gas stored within the gas chamber 136 into the barrel 410, respectively.

Figure 2:
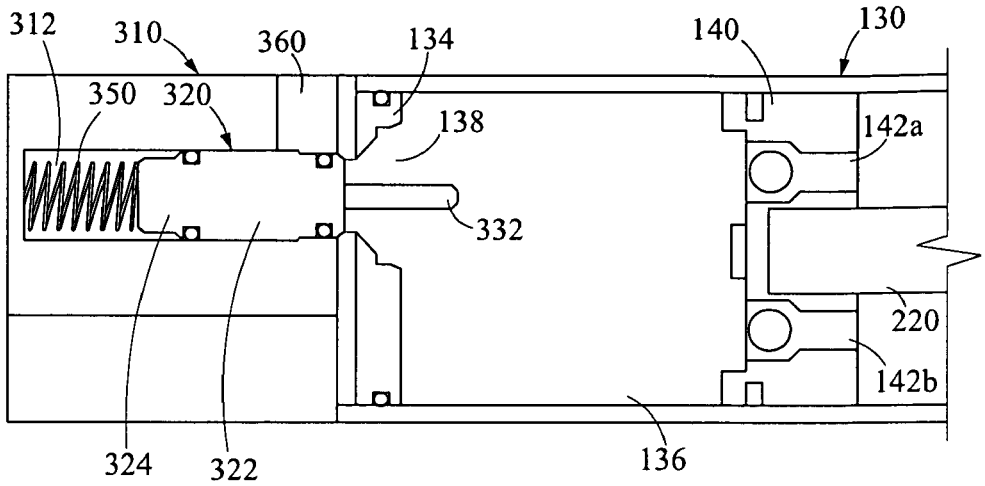
FIG. 2 illustrates a partial side view of a compression valve arrangement coupled to a cylinder of the projectile launching apparatus, according to an exemplary embodiment of the present invention.

Referring to FIGS. 2-5, various views of the compression valve arrangement 300 is illustrated in detail. In FIG. 2, a partial side view of the compression valve arrangement 300 is shown. The compression valve arrangement 300 includes a valve body 310 having a groove 312 extending along a longitudinal axis X-X of the valve body 310. A front end portion of the groove 312 extends to the hollow portion 138 of the cylinder end cap 134 and a rear end portion of the groove 312 is a closed configuration. A valve spool 320 is disposed within the groove 312 of the valve body 310 along the longitudinal axis X-X and is capable of reciprocating linearly within the groove 312. In one exemplary embodiment of the present invention, the valve spool 320 has a cylindrical body having a stepped structure configured by a primary body portion 322 and a concentric secondary body portion 324. Further, the secondary body portion 324 may have a polygonal configuration including at least two parallel sides. The polygonal configuration of the second body portion 324 has a wear advantage over a cylindrical configuration of the second body portion 324. This is due to the non rotation of the polygonal configuration. Since the valve spool cannot rotate, over time the polygonal valve spool will wear a small groove at the contact point with valve retainers 340. Once the groove 312 is worn onto the valve spool 320, the contact area between the valve spool 320 and the valve retainers 340 becomes a line contact instead of a point contact thereby reducing the stress by significant factor.

Figure 3:
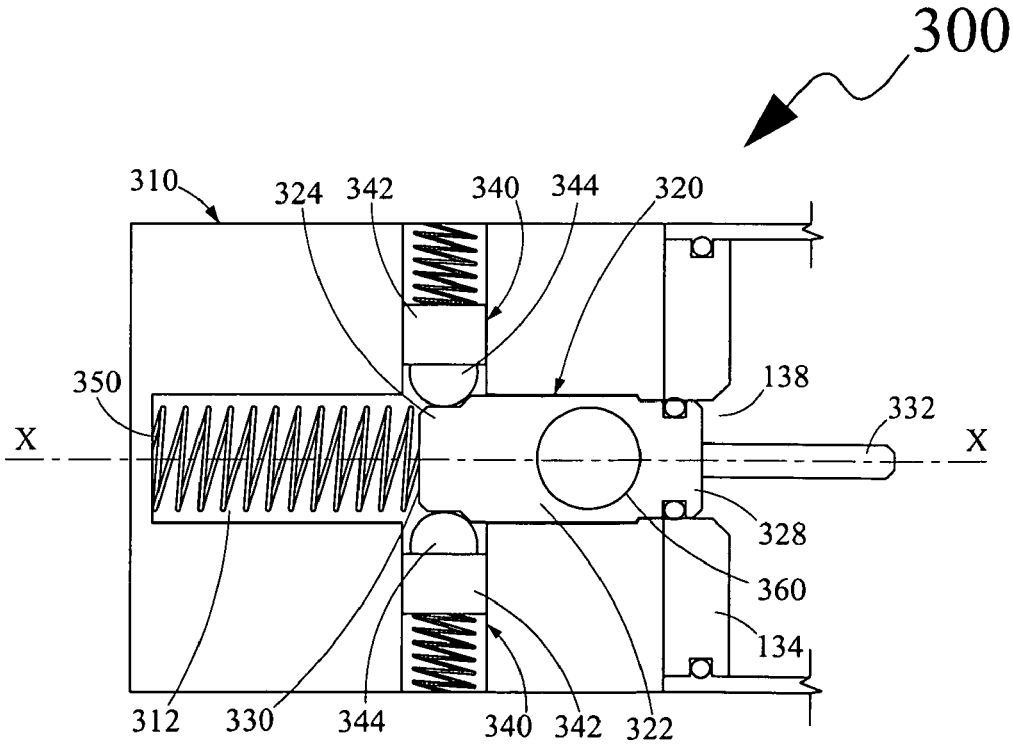
FIG. 3 illustrates a partial top view of the compression valve arrangement in a closed position, according to an exemplary embodiment of the present invention.

A top view of the compression valve arrangement 300 is represented in FIG. 3. As represented in FIG. 3, in one embodiment of the present invention, the primary body portion 322 has a diameter greater than a diameter of the secondary body portion 324. The secondary body portion 324 gradually extends from the primary body portion 322 in a manner such that the graduation of the primary body portion 322 into the secondary body portion 324 configures a chamfered portion 326 (see FIG. 4). The valve spool 320 further has a front face portion 328, a rear face portion 330 and a valve spool stem 332 extending outwardly from the front face portion 328 along a longitudinal axis X-X of the valve spool 320. Referring to FIG. 3, in the closed position of the compression valve arrangement 300, the front face portion 328 of the valve spool 320 fits into the hollow portion 138 of the cylinder end cap 134 and closes the hollow portion 138, and the valve spool stem 332 extends into the gas chamber 136 of the cylinder 130.

The compression valve arrangement 300 further comprises a pair of valve retainers 340 positioned in an opposed relationship laterally along the groove 312 of the valve body 310. In one embodiment, each valve retainer 340 is in the form of a cup 342 and a retention ball 344. In the closed state of the compression valve arrangement 300, when the valve spool 320 closes the hollow portion 138 of the cylinder end cap 134, the valve spool 320 is retained in such a position by the valve retainers 340. The valve retainers 340 are positioned in a manner such that the retention balls 344 gets engaged with the chamfered portion 326 of the valve spool 320, which applies a pressure on the valve spool 320 and prevents the valve spool 320 to move from the position closing the hollow portion 138 of the cylinder end cap 134. More specifically, referring to FIG. 2, a longitudinal side view representing the closed position of the compression valve arrangement 300, is shown, where the valve spool stem 332 lies inside the gas chamber 136 of the cylinder 130.

Additionally, the compression valve arrangement 300 comprises a valve return spring 350 disposed within the groove 312 and towards the rear end portion of the groove 312. The valve return spring 350 is operatively coupled to the rear face portion 330 of the valve spool 320. The compression valve arrangement 300 further comprises a gas passageway 360 between the groove 312 and the barrel 410 of the breech assembly 400. The gas passageway 360 is a passageway that extends from the groove 312 and opens into the barrel 410.

In an initial stage of the operation cycle of the projectile launching apparatus 100, the compression valve arrangement 300 is maintained in the closed position, where the front face portion 328 of the valve spool 320 is disposed in the hollow portion 138 of the cylinder end cap 134 and the primary body portion 322 of the valve spool 320 substantially closes the gas passageway 360. Further, in the open position of the compression valve arrangement 300, the valve spool 320 is moved toward the rear end portion of the groove 312 such that the valve spool 320 does not close the hollow portion 138 of the cylinder end cap 134. Further, the primary body portion 322 of the valve spool 320 also does not block the gas passageway 360. Accordingly, the compressed gas may be released into the barrel 410 from the gas chamber 136 through the hollow portion 138 of the cylinder end cap 134 and the gas passageway 360.

Figure 4:
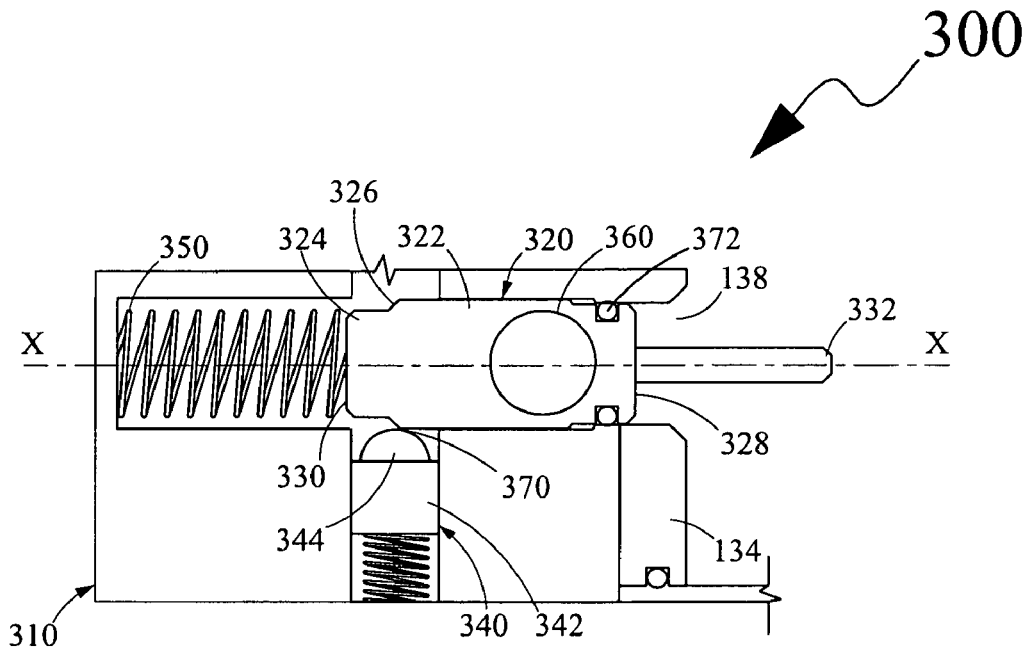
FIG. 4 illustrates a partial top view of the compression valve arrangement illustrating a tipping point of the compression valve arrangement, according to an exemplary embodiment of the present invention.
Figure 5:
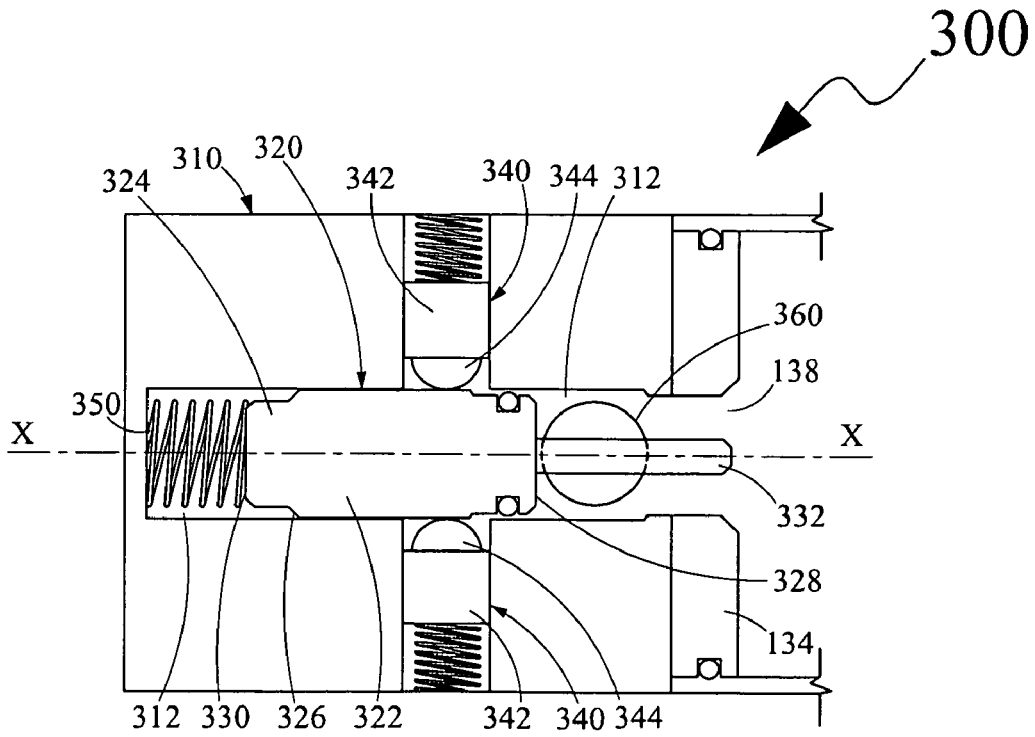
FIG. 5 illustrates a partial top view of the compression valve arrangement in an open position, according to an exemplary embodiment of the present invention.

The opening of the compression valve arrangement 300 is represented in FIGS. 4-5. FIG. 4 represent a tipping point position, which is an intermediate position that occurs, as the compression valve arrangement 300 advances from the closed position to the open position. Further, FIG. 5 illustrates a top view of the compression valve arrangement 300 illustrating the open position of the compression valve arrangement 300, according to an exemplary embodiment of the present invention. The open position of the compression valve arrangement 300 corresponds to the position of the valve spool 320 towards the rear end portion of the groove 312 such that the valve spool 320 opens the hollow portion 138 of the cylinder end cap 134. The valve spool 320 moves toward the rear end portion of the groove 312 depending on the movement of the piston 140 in the cylinder 130. The piston 140 is configured to push the valve spool 320 with help of the compressed gas in the gas chamber 136 to open the compression valve arrangement 300.

In one embodiment of the present invention, the compression valve arrangement 300 adopts the open position just before the piston 140 reaches the TDC of the cylinder 130. The advantage of opening of the compression valve arrangement 300 while the piston 140 is still advancing is that the pressure of the compressed gas in the gas chamber 136 does not force the piston 140 back. Additionally, if the compression valve arrangement 300 opens too early, the pressure offered by the compressed gas in the gas chamber 136 may be insufficient to launch the projectile 500 at a desired velocity. Furthermore, if the compression valve arrangement 300 opens too late, the piston 140 starts to move towards a bottom dead centre (BDC) before the projectile 500 is launched from the barrel 410. This causes a rapid drop in the pressure of the compressed gas released into the barrel 410 resulting in decreasing the speed of the projectile 500 and thereby decreasing an efficiency of the projectile launching apparatus 100.

The present invention also takes several other parameters into account that may affect the opening of the compression valve arrangement 300. These parameters may be important for the configurational features of the compression valve arrangement 300. Some of these parameters include, but are limited to, a pressure drop through the compression valve arrangement 300, an opening time of the compression valve arrangement 300 and a volume of the gas passageway 360. In a preferred embodiment, the compression valve arrangement 300 is referred to as a snap acting valve. More specifically, the opening time of the valve spool 320 should be less than 20 milliseconds (0.020 seconds). Herein, the opening time of the valve spool 320 is considered as an interval between a time when the valve spool 320 is closed and a time when the valve spool 320 is at least 70 percent open. Further herein, the at least 70 percent open corresponds to a position of the valve spool 320, where there is a release of the compressed gas by substantially 70 percent of an optimum flow of release of the compressed gas. The valve spool 320 needs to be opened completely and in a quick manner such that the energy of expansion of the compressed gas required in the barrel 410 is not lost to the valve spool 320 and the valve retainers 340. Considering an example, if the valve were to open in 0.100 seconds, the energy of expansion would be lost to the valve spool 320 and the valve retainers 340, and the ability to transfer the energy from the compressed gas into the barrel 410 to launch the projectile 500 would be greatly restricted. In one embodiment of the present invention, the valve spool 320 may be mechanically tripped with a single stroke of the piston 140 by a pressure applied by at least one of the compressed gas and the valve spool stem 332. In another embodiment of the present invention, the valve spool is further adapted to be cooperatively opened with an electric solenoid in addition to the pressure of the compressed gas. This will further provide a controlled opening of the valve spool 320 of the compression valve arrangement 300.

In one embodiment of the present invention, an opening force that may propel the projectile 500, such as a standard paintball with a velocity of approximately 280 Feet per Second (fps) may be generated, when the gas in the gas chamber 136 is compressed by a force of approximately 160 Pounds per Square Inch (psi) with a volume of approximately 1.0 cubic inch. Further, the volume of gas contained in gas passageway 360 should be less than 15 percent of a volume of an initial uncompressed gas in the gas chamber 136, i.e., when the piston 140 is at the TDC of the cylinder 130, for launching the projectile 500 from the barrel 410. Thus, the compression valve arrangement 300, which opens completely and in a quick manner to launch the projectile 500 from the barrel 410 with a high velocity, should not have a too high volume in the gas passageway 360.

Furthermore, a high Cv (flow coefficient of a valve, which relates a pressure drop of a gas across the valve to a flow of the gas through the valve) characteristic and snap action features of the compression valve arrangement 300 with the low volume of gas contained within the gas passageway 360 result in a significant reduction of a compression energy that is required to launch the projectile 500. Typically, at a given pressure drop, a compression valve arrangement having a high Cv provides a larger flow of gas than a compression valve arrangement having a low Cv. Therefore, in the present invention, the compression valve arrangement 300 is configured with the high Cv. This results in a fast opening speed of the compression valve arrangement 300 and very efficient conversion of the energy of the compressed gas in the gas chamber 136 through the compression valve arrangement 300 to launch the projectile 500 with the high velocity.

In one embodiment of the present invention, the opening of the valve spool 320 may be understood with the following consideration. The valve spool 320 weighs approximately 1 oz, an opening force of approximately 24 lbs is required to push the valve spool 320 against the valve retainers 340 in order to bring the valve spool 320 in the open position and a restoration force of the valve return spring 350 is approximately 3 lbs. Further, the front face portion 328 of the valve spool 320 has a diameter of approximately 0.437 inches. When a pressure of the compressed gas in the gas chamber 136 reaches to approximately 160 psi, a force of approximately 24 lbs is applied on the front face portion 328 of the valve spool 320. This moves the valve spool 320 past a tipping point 370 (a displacement of approximately 0.06 inches from the closed position) at which the retention force on the valve spool 320 drops to 3 lbs as there is only the restoration force of the valve return spring 350, which opposes the movement of the valve spool 320 at the moment. The opening force on the valve spool 320 is approximately 21 lbs. The tipping point 370 is clearly shown in FIG. 4 in which an O-ring 372 on the valve spool 320 has not moved past the gas passageway 360. In this position, the compression valve arrangement 300 is still in the closed position and accordingly, the compressed gas in the gas chamber 136 is not released into the barrel 410. In an embodiment of the present invention, the O-ring 372 is an electrometric element that functions as a sealing member to allow clearance between the valve spool 320 and the valve body 310. In this exemplary embodiment of the present invention, the open position of the valve spool 320 is illustrated as 0.5 inches from the closed position in FIG. 5. A distance of the valve spool 320 to the open position is traversed in less then approximately 5 milliseconds, resulting in nearly instantaneous release of the compressed gas to the barrel 410 from the gas chamber 136 through the gas passageway 360.

After the tipping point 370, the valve retainers 340 only provide a frictional force to the valve spool 320. This frictional force is far less than a direct force applied by the valve retainers 340 on the valve spool 320. In the embodiment shown in FIGS. 2-5, once the retention balls 344 ride up the chamfered portion 326 on the valve spool 320, the force applied by the retention balls 344 to maintain the valve spool 320 in its position changes from 45 degrees (or the angle of the chamfered portion 326) to 90 degrees, which is perpendicular to the movement of the valve spool 320. This essentially stops the retention balls 344 and the valve retainers 340 from retaining the valve spool 320, as the valve retainers 340 acts perpendicularly to the movement of the valve spool 320 and may no longer restrain the valve spool 320. In such a situation, only force that maintains the valve spool 320 in the closed position is the restoration force applied by the valve return spring 350. The valve return spring 350 is configured such that the restoration force applied by the valve return spring 350 is substantially less than the pressure of the compressed gas applied to the front face portion 328 of the valve spool 320. Therefore, the valve spool 320 of the compression valve arrangement 300 snaps to the open position, which is shown in FIG. 5. Further, the compressed gas in the gas chamber 136 of the cylinder 130 starts passing into the barrel 410 through the gas passageway 360 of the compression valve arrangement 300.

In another embodiment of the present invention, the piston 140 applies pressure on the valve spool stem 332 while proceeding towards the cylinder end cap 134, thereby causing the valve spool 320 to open the gas passageway 360 in addition to the pressure applied by the compressed gas within the gas chamber 136. A person skilled in the art would appreciate the fact that the valve spool stem 332 allows the piston 140 to hold the valve spool 320 in the open position even when the pressure in the gas chamber 136 drops. This further improves the efficiency of the compression valve arrangement 300 since the valve spool 320 is held in the open position even if the pressure in the gas chamber 136 drops below the pressure required to hold the valve spool 320 in the open position against the restoration force of the valve return spring 350.

Once the valve spool 320 is opened, it is maintained in the open position by the pressure of the compressed gas in the gas chamber 136 until the pressure of the compressed gas in the gas chamber 136 drops below the restoration force of the valve return spring 350. Finally, when the piston 140 reaches the TDC of the cylinder 130, causes the maximum amount of compressed gas in the gas chamber 136 to be delivered to the barrel 410 through the gas passageway 360. The compressed gas in the barrel 410 expands and launches the projectile 500 out of the barrel 410.

Referring again to FIG. 1, the breech assembly 400 includes the barrel 410, a projectile inlet port 420 and a bolt 430. The projectile inlet port 420 is configured on the barrel 410 and is adapted to receive the projectile 500 into the barrel 410. The bolt 430 includes a front portion 432 and a rear portion 434. The bolt 430 is operatively coupled to a bolt driving mechanism, which is capable of reciprocating the bolt 430 between a first position and a second position. In the first position, the bolt 430 is configured to be partially received within the barrel 410 such that the front portion 432 of the bolt 430 shuts off the projectile inlet port 420. Further, in the second position, the bolt 430 is configured to enable the projectile 500 to enter the barrel 410 from the projectile inlet port 420.

The bolt 430 further includes a bolt passageway 470 configured on the front portion 432 of the bolt 430. The bolt passageway 470 is configured to align with the gas passageway 360 when the bolt 430 is in the first position. When the piston 140 reaches the TDC of the cylinder 130 and the compression valve arrangement 300 opens the gas passageway 360, the bolt 430 is also moved to the first position. Accordingly, the gas passageway 360 and the bolt passageway 470 align to form a duct, through which the compressed gas is released into the barrel 410 from the gas chamber 136. The compressed gas that reaches the barrel 410 through the duct starts expanding in the barrel 410 for applying pressure on the projectile 500 to launch out of the barrel 410 with the high velocity. It will be apparent to a person skilled in the art that the bolt passageway 470 is configured for a safe operation of the projectile launching apparatus 100. This ensures that the compressed gas may only be released in the barrel 410, when the bolt 430 is in the first position and the projectile 500 is chambered in the barrel 410.

The bolt driving mechanism includes a bolt cam 440 and a spring 450. The bolt cam 440 of the bolt driving mechanism is operatively coupled to the linear motion converter 200 and is capable of reciprocating the bolt 430 to the second position. The bolt cam 440 is connected to the linear motion converter 200 through a shaft 212 about which the crank wheel 210 is configured to rotate. Accordingly, the bolt cam 440 is configured to rotate with the rotational movement of the crank wheel 210 as the shaft 212 of the crank wheel 210 is connected to the bolt cam 440. The bolt cam 440 is disposed in a first cavity 412 configured in the rear portion 434 of the bolt 430. The first cavity 412 is configured between a protruding member 480 and a bottom face (not shown) of the bolt 430, which touches a body of the projectile launching apparatus 100. The bottom face of the bolt 430 is configured with a channel capable of accommodating the protruding member 480 therein. Accordingly, the bolt 430 is capable of moving over the protruding member 480 while moving from the first position to the second position and vice versa.

The bolt cam 440 is disposed in the first cavity 412 and is configured to rotate about the shaft 212 of the crank wheel 210 in the first cavity 412. During the rotation of the bolt cam 440, the bolt cam 440 comes into a contact with a bolt contact bar 436 disposed at the rear portion 434 of the bolt 430. Such a contact of the bolt cam 440 applies a force on the bolt contact bar 436 such that the bolt 430 moves backward. More specifically, the bolt cam 440 has a suitable peripheral profile, which touches the bolt contact bar 436 to move the bolt 430 backward. The bolt cam 440 moves the bolt 430 to second position from the first position for opening the projectile inlet port 420 and allowing the projectile 500 to be received into the barrel 410.

The bolt 430 is moved from the second position to the first position by the spring 450, which is accommodated in a second cavity 414. The second cavity 414 is configured between the protruding member 480 and the front portion 432 of the bolt 430 as shown in FIG. 1. In one embodiment of the present invention, the spring 450 may be a bungee. The spring 450 compresses with the backward movement of the bolt 430, i.e., when the bolt 430 reaches the second position, the spring 450 is completely compressed and an energy is stored therein. The spring 450 then tends to expand and thereby pushes the bolt 430 to the first position from the second position. The movement of the bolt 430 towards the first position from the second position closes the projectile inlet port 420 and allows the projectile 500 to get chambered in the barrel 410.

In another embodiment of the present invention, functions of the bolt cam 440 and the spring 450 may be reversed such that the bolt cam 440 moves the bolt 430 from the second position towards the first position and the spring 450 moves the bolt 430 from the first position to the second position. However, the above described functions of the bolt cam 440 and the spring 450 is preferable for avoiding a pinch point at the projectile inlet port 420. The pinch point is avoided as a forward movement, i.e., the second position to the first position, of the bolt 430 may be limited when the spring 450 is used for providing the forward movement of the bolt 430 rather than the bolt cam 440.

The bolt driving mechanism further includes a locking mechanism for locking the bolt 430 in the first position, prior to the releasing of the compressed gas from the cylinder 130 to the barrel 410 through the compression valve arrangement 300. The locking mechanism includes a plurality of spring loaded balls, such as a ball 460*a* and a ball 460*b* and a plurality of detent holes, such as a detent hole 462*a* and a detent hole 462*b*. The balls 460*a* and 460*b* are received in detent holes 462*a* and 462*b*, configured on an upper surface of the bolt 430. Further, the locking mechanism enables in minimizing the backward movement of the bolt 430 when the compressed gas is being released to the barrel 410 through the compression valve arrangement 300. A person skilled in the art will appreciate that upon minimizing the backward movement of the bolt 430, the force applied on the projectile 500 by the compressed gas increases. Additionally, the locking mechanism enables in reducing a mass of the bolt 430 as the locking mechanism tends to overcome the pressure exerted on the bolt 430 when the compression valve arrangement 300 is in the open position. In one embodiment of the present invention, the locking mechanism may be a magnet and a magnetic catch plate such that the magnet attaches to the magnetic catch plate prior to the opening of the compression valve arrangement 300.

Referring now to FIGS. 6-9, a projectile launching apparatus 100 incorporating the slider crank arrangement used as a linear motion converter is shown, according to an exemplary embodiment of the present invention. The projectile launching apparatus 100 as shown in FIGS. 6-9 is similar in terms of the configuration and various components of the projectile launching apparatus 100 as described in conjunction with FIG. 1. Hence, the reference numerals for the various components of the projectile launching apparatus 100 of FIG. 1 are also used for the reference of corresponding components of the projectile launching apparatus 100 shown in FIGS. 6-9. An operation cycle of launching the projectile 500 using the projectile launching apparatus 100 is explained in details in conjunction with FIGS. 6-9.

Figure 6:
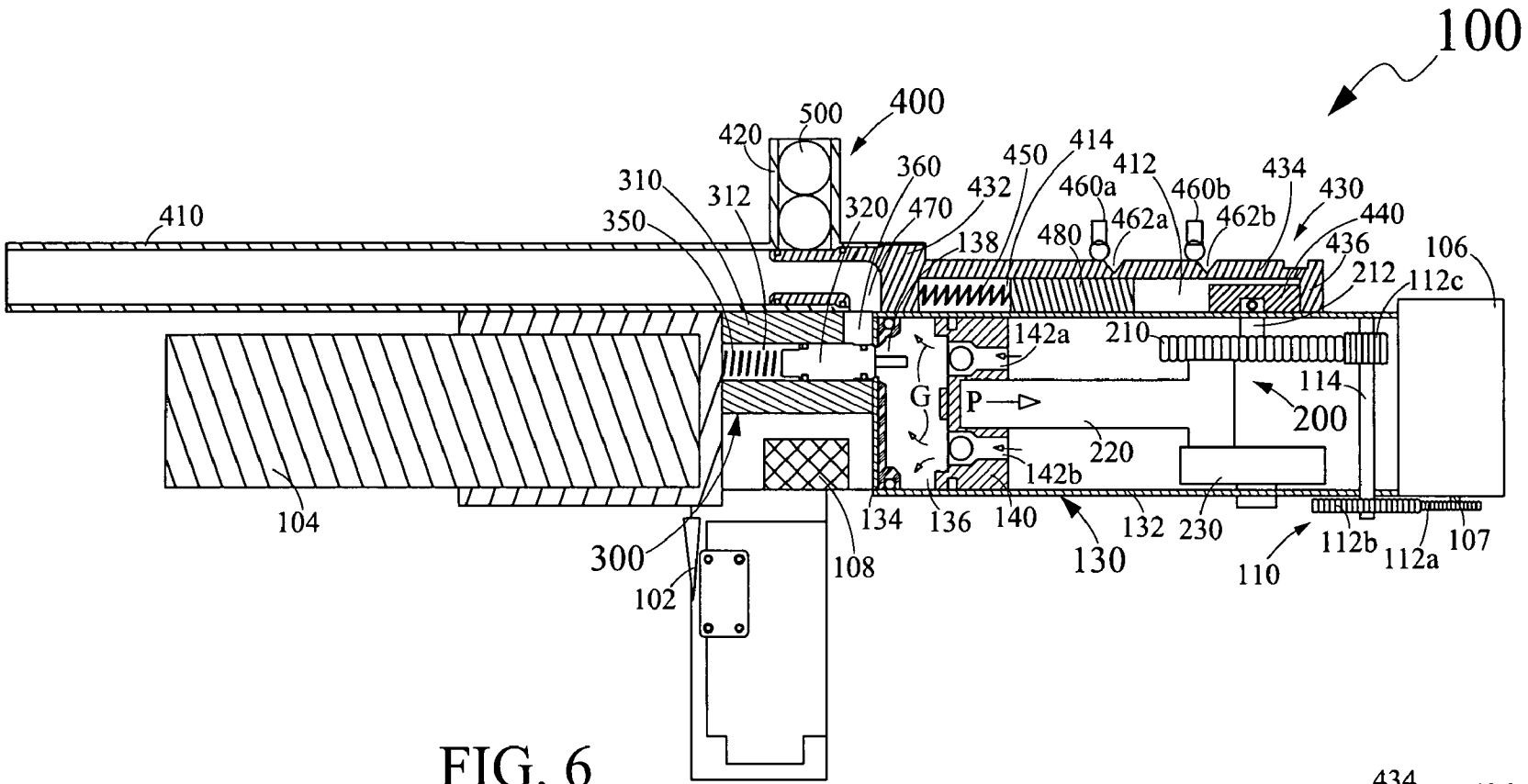
FIG. 6 illustrates a longitudinal cross-sectional view of the projectile launching apparatus incorporating a slider crank arrangement and a cylinder having a piston moving towards a bottom dead centre (BDC) within the cylinder, according to an exemplary embodiment of the present invention.

Various stages of the operation cycle of the projectile launching apparatus 100 begin with the piston 140 positioned close to the TDC, i.e., towards the cylinder end cap 134 of the cylinder 130. Referring to FIG. 6, a longitudinal cross-sectional view of the projectile launching apparatus 100 incorporating the slider crank arrangement 200 with the piston 140 moving towards the BDC from the TDC, is shown. In an embodiment of the present invention, the position of the piston 140 and the compression valve arrangement 300 may be an initial stage of the operation cycle in the projectile launching apparatus 100. In the initial stage, as shown in FIG. 6 and having reference to FIGS. 2-5, the front face portion 328 of the valve spool 320 fits into the hollow portion 138 of the cylinder end cap 134 such that the front face portion 328 closes the hollow portion 138, while the valve spool stem 332 extends into the gas chamber 136 of the cylinder 130. Further, the valve spool 320 is retained in such a position by the valve retainers 340. The operational cycle of the projectile launching apparatus 100 begins with the start switch 102 pressed ON. Further, the motor 106 is powered ON by the power source 104 using the control circuit 108.

The gears 112 rotate once the motor 106 is powered by the power source 104. The crank wheel 210 starts rotating (either clockwise or counterclockwise) upon receiving the rotational movement from the gears 112, causing the piston 140 to move linearly away from the cylinder end cap 134 within the cylinder guide 132, which is shown by arrow marks 'P' in FIG. 6. The movement of the piston 140 towards the BDC of the cylinder 130 opens the check valves 142 disposed on the piston 140 for introducing the gas into the gas chamber 136. Persons skilled in the art will appreciate the fact that the present invention uses the gas, which is the atmospheric air at the atmospheric pressure thereby avoiding the usage of any pre-compressor for pressurizing an intake of the gas into the gas chamber 136. The intake of the gas in the gas chamber 136 is shown by arrow marks 'G'.

In a preferred embodiment of the present invention, a volume of the gas in the gas chamber 136 of the cylinder 130 ranges from 6 to 9 cubic inches at standard temperature and pressure conditions and, more preferably, 8 cubic inches. Further, with the movement of the piston 140 towards the BDC, the bolt 430 also moves from the first position towards the second position with the help of the rotational movement of the crank wheel 210 along with the bolt cam 440, as shown in FIG. 6A.

Figure 6A:
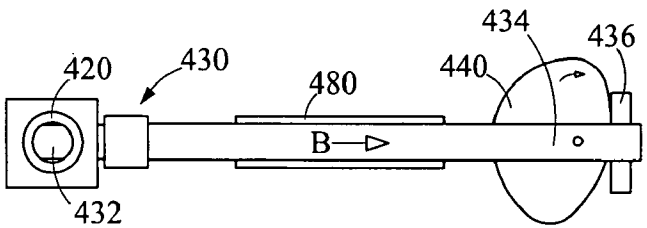

Referring now to FIG. 6A, a partial top view of the projectile launching apparatus 100 with the bolt 430 moving from the first position towards the second position for opening the projectile inlet port 420, is shown, in accordance with an exemplary embodiment of the present invention. The rotational movement of the slider crank arrangement 200, more specifically the rotational movement of the crank wheel 210 is transferred to the bolt 430 with the help of the bolt cam 440. The bolt cam 440 rotates (either clockwise or counterclockwise) about the shaft 212. The rotational movement of the bolt cam 440 depends on the rotational movement of the crank wheel 210. As shown in FIG. 6A, the bolt 430 is in the first position, closing the projectile inlet port 420 and the rotational movement of the bolt cam 440 causing the bolt 430 to move towards the second position of the bolt 430 for opening the projectile inlet port 420. More specifically, the bolt cam 440 touches the bolt contact bar 436 and tends to move the bolt 430 backward, i.e., towards the second position of the bolt 430. Further, in this state, the spring 450 of the bolt driving mechanism starts to compress with the backward movement of the bolt 430. Furthermore, with the backward movement of the bolt 430, the gas chamber 136 is also occupied with the preferred volume of gas and the piston 140 reaches the BDC of the cylinder 130, as explained further in conjunction with FIG. 7.

Figure 7:
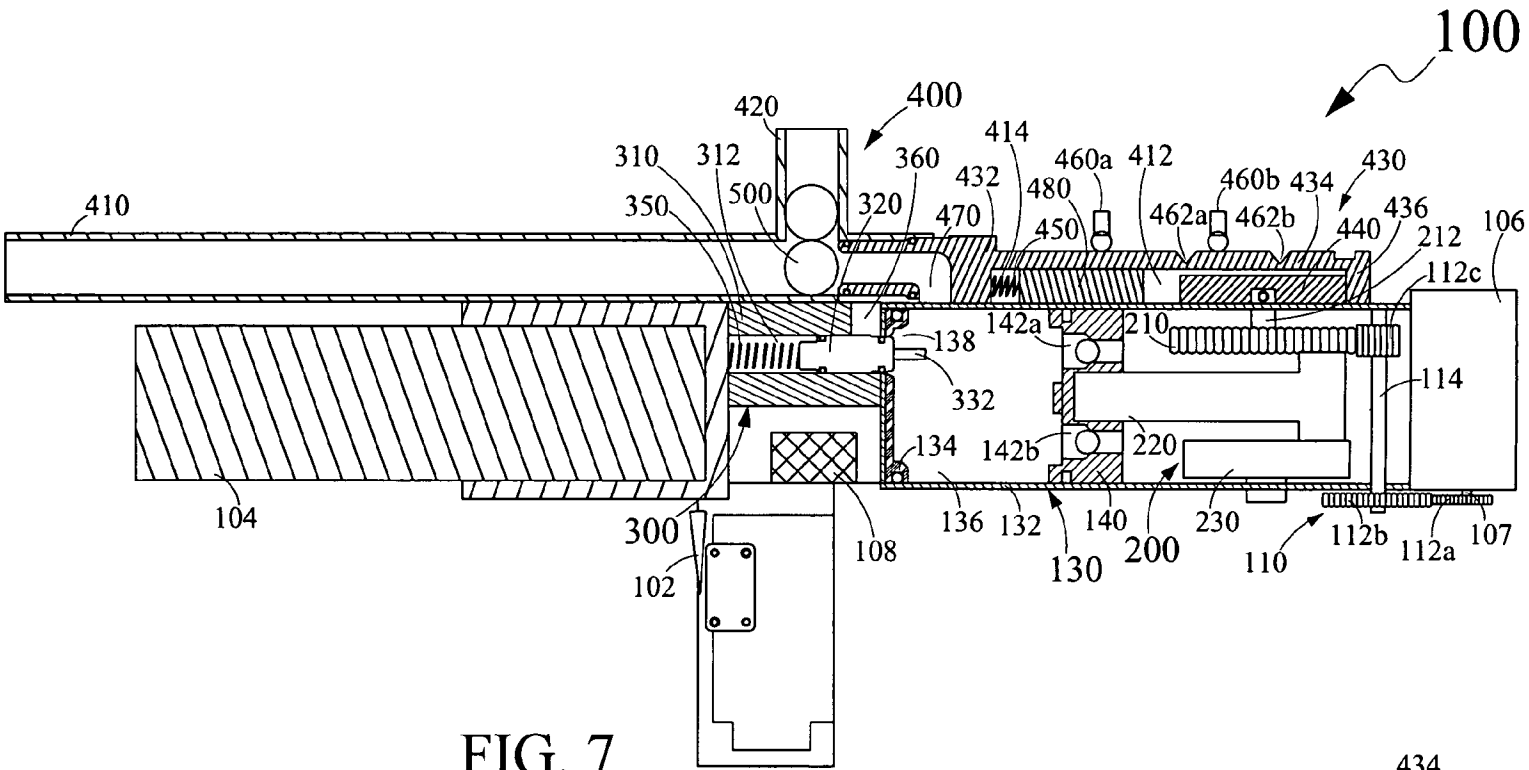
FIG. 7 illustrates a longitudinal cross-sectional view of the projectile launching apparatus incorporating the slider crank arrangement with the piston positioned at the BDC of the cylinder, according to an exemplary embodiment of the present invention.

Referring now to FIG. 7, a longitudinal cross-sectional view of the projectile launching apparatus 100 incorporating the slider crank arrangement 200 with the piston 140 positioned at the BDC of the cylinder 130 is shown, according to an exemplary embodiment of the present invention. Once the piston 140 reaches the BDC of the cylinder 130, the check valves 142 come to the closed position enabling the storing of a preferred volume of gas within the gas chamber 136. At the same time, the bolt 430 moves towards the second position of the bolt 430 with the help of the rotational movement of the bolt cam 440, as shown in FIG. 7A.

Figure 7A:
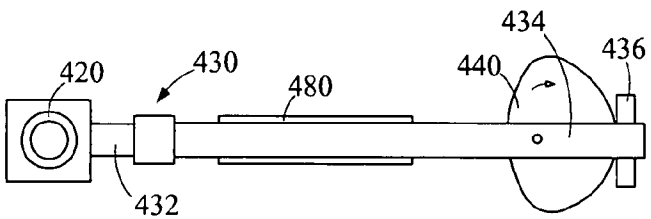

FIG. 7A illustrates a partial top view of the projectile launching apparatus 100 with the bolt 430 positioned at the second position, in accordance with an exemplary embodiment of the present invention. A continued rotational movement of the bolt cam 440 about the shaft 212 moves the bolt 430 to the second position. As shown in FIG. 7A, when the bolt 430 is in the second position, the projectile inlet port 420 opens, which allows the projectile 500 to be fed into the barrel 410. In one embodiment of the present invention, the breech assembly 400 may include a projectile feeder (not shown) configured on the projectile inlet port 420. The projectile feeder is adapted to accommodate plurality of projectiles, such as the projectile 500 and capable of feeding the projectiles into the projectile inlet port 420. Further, the projectile feeder is electrically coupled to the control circuit 108 in order to control the operation of the projectile feeder. Specifically, the projectile feeder receives signals generated by the control circuit 108 for operating the projectile feeder in a controlled manner. Additionally, the coupling of the projectile feeder with the control circuit 108 also eliminates the need for external batteries for the running of the projectile feeder as the projectile feeder may obtain power from the power source 104 through the control circuit 108.

In the second position of the bolt cam 440, the spring 450 of the bolt driving mechanism is in a compressed state as the bolt 430 moves towards the second position by compressing the spring 450. More specifically, the front portion 432 of the bolt 430 moves longitudinally in the second cavity 414 and thereby compressing the spring 450, disposed in the second cavity 414.

Figure 8:
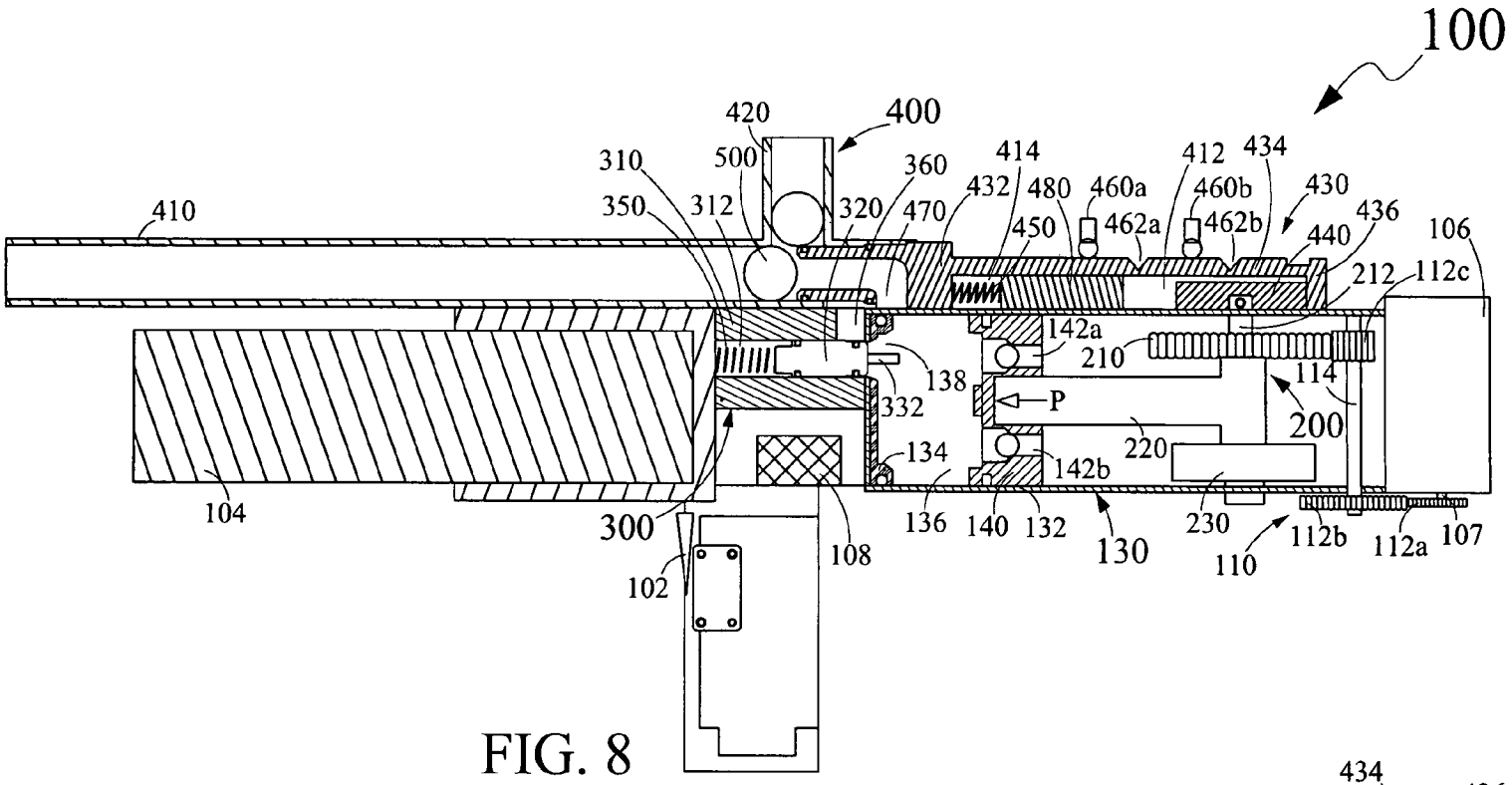
FIG. 8 illustrates a longitudinal cross-sectional view of the projectile launching apparatus incorporating the slider crank arrangement with the piston moving towards a top dead centre (TDC) of the cylinder, according to an exemplary embodiment of the present invention.
Figure 8A:
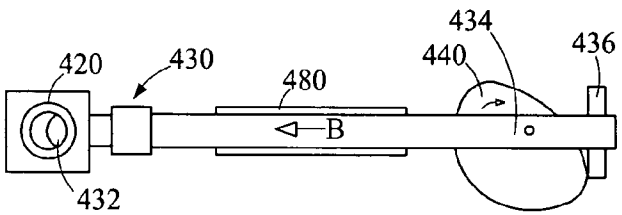

Further, a next stage of the operation cycle of the launching the projectile 500 is explained in conjunction with FIGS. 8 and 8A. The continued rotational movement of the crank wheel 210 moves the piston 140 towards the TDC, i.e., towards the cylinder end cap 134 of the cylinder 130, as shown in FIG. 8. FIG. 8 illustrates a longitudinal cross-sectional view of the projectile launching apparatus 100 incorporating the slider crank arrangement 200 with the piston 140 moving towards the TDC of the cylinder 130. The piston 140 moves towards the cylinder end cap 134 for compressing the gas occupied within the gas chamber 136, which is shown by arrow marks 'P'. While the piston 140 moves towards the TDC, the check valves 142 remain in the closed position to prevent any exit of the gas occupied within the gas chamber 136. The piston 140 continuously compresses the occupied gas in the gas chamber 136 while moving towards the TDC.

In this stage of the operation cycle of launching the projectile 500, the valve spool 320 is disposed in the hollow portion 138 of the cylinder end cap 134 that closes the hollow portion 138 and the gas passageway 360. The closing of the hollow portion 138 by the valve spool 320 has been already described in conjunction with FIGS. 2-5. Further, when the piston 140 moves towards the TDC of the cylinder 130, the bolt 430 simultaneously moves towards the first position of the bolt 430 with a force applied by an expansion of the spring 450.

FIG. 8A illustrates a partial top view of the projectile launching apparatus 100, where the bolt 430 moves towards the first position for partially closing the projectile inlet port 420. Herein, the continued rotational movement of the bolt cam 440 about the shaft 212 moves the bolt cam 440 away from the bolt contact bar 436. Upon moving the bolt cam 440 away from the bolt contact bar 436, the spring 450 expands to move the bolt 430 towards the first position of the bolt 430. More specifically, the stored energy of the spring 450 (when the bolt 430 is positioned in the second position) moves the bolt 430 when the bolt cam 440 starts moving away from the bolt contact bar 436. Referring to FIG. 8 it will be apparent to a person ordinary skilled in the art that the bolt 430 partially closes the projectile inlet port 420 and further chambers the projectile 500 into the barrel 410 of the breech assembly 400. Furthermore, the continued rotational movement of the crank wheel 210 moves the piston 140 to the TDC of the cylinder 130, which is shown in FIG. 9 as a final stage of the operation cycle of launching the projectile 500 from the projectile launching apparatus 100.

Figure 9:
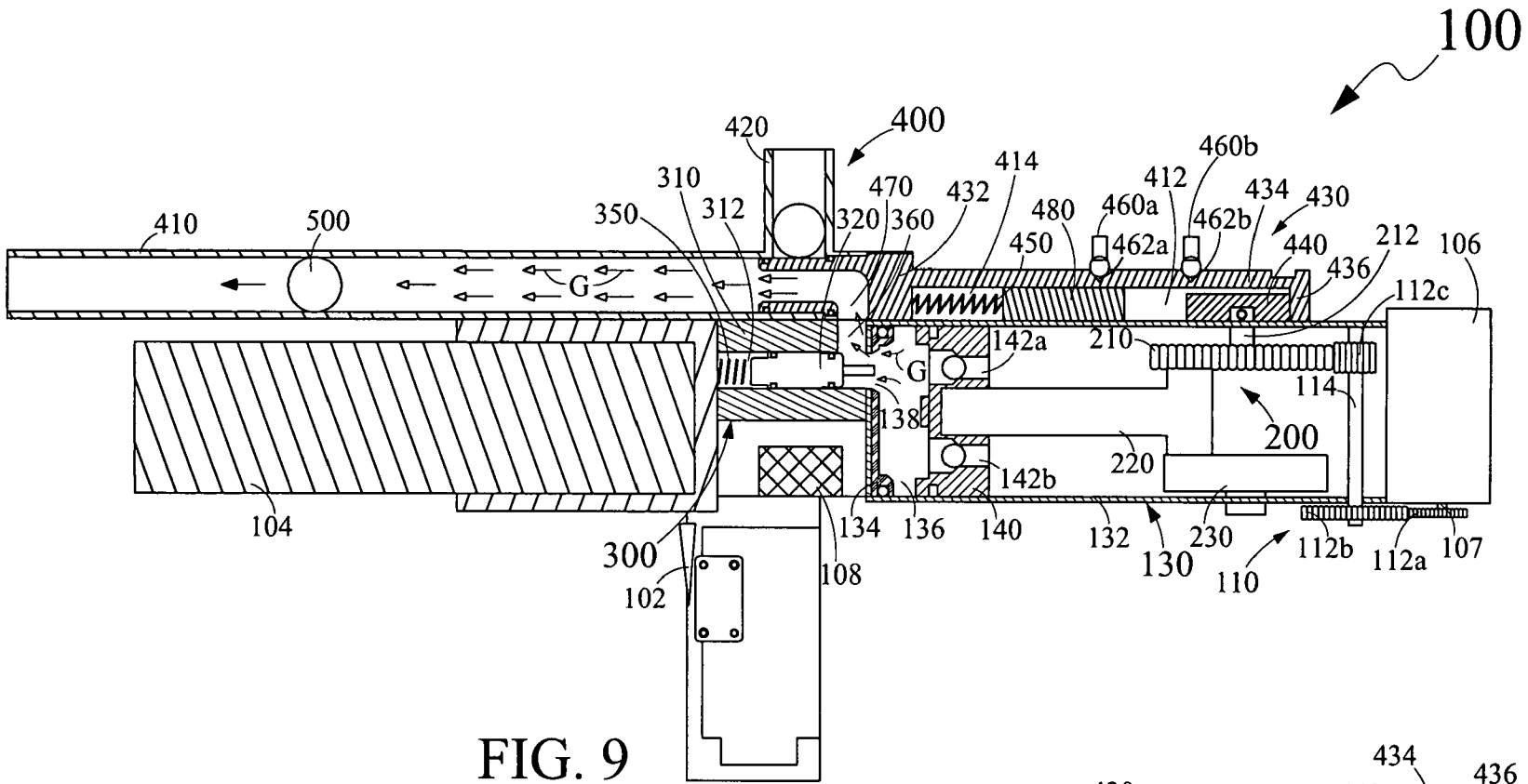
FIG. 9 illustrates a longitudinal cross-sectional view of the projectile launching apparatus incorporating the slider crank arrangement with the piston positioned at the TDC of the cylinder, according to an exemplary embodiment of the present invention.

FIG. 9 illustrates a longitudinal cross-sectional view of the projectile launching apparatus 100 incorporating the slider crank arrangement 200, when the piston 140 is positioned at the TDC of the cylinder 130. The continued rotational movement of the crank wheel 210 moves the piston 140 towards the cylinder end cap 134. Accordingly, the piston 140 continues compressing the gas occupied in the gas chamber 136 while moving towards the TDC. In this state, the compression valve arrangement 300 comes to the open position, when the pressure of the gas compressed inside the gas chamber 136 exceeds a maintaining pressure of the valve spool 320 of the compression valve arrangement 300. The compression valve arrangement 300 may also be in the open position, in case the piston 140 hits the valve spool stem 332 of the valve spool 320. Further, when the piston 140 is at the TDC of the cylinder 130, the bolt 430 moves to the first position of the bolt 430 with the help of the expansion of the spring 450.

Figure 9A:
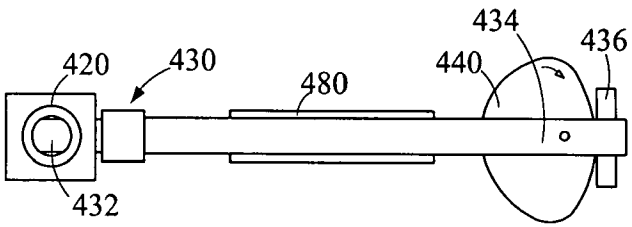

FIG. 9A illustrates a partial top view of the projectile launching apparatus 100 with the bolt 430 positioned at the first position for completely closing the projectile inlet port 420. The continued rotational movement of the bolt cam 440 about the shaft 212 further moves the bolt cam 440 away from the bolt contact bar 436 of the bolt 430. Upon further movement of the bolt cam 440 away from the bolt contact bar 436 of the bolt 430, the spring 450 expands to move the bolt 430 to the first position of the bolt 430. More specifically, the stored energy of the spring 450 continues moving the bolt 430 once the bolt cam 440 starts moving away from the bolt contact bar 436. Referring to FIG. 9 again, it will be apparent to a person ordinary skilled in the art that the bolt 430 completely closes the projectile inlet port 420 and thereby avoids a feeding of another projectile 500 into the barrel 410.

Once the piston 140 reaches the TDC of the cylinder 130, the pressure inside the gas chamber 136 increases to an extent that the pressure of the gas in the gas chamber 136 exceeds the pressure applied by the valve retainers 340 and the valve return spring 350 on the valve spool 320. Further, the piston 140 also applies a force at the valve spool stem 332 that aids in pushing the valve spool 320 towards the rear end portion of the groove 312. This causes the compression valve arrangement 300 to open, i.e., adopting the open position by pushing the valve spool 320 to move linearly inside the groove 312 of the valve body 310 in a manner such that the valve spool 320 opens the hollow portion 138 of the cylinder end cap 134. The position of the compression valve arrangement in this situation may be more specifically referred to as illustrated in FIG. 5, when the valve spool 320 opens the hollow portion 138 and the retention balls 344 crosses the tipping point 370.

As the bolt 430 is positioned at the first position and the compression valve arrangement 300 is also in the open position, the bolt passageway 470 and the gas passageway 360 are aligned to form the duct. Upon aligning of the bolt passageway 470 and the gas passageway 360, the compressed gas from the gas chamber 136 is released into the barrel 410, which is shown by arrows 'G' in FIG. 9. The compressed gas reaching the barrel 410 through the duct starts expanding in the barrel 410 for applying pressure on the projectile 500 to launch the projectile 500 out of the barrel 410 with the high velocity.

In this embodiment of the present invention as described in conjunction with FIGS. 6-9, the launching of the projectile 500 using the pressure of the compressed gas is completed in a single stroke of the piston 140. Herein, a single stroke compression enables in compressing the gas in the gas chamber 136 such that the compression exponent of the gas inside the gas chamber 136 is greater then 1.05. The compression exponent greater than 1.05 yields higher gas pressure for a given compression ratio and increases a volumetric efficiency of the configurational aspect of the projectile launching apparatus 100 by allowing more energy to be stored in a volume of gas compared to the compression done via a normal multi-stroke compressor in which the heat of compression is lost to the environment. In the present embodiment, the projectile launching apparatus 100 has an efficient design such that the single stroke operation is sufficiently short (in terms of time) to yield a compression exponent of approximately 1.1.

Upon completion of the single stroke, i.e. when the piston 140 is at the TDC of the cylinder 130, a maximum amount of compressed gas is delivered to the barrel 410. Further, the compression valve arrangement 300 remains in the open position until the pressure of the compressed gas in the gas chamber 136 drops below the restoration force of the valve return spring 350 and/or the piston 140 moves away from contacting the valve spool stem 332. Specifically, the pressure inside the gas chamber 136 falls below the restoration force applied by the valve return spring 350, which thereby applies pressure on the valve spool 320 causing the valve spool 320 to close the hollow portion 138 of the cylinder end cap 134. Accordingly, with each triggering (i.e., powering of the switch 10), one projectile 500 is launched out of the barrel 410 and the projectile launching apparatus 100 is ready for the next operational cycle to launch another projectile.

FIGS. 10-13 are longitudinal cross-sectional views of a projectile launching apparatus 1000 incorporating a crankshaft and connecting rod arrangement 1100, according to an exemplary embodiment of the present invention. Various stages of the operation cycle of launching the projectile 500 from the projectile launching apparatus 1000 are described in conjunction with FIGS. 10-13. The projectile launching apparatus 1000 is similar to the projectile launching apparatus 100 except for the crankshaft and connecting rod arrangement 1100 used in the place of the linear motion converter 200, and a gear reduction mechanism 1200 associated with the crankshaft and connecting rod arrangement 1100. Therefore, the various components, which are same in both the projectile launching apparatuses 100 and 1000, are referred by the same reference numerals. Hence, the corresponding description of these components may be entirely referred from their description in conjunction with FIGS. 1 and 6-9.

The projectile launching apparatus 1000 includes the crankshaft and connecting rod arrangement 1100 in addition to the components such as the start switch 102, the power source 104, the motor 106, the control circuit 108, the gear reduction mechanism 1200, the cylinder 130, the compression valve arrangement 300 and the breech assembly 400 including the barrel 410 and the projectile inlet port 420. The projectile launching apparatus 1000 is capable of launching the projectile 500 from the barrel 410 of the breech assembly 400 with the help of a compressed gas. The compressed gas is generated within the cylinder 130 due to a reciprocal movement of the piston 140 coupled to the crankshaft and connecting rod arrangement 1100.

The gear reduction mechanism 1200 transfers the rotational movement of the motor 106 into a movement of the crankshaft and connecting rod arrangement 1100. The gear reduction mechanism 1200 includes a plurality of gears (not shown), which are configured to transfer the rotational movement of the motor 106 to the movement of the crankshaft and connecting rod arrangement 1100. The plurality of gears used in the gear reduction mechanism 1200 may include, but are not limited to planetary gears, spur gears, helical gears, bevel gears and face gears. Further, the gear reduction mechanism 1200 may include a plurality of such gears or a combination of such gears.

The gear reduction mechanism 1200 is coupled to a motor shaft (not shown) for transferring the rotational movement of the motor 106 to the crankshaft and connecting rod arrangement 1100. The crankshaft and connecting rod arrangement 1100 includes a crankshaft 1110 and a connecting rod 1120. The crankshaft 1110 comprises a first portion 1112, an intermediate portion 1114 and a second portion 1116. The first portion 1112, the intermediate portion 1114 and the second portion 1116 are configured to constitute a 'U' shaped structure. The crankshaft 1110 is coupled to the connecting rod 1120 at the intermediate portion 1114 of the crankshaft 1110.

The crankshaft 1110 is couple to a rear body portion of the projectile launching apparatus 1000 at the first portion 1112 and the second portion 1116 of the crankshaft 1110. More specifically, the first portion 1112 is functionally coupled with the gear reduction mechanism 1200 and the second portion 1116 is functionally coupled with the breech assembly 400. The connecting rod 1120 includes a front end portion 1122 and a rear end portion 1124. The front end portion 1122 of the connecting rod 1120 is coupled with the piston 140 and the rear end portion 1124 of the connecting rod 1120 is coupled with the intermediate portion 1114 of the crankshaft 1110.

The crankshaft and connecting rod arrangement 1100 is configured to rotate with the rotational movement of the motor 106 as the first portion 1112 of the crankshaft 1110 is coupled to the gear reduction mechanism 1200. Further, the connecting rod 1120 moves within the cylinder 130 with the rotational movement of the crankshaft 1110. The connecting rod 1120 is coupled to the piston 140, and accordingly, the piston 140 reciprocates within the cylinder 130 following the cylinder guide 132 alongwith the movement of the connecting rod 1120.

The crankshaft and connecting rod arrangement 1100 is further capable of moving the bolt 430 of the breech assembly 400. The second portion 1116 is operatively coupled to the bolt 430 and is configured to transfer the rotational movement of the crankshaft 1110 to the bolt 430. More specifically, the bolt 430 is configured to be moved between the first position and the second position with the help of a bolt driving mechanism. Herein, the bolt driving mechanism includes a bolt cam, such as the bolt cam 440 and a spring, such as the spring 450.

The bolt cam 440 is configured to rotate (either clockwise or counterclockwise) about the intermediate portion 1114 of the crankshaft 1110, which connects the bolt cam 440 to the crankshaft 1110. When the bolt 430 is in the first position closing the projectile inlet port 420, the bolt cam 440 is configured to rotate such that the bolt 430 is moved towards the second position of the bolt 430 to open the projectile inlet port 420. More specifically, the bolt cam 440 touches a bolt contact bar, such as the bolt contact bar 436 for moving the bolt 430 backward, i.e., towards the second position of the bolt 430. At the same time the spring 450 of the bolt driving mechanism starts compressing as the bolt 430 moves backward. Further, in this state, the spring 450 of the bolt driving mechanism starts to compress with the backward movement of the bolt 430. Furthermore, with the backward movement of the bolt 430, the gas chamber 136 is occupied with a preferred volume of gas until the piston 140 reaches the BDC of the cylinder 130, as shown in FIG. 10.

An operational cycle of launching the projectile 500 from the barrel 410 of the projectile launching apparatus 1000 is herein described in a sequential manner, with reference to FIGS. 10-13. In FIG. 10, an initial stage of the operation cycle of the projectile launching apparatus 1000 is represented. In one embodiment of the present invention, at the initial stage of the operation cycle, the piston 140 is positioned close to the TDC of the cylinder 130, which is towards the cylinder end cap 134. This stage of the operational cycle begins, as the start switch 102 is pressed ON and correspondingly, the motor 106 is powered by the power source 104 using the control circuit 108.

The gear reduction mechanism 1200 starts rotating once the motor 106 is powered by the power source 104. Further, the crankshaft 1110 starts rotating (either clockwise or counterclockwise) about the first portion 1112 of the crankshaft 1110 upon receiving a rotational movement from the gears 112 of the gear reduction mechanism 1200. This causes the piston 140 to move linearly away from the cylinder end cap 134 within the cylinder guide 132, which is shown by the arrow mark 'P'. The movement of the piston 140 towards the BDC of the cylinder 130 opens the check valves 142 disposed on the piston 140 for introducing the gas into the gas chamber 136, as represented by the arrow mark 'G'. Preferably, the gas that is introduced in the gas chamber 136 is the atmospheric air at the atmospheric pressure, thereby avoiding the usage of any pre-compressor for pressurizing the gas. In a preferred embodiment of the present invention, a volume of the gas in the gas chamber 136 of the cylinder 130 ranges from 6 to 9 cubic inches at standard temperature and pressure conditions and, more preferably, 8 cubic inches.

Further, with the movement of the piston 140 towards the BDC, the bolt 430 also moves from the first position towards the second position. The movement of the bolt 430 towards the second position of the projectile launching apparatus 100 has already been described in conjunction with FIG. 6A. In this stage, the compression valve arrangement is in the closed position. Specifically, the front face portion 328 of the valve spool 320 is disposed in the hollow portion 138 of the cylinder end cap 134 to close the hollow portion 138 and the gas passageway 360. The position of the valve spool 320 closing the hollow portion 138 of the cylinder end cap 134 is more specifically illustrated in FIGS. 2-5 and is explained in conjunction with the projectile launching apparatus 100.

In FIG. 11, a next stage of the operation cycle of the projectile launching apparatus 1000 is represented, where the piston 140 is positioned at the BDC of the cylinder 130, according to an exemplary embodiment of the present invention. Once, the piston 140 reaches the BDC of the cylinder 130 after the initial stage of the operation cycle as described in conjunction with FIG. 10, the check valves 142 disposed on the piston 140 adopt the closed position. The closed position of the check valves 142 enables in occupying a preferred volume of gas in the gas chamber 136. Further, in this stage, the compression valve arrangement 300 remains in the closed position.

Further, when the piston 140 reaches the BDC of the cylinder 130, the bolt 430 is also moved to the second position. The movement of the bolt 430 towards the second position is explained in conjunction with FIG. 7A. As explained in conjunction with FIG. 7A, the bolt cam 440 moves the bolt 430 backward until the bolt 430 reaches the second position. A continued rotational movement of the bolt cam 440 about the second portion 1116 moves the bolt 430 to the second position in order to open the projectile inlet port 420. In the second position of the bolt 430, the projectile inlet port 420 is open for the feeding of the projectile 500 into the barrel 410 of the projectile launching apparatus 1000.

In the second position of the bolt 430, the spring 450 is compressed by the bolt 430. The bolt 430 is capable of moving longitudinally in the second cavity 414, as already explained in conjunction with the projectile launching apparatus 100 in FIG. 1, for compressing the spring 450 accommodated in the second cavity 414. Further, the continued rotational movement of the crankshaft 1110 continues moving the piston 140 towards the TDC of the cylinder 130, as described in conjunction with FIG. 12.

In FIG. 12, a next stage of the operation cycle of the projectile launching apparatus 1000 is represented, where the piston 140 is moving towards the TDC of the cylinder 130 after occupying the gas within the gas chamber 136 as shown by arrow mark 'P'. The piston 140 compresses the gas occupied within the gas chamber 136 while moving towards the TDC. In this stage, the check valves 142 remain in the closed position to prevent any exit of the compressed gas from the gas chamber 136. The piston 140 continuously compresses the gas in the gas chamber 136 while moving towards the TDC. In this stage, the valve spool 320 of the compression valve arrangement 300 remains disposed in the hollow portion 138 of the cylinder end cap 134 to maintain the compression valve arrangement 300 in the closed position.

Herein, the movement of the bolt 430, while the piston 140 is moving toward the TDC of the cylinder 130, may be referred from the description in conjunction with FIG. 8A of the projectile launching apparatus 100. The bolt 430 moves towards the first position for partially closing the projectile inlet port 420. More specifically, the continued rotational movement of the bolt cam 440 moves the bolt cam 440 away from the bolt contact bar 436 and thereafter the spring 450 expands to move the bolt 430 towards the first position and partially closes the projectile inlet port 420. Referring to FIG. 12 again, the position of the bolt 430 is represented such that the bolt 430 partially closes the projectile inlet port 420. When the bolt 430 partially closes the projectile inlet port 420, the bolt 430 pushes the projectile 500 slightly forward to chamber the projectile 500 into the barrel 410, as shown in FIG. 1. Further, the rotational movement of the crankshaft 1110 moves the piston 140 to the TDC of the cylinder 130, as shown in FIG. 13.

In FIG. 13, a final stage of the operation cycle of the projectile launching apparatus 1000 is represented. FIG. 13 is a longitudinal cross-sectional view of the projectile launching apparatus 1000, where the piston 140 has reached the TDC of the cylinder 130. When the piston 140 reaches the TDC of the cylinder 130, the piston 140 completes the compression of the occupied gas within the gas chamber 136, which is now the 'compressed gas'. In this state, the compression valve arrangement 300 adopts the open position as the pressure of the compressed gas inside the gas chamber 136 exceeds the maintaining pressure of the valve spool 320 of the compression valve arrangement 300. The compression valve arrangement 300 may also additionally adopt the open position, when the piston 140 hits the valve spool stem 332 of the valve spool 320.

More specifically, the pressure inside the gas chamber 136 increases to an extent that the pressure of the compressed gas exceeds the maintaining pressure applied by the valve retainers 340 and the valve return spring 350 on the valve spool 320. In such a situation, the compressed gas inside the gas chamber 136 pushes the valve spool 320 to move linearly inside the groove 312 of the valve body 310 in a manner such that the valve spool 320 opens the hollow portion 138 of the cylinder end cap 134. Accordingly, the primary body portion 322 of the valve spool 320 also does not block the gas passageway 360. Thereafter, the compression valve arrangement 300 remains open due to the pressure of the compressed gas in the gas chamber 136. The compression valve arrangement 300 remains in the open position until the pressure of the compressed gas in the gas chamber 136 drops below the restoration force of the valve return spring 350 and/or the piston 140 moves away from contacting the valve spool stem 332.

Further, herein, in this stage, the movement of the bolt 430 of the projectile launching apparatus 1000 to the first position, when the piston 140 is at the TDC of the cylinder 130 may be referred from the corresponding description in conjunction with FIG. 9A. The bolt 430 moves to the first position in order to completely close the projectile inlet port 420. In FIG. 13, the bolt 430 is shown such that the bolt 430 completely closes the projectile inlet port 420 and also chambers the projectile 500 into the barrel 410. More specifically, the continued rotational movement of the bolt cam 440 moves the bolt cam 440 away from the bolt contact bar 436 to the first position. In such a case, the spring 450 expands completely to move the bolt 430 to the first position to completely close the projectile inlet port 420.

The compressed gas in the gas chamber 136 of the cylinder 130 starts releasing into the barrel 410 through the gas passageway 360 of the compression valve arrangement 300, as shown by arrows 'G' in FIG. 13. More specifically, the bolt 430 further includes the bolt passageway 470 configured on the front portion 432 of the bolt 430. The bolt passageway 470 is configured to align with the gas passageway 360, when the bolt 430 is in the first position and the piston 140 is at the TDC of the cylinder 130. When the gas passageway 360 and the bolt passageway 470 align, the compressed gas is released from the gas chamber 136 into the barrel 410 through the gas passageway 360 and the bolt passageway 470. The compressed gas, after reaching the barrel 410 starts expanding in the barrel 410 and applies a high pressure on the projectile 500 to launch the projectile 500 from the barrel 410 with a high velocity.

The projectile launching apparatuses 100 and 1000 use a single stroke compression as the projectile 500 is release in the single stroke of the piston 140. The single stroke compression enables in compressing the gas in the gas chamber 136 such that the compression exponent of the gas inside the gas chamber 136 is greater then 1.05. The compression exponent greater than 1.05 yields higher gas pressure for a given compression ratio and increases a volumetric efficiency of the configurational aspect of the projectile launching apparatuses 100 and 1000 by allowing more energy to be stored in a volume of gas compared to the compression done via a normal multi-stroke compressor, in which the heat of compression is lost to the environment. In one embodiment, the projectile launching apparatuses 100 and 1000 have efficient designs such that the single stoke compression is sufficiently short (in terms of time) to yield a compression exponent of approximately 1.05.

Upon completion of the single stroke, i.e. when the piston 140 reaches the TDC of the cylinder 130, a maximum amount of the compressed gas is delivered to the barrel 410. The pressure inside the gas chamber 136 falls below the pressure applied by the valve return spring 350, which thereby applies pressure on the valve spool 320 causing the valve spool 320 to close the hollow portion 138 of the cylinder end cap 134. Accordingly, with each triggering (i.e., powering of the start switch 102), one projectile 500 is launched from the barrel 410 and the projectile launching apparatus 1000 becomes ready for the next operational cycle to launch another similar projectile.

In another embodiment of the present invention, the present invention provides a projectile launching apparatus that is capable of launching larger projectiles. The design of such projectile launching apparatus requires a large amount of compressed gas with a high compression ratio. For example, the larger projectiles, such as a non lethal ballistic projectile requires 14 cubic inch of gas compressed with a compression ratio of 8:1. To meet the requirement of the large amount of the compressed gas, the present invention incorporates a liner motion converter which strokes more than once in a cylinder of the projectile launching apparatus. In this situation, a volume of the cylinder should be slightly larger than half of the required volume of the gas and the linear motion converter needs to be stroked twice or more. Further, a gas chamber within the cylinder is configured to have a primary gas chamber and a secondary gas chamber i.e. dividing the gas chamber into the primary gas chamber and the secondary gas using a separator. The primary gas chamber is in close proximity with the secondary gas chamber and communicates through a check valve configured on the separator. The primary gas chamber is used for accommodating the linear motion converter in a manner, such that the linear motion converter compresses the gas within the primary gas chamber. The secondary gas chamber is used for storing the compressed gas of the primary gas chamber with a compression exponent greater than 1.05. Further, the cylinder is coupled to a breech assembly through a compression valve arrangement. The compression valve arrangement transfers the compressed gas from the secondary gas chamber to a barrel of the breech assembly for launching the larger projectiles, chambered in the barrel, with a high velocity.

Referring to FIGS. 14-21, longitudinal cross-sectional views of a projectile launching apparatus 2000 having a cylinder including two gas chambers and incorporating the linear motion converter 200 is shown, according to an exemplary embodiment of the present invention. The projectile launching apparatus 2000 is similar to the projectile launching apparatus 100 as described in conjunction with FIG. 1, except for a cylinder 2130 having two gas chambers used in place of the cylinder 130 having a single gas chamber, a compression valve arrangement 2300 and a breech assembly 2400. Accordingly, the projectile launching apparatus 2000 includes the cylinder 2130, the compression valve arrangement 2300 and the breech assembly 2400 in addition to various components of the projectile launching apparatus 100 such as the start switch 102, the power source 104, the motor 106, the control circuit 108, the gear reduction mechanism 110 and the linear motion converter 200. The linear motion converter 200 of the present embodiment is represented by a slider crank arrangement. However, it will be evident to a person skilled in the art that the linear motion converter 200 may also be a crankshaft and connecting rod arrangement, a rack and pinion arrangement and a lead screw arrangement. The projectile launching apparatus 2000 is capable of launching a projectile 600, which may be larger than the projectile 500 as shown in FIG. 1. The projectile launching apparatus 2000 utilizes pressure of a gas, compressed within the cylinder 2130 with the help of the linear motion converter 200. This compressed gas is released into the breech assembly 2400 through the compression valve arrangement 2300 and thereafter the compressed gas expands in the barrel 410 of the breech assembly 2400 and applies pressure to the projectile 600 to launch the projectile 600 from the barrel 410.

The piston 140 reciprocates within the cylinder 2130. The cylinder 2130 further includes a cylinder end cap, such as the cylinder cap 134 and a cylinder guide, such as the cylinder guide 132. Check valves, such as the check valves 142, are configured in the body of the piston 140, as explained in conjunction with the cylinder 130 of FIG. 1. The reciprocal movement of the piston 140 defines a gas chamber within the cylinder 2130 between the cylinder end cap 134, the piston 140 and the cylinder guide 132. As shown in FIGS. 14-21, the gas chamber of the projectile launching apparatus 2000 includes a separator 2140, which divides the gas chamber into a primary gas chamber 2142 and a secondary gas chamber 2144. The piston 140 and the separator 2140 between the cylinder guide 132 configures the primary gas chamber 2142. Further the cylinder end cap 134 and the separator 2140 between the cylinder guide 132 configures the secondary gas chamber 2144. The primary gas chamber 2142 and the secondary gas chamber 2144 are capable of accommodating gas therein.

The piston 140 is capable of reciprocally moving within the primary gas chamber 2142 to occupy and compress the gas in the primary gas chamber 2142. More specifically, the reciprocal movement of the piston 140 enables the check valves 142 to attain the opened position or the closed position. The open position the check valves 142 enables an intake of the gas into the primary gas chamber 2142 and the closed position of the check valves 142 prevent an exit of the occupied gas from the primary gas chamber 2142. Further, when the piston 140 reciprocates towards the separator 2140, the piston 140 tends to compress the gas occupied within the primary gas chamber 2142.

The gas compressed in the primary gas chamber 2142 is transferred to the secondary gas chamber 2144 through check valves, such as a check valve 2146*a* and a check valve 2146*b* (hereinafter collectively referred to as 'check valves 2146'). The check valves 2146 are configured in the separator 2140. The check valves 2146 operates in a manner such that, when the piston 140 reciprocates towards the separator 2140 and a pressure in the primary gas chamber 2142 exceeds a pressure of the secondary gas chamber 2144, the check valves 2146 open and the compressed gas is transferred from the primary gas chamber 2142 into the secondary gas chamber 2144. Similarly, when the compressed gas is transferred to the secondary gas chamber 2144 and the pressure of the secondary gas chamber 2144 exceeds the pressure of the primary gas chamber 2142, the check valves 2146 close in order to prevent any exit of the compressed gas from the secondary gas chamber 2144 back to the primary gas chamber 2142.

The secondary gas chamber 2144 is adjacent to the compression valve arrangement 2300 as the cylinder end cap 134 of the cylinder 2130 is functionally coupled to the compression valve arrangement 2300. The configurational aspect of the compression valve arrangement 2300 of the projectile launching apparatus 2000 is same as the compression valve arrangement 300 as explained in conjunction with FIGS. 2-5 except for the fact that the valve spool stem 332 is not present in the compression valve arrangement 2300.

The compression valve arrangement 2300 adopts the open position when the pressure of the compressed gas inside the secondary gas chamber 2144 exceeds the maintaining force of a valve spool, such as the valve spool 320. This can be accomplished by the force of the compressed air alone or by additional force exerted by an electric solenoid (not shown). In a preferred embodiment, the compression valve arrangement 2300 is referred to as a snap acting valve in which the valve spool 320 takes less then 20 milliseconds for moving from an initial position, which is the closed position to a position allowing a substantially 70 percent of an optimum flow of the compressed gas to be released through the compression valve arrangement 2300. More specifically, the opening time of the valve spool 320, i.e. the interval between a time when the compression valve arrangement 2300 is in the closed position and a time, when the compression valve arrangement 2300 is at least 70 percent open, should be less than 20 milliseconds. The valve spool 320 needs to open completely and in a quick manner such that the energy of expansion of the compressed gas that is required in the barrel 410 to launch the projectile 600, should not be lost to the valve spool 320 and valve retainers, such as the valve retainers 340.

In the open position of the compression valve arrangement 2300, the valve spool 320 moves linearly within the groove 312 of the valve body 310 for opening the hollow portion 138 (see FIG. 5) and the gas passageway 360. The opening of the hollow portion 138 allows the compressed gas to release into the barrel 410 through the gas passageway 360 and a bolt passageway 470, which is further shown in FIG. 21. More specifically, the bolt 430 further includes the bolt passageway 470 configured on the front portion 432 of the bolt 430. The bolt passageway 470 is configured such that the gas passageway 360 and the bolt passageway 470 are aligned, when the bolt 430 is in the first position. Upon aligning the bolt passageway 470 and the gas passageway 360 the compressed gas from the secondary gas chamber 2144 is released into the barrel 410. The compressed gas reaching the barrel 410 through the bolt passageway 470 starts expanding in the barrel 410 for applying a pressure on the projectile 600 to launch the projectile 600 from the barrel 410 with the high velocity.

The breech assembly 2400 includes the barrel 410, a projectile inlet port, such as the projectile inlet port 420 and the bolt 430. The projectile inlet port 420 is configured on the barrel 410 and is adapted to receive the projectile 600 in the projectile inlet port 420. The bolt 430 has a front portion, such as the front portion 432 and a rear portion, such as the rear portion 434. The bolt 430 is operatively coupled to the linear motion converter 200 in a manner such that the bolt 430 is capable of reciprocating between the first position and the second position of the bolt 430 as explained in conjunction with FIG. 1. In the first position, the bolt 430 is configured to be partially received within the barrel 410 such that the front portion 432 of the bolt 430 shuts off the projectile inlet port 420 and in the second position, the bolt 430 enables the projectile 600 to be fed into the barrel 410 from the projectile inlet port 420.

More specifically, the bolt 430 is reciprocated between the first position and the second position due to a bolt driving mechanism coupled to the linear motion converter 200. The bolt driving mechanism includes a bolt gear 2410, a bolt gear 2412, a bolt cam such as the bolt cam 440, and a spring such as the spring 450.

Figure 14:
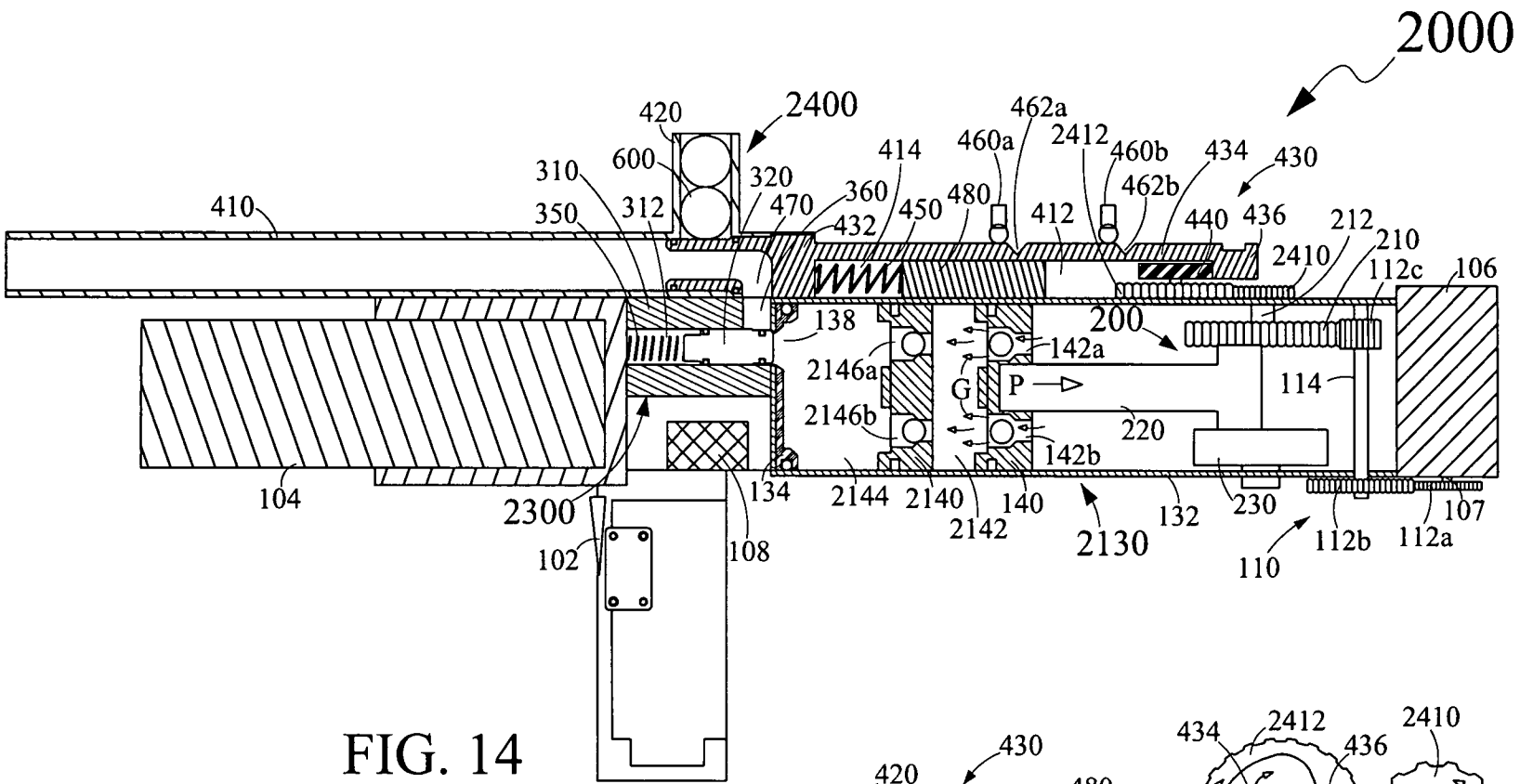

As shown in FIG. 14, the bolt gear 2410 is coupled to the crank wheel 210 by the shaft 212, about which the crank wheel 210 is configured to rotate. Accordingly the bolt gear 2410 rotates with the rotation of the crank wheel 210. Further, the bolt gear 2410 is meshed with the bolt gear 2412 and is responsible for rotating the bolt gear 2412. In one embodiment of the present invention, a rotational speed of the bolt gear 2412 is half of a rotational speed of the bolt gear 2410. This may be achieved by selecting the diameter of the bolt gear 2412 as half of the diameter of the bolt gear 2410. Further, the bolt gear 2412 is coupled to the bolt cam 440 and accordingly rotates the bolt cam 440.

The bolt gear 2410, the bolt gear 2412 and the bolt cam 440 are accommodated in the first cavity 412 and the spring 450 is accommodated in the second cavity 414. The configurations of the first cavity 412 and the second cavity 414 have been explained in conjunction with FIG. 1.

The bolt cam 440 is disposed in the first cavity 412 at the rear portion 434 of the bolt 430 such that while rotating, the bolt cam 440 makes contact to the bolt contact bar 436 and pushes the bolt 430 backward, i.e., towards the second position. The bolt contact bar 436 is disposed at the rear portion 434 of the bolt 430. The bolt 430 also moves backward as the bolt contact bar 436 is pushed backward during the rotation of the bolt cam 440. Accordingly, the bolt cam 440 moves the bolt 430 to second position from the first position for opening the projectile inlet port 420 and allowing the projectile 600 to feed into the barrel 410.

The bolt 430 moves forward with the help of the spring 450, disposed in the second cavity 414, as explained in conjunction with FIG. 1. The spring 450 moves the bolt 430 to the first position to shut off the projectile inlet port 420 and chambers the projectile 600 in the barrel 410. The breech assembly 2400 also includes the locking mechanism as explained in conjunction with FIG. 1, for locking the bolt 430 in the first position, prior to the release of the compressed gas into the barrel 410 through the compression valve arrangement 2300. The locking mechanism includes the spring loaded balls such as the balls 460*a* and 460*b* and the plurality of detent holes such as the detent holes 462*a* and 462*b*. The balls 460*a* and 460*b* are received in the detent holes 462*a* and 462*b*, configured on an upper surface of the bolt 430 to lock the bolt 430 in the first position.

An operational cycle to launch the projectile 600 from the projectile launching apparatus 2000 may includes a plurality of strokes of the piston 140 within the primary gas chamber 2142. The plurality of strokes of the piston 140 compresses the gas occupied in the primary gas chamber 2142 and the compressed gas is transferred to the secondary gas chamber 2144 through the check valves 2146 and is stored therein. The operation of the projectile launching apparatus 2000 mainly depends on a compression exponent of the compressed gas stored in the secondary gas chamber 2144. Further, the compression exponent depends on the number of strokes of the piston 140 in the primary gas chamber 2142. The plurality of strokes of the piston 140 lowers the compression exponent, as the plurality of strokes takes more time for compressing the occupied gas in the primary gas chamber 2142. As the more time is spent during the plurality of strokes of the piston 140, the compressed gas stored in the secondary gas chamber 2144 may get cooled, which results in a decrease in the compression exponent of the compressed gas in the secondary gas chamber 2144. The compression exponent is also related to the pressure and the temperature of the compressed gas. For example, a given volume of gas with a compression exponent of 1.3 has a higher temperature than the same volume of gas having a compression exponent of 1.2. The higher temperature and the pressure enables in storing more energy in the compressed gas stored in the secondary gas chamber 2144.

The present embodiment of the projectile launching apparatus 2000 ensures that the compressed gas stored in the secondary gas chamber 2144 has the compression exponent greater than 1.05. Therefore, to maintain a compression exponent greater than 1.05, it is advantageous to limit the number of strokes of the linear motion converter 200. It is preferred to keep the number of strokes of the linear motion converter 200 to be less than 5. This exemplary embodiment of the present invention is described by considering the number of strokes of the piston 140 equal to two.

The operational cycle of the projectile launching apparatus 2000 includes two stokes, such as a first stroke and a second stroke, of the piston 140 in the primary gas chamber 2142. The first stroke and the second stroke of the piston 140 are responsible for compressing the gas in the primary gas chamber 2142 with a compression exponent greater than 1.05 and thereafter transferring the compressed gas to the secondary gas chamber 2144 and storing the compressed gas with the compression exponent greater than 1.05 in the secondary gas chamber 2144, prior to releasing the compressed gas into the barrel 410 through the compression valve arrangement 2300.

The first stroke of the piston 140 within the primary gas chamber 2142 involves moving the piston 140 from a TDC (herein, the TDC of the primary gas chamber 2142 is at 'a proximity to the separator 2140') towards a BDC of the cylinder 2130. The check valves 142 adopt the open position to allow gas to be entered the primary gas chamber 2142. Herein the term 'gas' refers to the atmospheric air at the atmospheric pressure. At the same time, the check valves 2146 and the compression valve arrangement 2300 remain in the closed position. Further, when the piston 140 reaches at the BDC of the cylinder 2130, the check valves 142 adopt the closed position to occupy the gas, which has entered the primary gas chamber 2142 therein. Further, the first stroke of the piston 140 moves the piston 140 from the BDC towards the proximity to the separator 2140 for compressing the gas occupied in the primary gas chamber 2142. The check valves 2146, the check valves 142 and the compression valve arrangement 3200 remain in the closed position. When the piston 140 reaches at the proximity to the separator 2140, the check valves 2146 adopt the open position in order to transfer the compressed gas to the secondary gas chamber 2144. Once the compressed gas is transferred to the secondary gas chamber 2144 from the primary gas chamber 2142, the check valves 2146 is brought into the closed position and the compressed gas is stored in the secondary gas chamber 2144. Hereinafter, the compressed gas stored in the secondary gas chamber 2144 after the first stroke may be termed as the 'stored gas'. Additionally, the first stroke of the piston 140 in the primary gas chamber 2142 causes the bolt 430 to move from the first position towards the second position.

The second stroke of the piston 140 within the primary gas chamber 2142 involves moving the piston 140 from the proximity to the separator 2140 to towards the BDC of the cylinder 2130. The check valves 142 again adopt the open position to allow the gas to enter the primary gas chamber 2142. At the same time, the check valves 2146 and the compression valve arrangement 2300 remain in the closed position. When the piston 140 reaches the BDC of the cylinder 2130, the check valves 142 adopt the closed position in order to occupy gas within the primary gas chamber 2142. The second stroke further involves moving the piston 140 towards the proximity to the separator 2140 from the BDC for compressing the occupied gas again in the primary gas chamber 2142 (with the check valves 142, the check valves 2146 and the compression valve arrangement 2300 in the closed position). As the piston 140 reaches to the proximity to the separator 2140, the check valves 2146 adopt the open position to transfer the compressed gas into the secondary gas chamber 2144 from the primary gas chamber 2142. It will be apparent to a person ordinary skilled in the art that the compressed gas which is released into the secondary gas chamber 2144 during the second stroke of the piston 140, is added to the stored gas in the secondary gas chamber 2144, which was initially transferred during the first stroke of the piston 140. Thereafter, the compression valve arrangement 2300 adopts the open position to release the compressed gas into the barrel 410 from the secondary gas chamber 2144 for launching the projectile 600. As the projectile 600 is launched, the check valves 2146 and the compression valve arrangement 2300 adopt the closed position again to initiate the launching of a next projectile 600.

Referring again to FIGS. 14-17, the first stroke of the operation cycle of the projectile launching apparatus 2000, is described. Herein, various stages of the first stroke in the operation cycle are described in a sequential manner. The initial stage of the first stroke of the operational cycle of the projectile launching apparatus 2000 is shown in FIG. 14. The initial stage begins with the start switch 102 pressed ON for powering the motor 106 using the control circuit 108. At the beginning of the first stroke, the piston 140 is positioned at the proximity to the separator 2140 and the bolt 430 may be positioned at the first position. The piston 140 moves towards the BDC of the cylinder 2130 from the proximity to the separator 2140, which is shown by the arrow mark 'P'. Specifically, upon receiving power from the power source 104, the motor 106 provides a rotational movement to the linear motion converter 200 through the gear reduction mechanism 110. The crank wheel 210 of the linear motion converter 200 rotates (either clockwise or counter clockwise) alongwith the rotational movement of the gear 112*c* of the gear reduction mechanism 110. The rotational movement of the crank wheel 210 causes the piston 140 to move linearly away from the separator 2140 and thereby opening the check valves 142 for the intake of the gas into the primary gas chamber 2142.

Figure 14A:
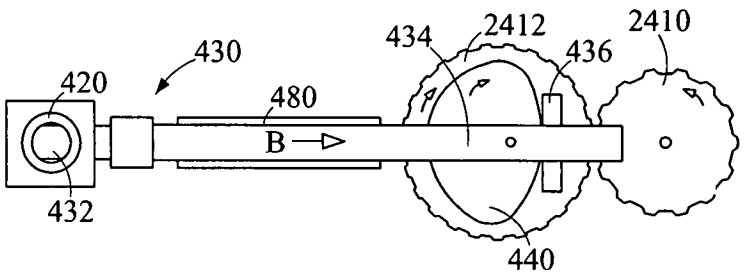

The intake of the gas through the check valves 142 continues until the piston 140 reaches the BDC of the cylinder 2130. The volume of the gas in the primary gas chamber 2142 ranges from 6 to 9 cubic inch at standard temperature and pressure conditions and, more preferably, equal to about 7 cubic inch. As shown in FIG. 14A, with the beginning of the first stroke, the bolt 430 also starts moving from the first position towards the second position with the help of the rotational movement of the bolt cam 440. More specifically, the bolt cam 440 touches the bolt contact bar 436 and pushes the bolt 430 backward, i.e., towards the second position alongwith the rotational movement of the bolt cam 440. As the bolt 430 starts moving towards the second position, the spring 450 starts being compressed in the second cavity 414 by the front portion 432 of the bolt 430.

Figure 15:
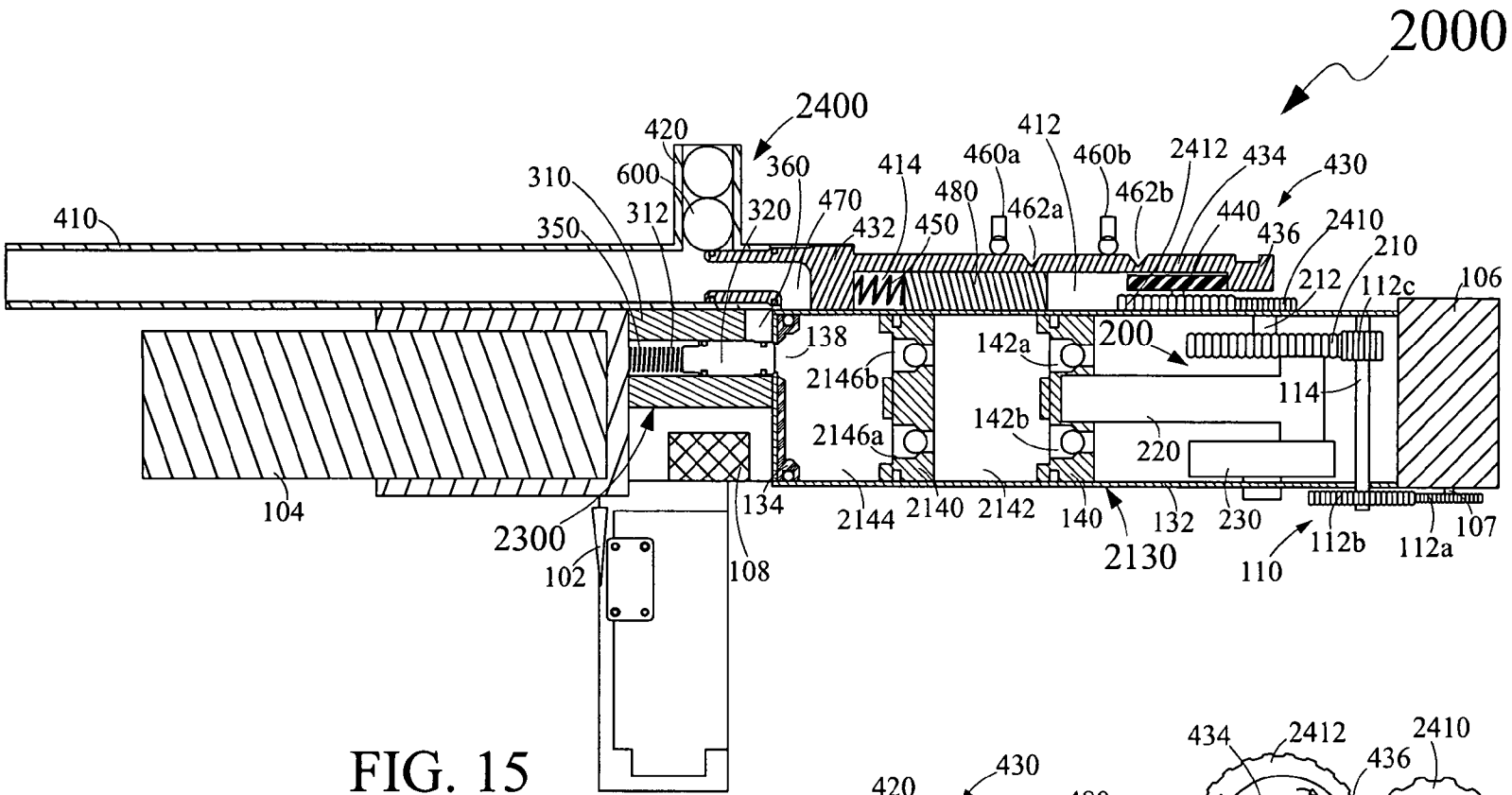
Figure 15A:
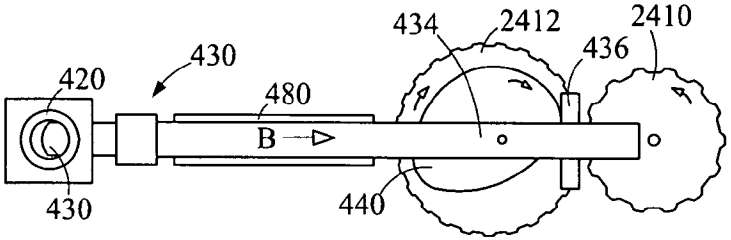

In FIG. 15, a next stage of the first stroke of the operation cycle in the projectile launching apparatus 2000 is shown. In this stage, the piston 140 is shown at the BDC of the cylinder 2130. Once the piston 140 reaches the BDC, the check valves 142 adopt the closed position to occupy the gas, which is entered the primary gas chamber 2142 and thereby preventing the exit of the gas occupied within the primary gas chamber 2142. The bolt cam 440 also continues rotating with the rotational movement of the crank wheel 210. The continued rotational movement of the bolt cam 440 also continuously moves the bolt 430 towards the second position in order to open the projectile inlet port 420, as shown in FIG. 15A. The rotation of the bolt cam 440 further compresses the spring 450 with the movement of the bolt 430.

Figure 16:
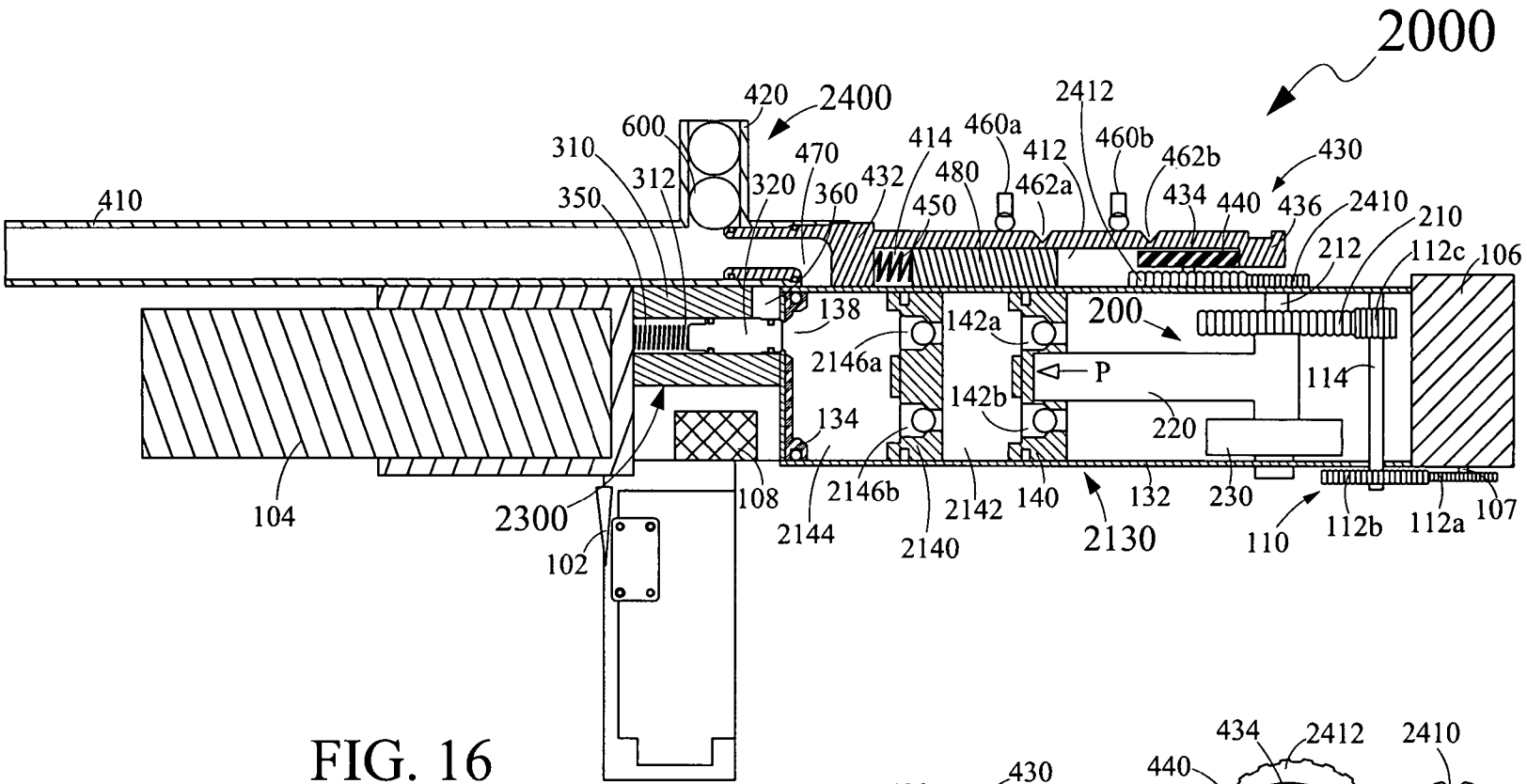
Figure 16A:
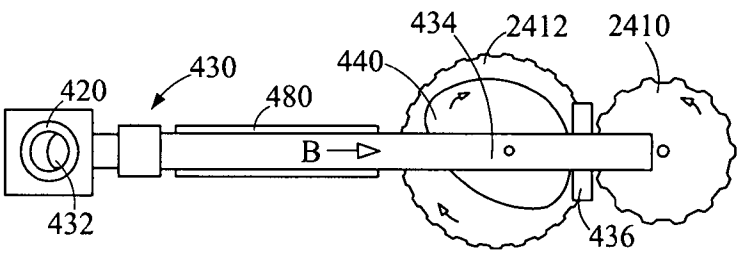

In FIG. 16, a next stage of the first stroke of the operation cycle is shown, where the piston 140 is moving forward towards the proximity to the separator 2140. The forward movement of the piston 140 towards the proximity to the separator 2140, with the check valves 142 in the closed position, causes the compression of the gas occupied in the primary gas chamber 2142. The gas occupied in the primary gas chamber 2142 is compressed such that the compressed gas has a compression exponent at least equal to 1.05. At the same time, the bolt 430 continues moving towards the second position for almost opening the projectile inlet port 420 with the continued rotational movement of the bolt cam 440, as shown in FIG. 16A. Further, the movement of the bolt 430 towards the second position almost compress the spring 450 with the front portion 432 of the bolt 430.

Figure 17:
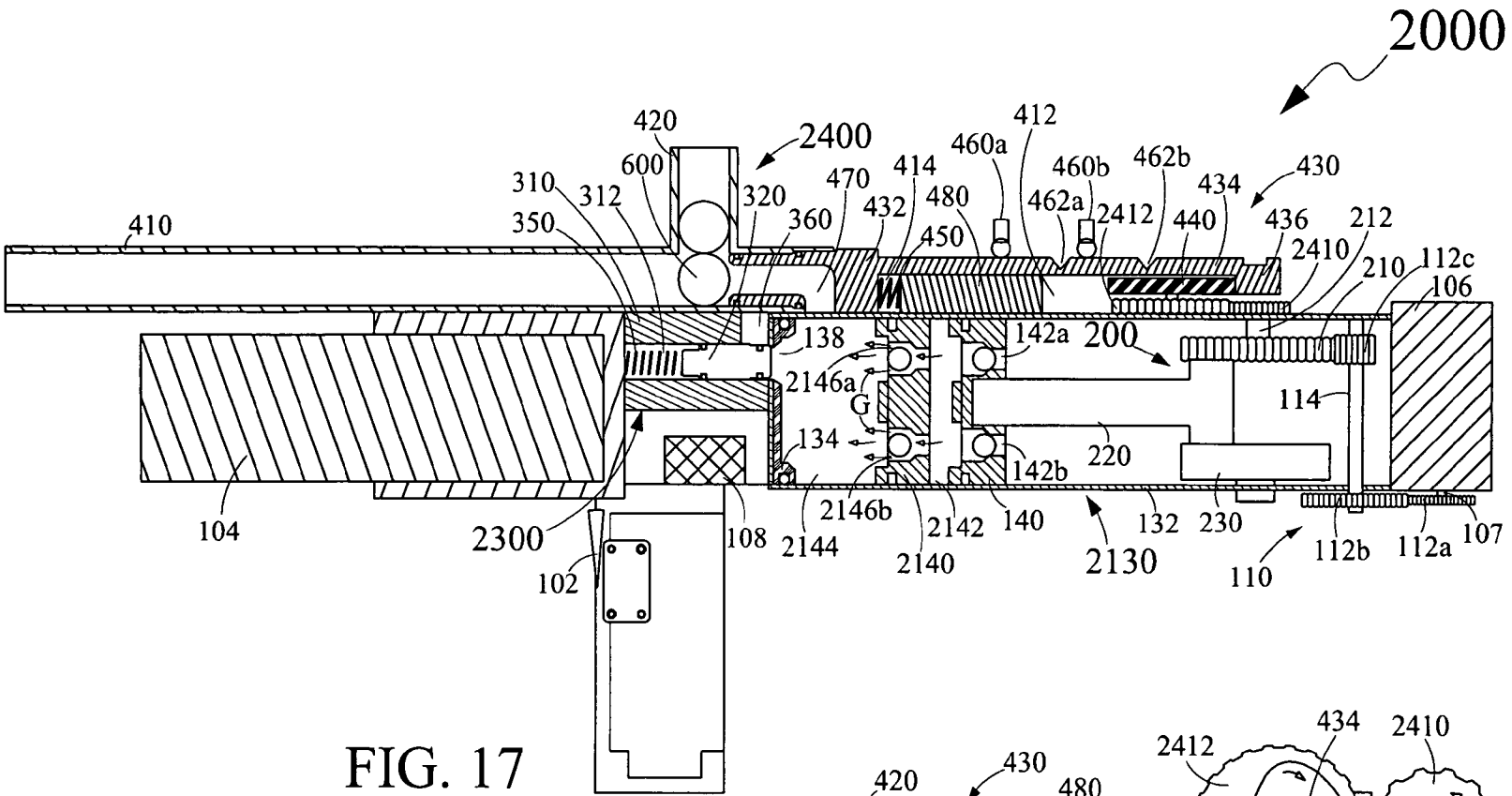
Figure 17A:
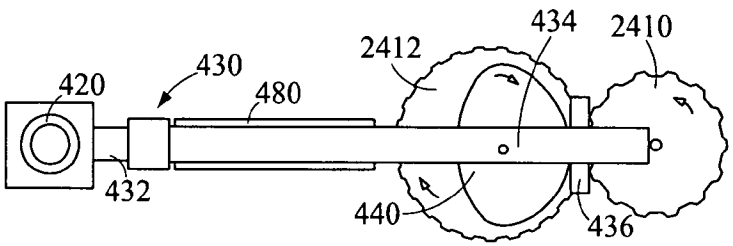

Further, in FIG. 17, a final stage, i.e., completion of the first stroke is shown, where the piston 140 has reached the proximity to the separator 2140. Once the piston 140 reaches the proximity to the separator 2140, the compressed gas in the primary gas chamber 2142 has sufficient pressure to open the check valves 2146 and accordingly, the compressed gas is transferred to the secondary gas chamber 2144. As described before, the compressed gas transferred to the secondary gas chamber 2144 has a compression exponent of greater than about 1.05. Furthermore, once the compressed gas of the primary gas chamber 2142 is transferred to the secondary gas chamber 2144, a pressure of compressed gas within the secondary gas chamber 2144 causes the check valves 2146 to adopt the closed position. Further, as shown in FIG. 17A, the continued rotational movement of the bolt cam 440 moves the bolt 430 to the second position, where the bolt 430 completely opens the projectile inlet port 420. The opening of the projectile inlet port 420 causes the projectile 600 to be fed into the barrel 410. In this position, the front portion 432 of the bolt 430 completely compresses the spring 450.

Figure 18:
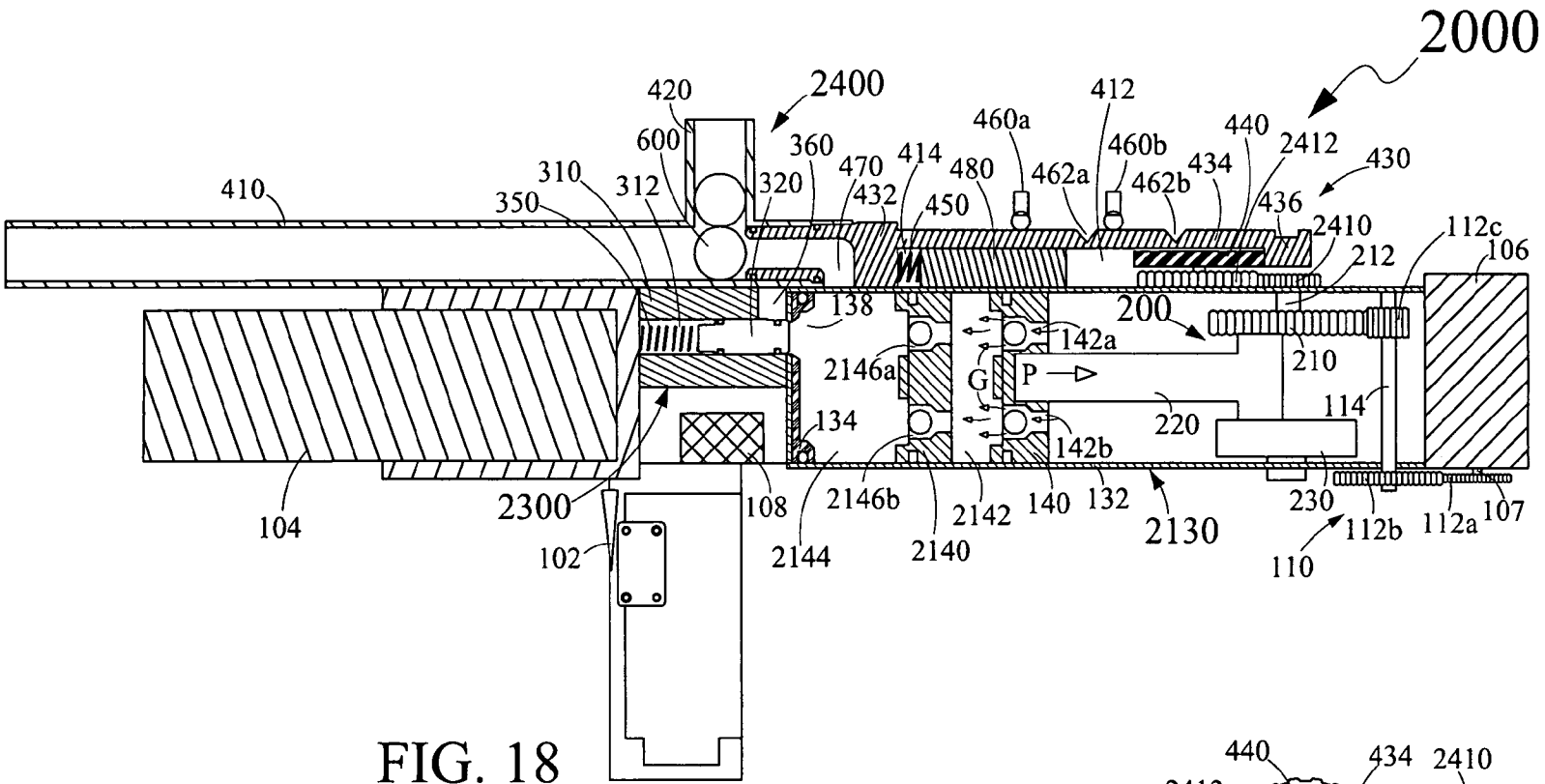
Figure 18A:
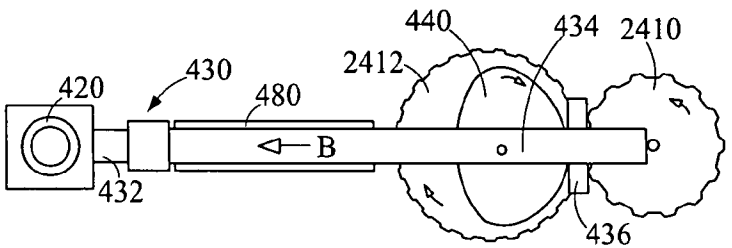

Further, referring again to FIGS. 18-21, the second stroke of the projectile launching apparatus 2000 is described. Herein, various stages of the second stroke in the operation cycle are described in a sequential manner. In FIG. 18, an initial stage of the second stroke is shown, where the piston 140 is positioned at the proximity to the separator 2140 after the final stage of the first stroke. With the start of the second stroke of the piston 140, the piston 140 starts moving linearly away from the separator 2140 towards the BDC and the check valves 142 adopt the open position in order to intake the gas again into primary gas chamber 2142. The intake of the gas through the check valves 142 in the primary gas chamber 2142 continues until the piston 140 reaches the BDC of the cylinder 2130. Further, as shown in FIG. 18A, with the beginning of the second stroke, the bolt 430 also starts moving from the second position towards the first position as the spring 450 starts expanding. More specifically, the bolt cam 440 rotates away from the bolt contact bar 436 and the spring 450 expands from its compressed state in the final stage of the first stroke in order to move the bolt 430 towards the first position for closing the projectile inlet port 420.

Figure 19:
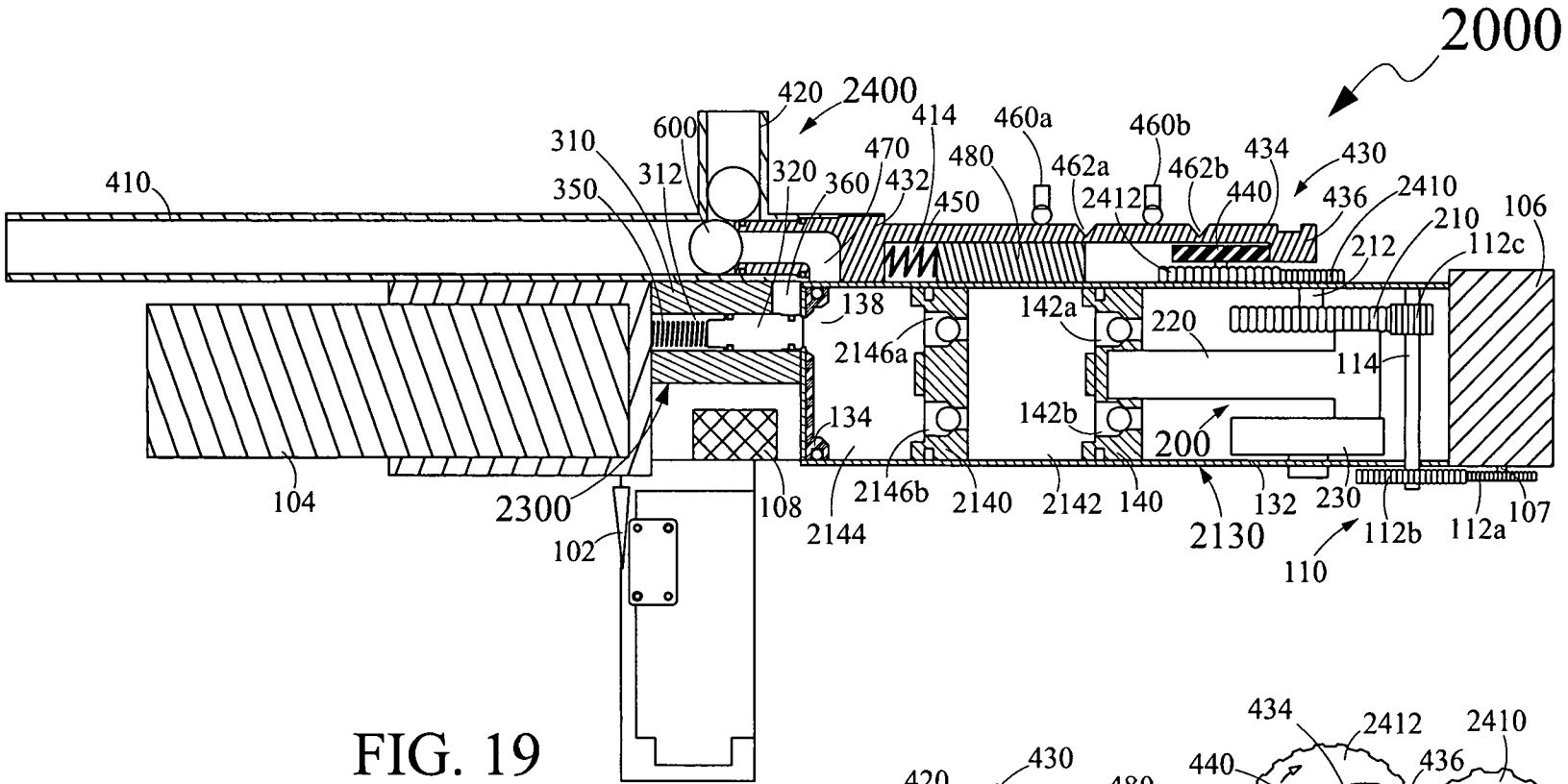
Figure 19A:
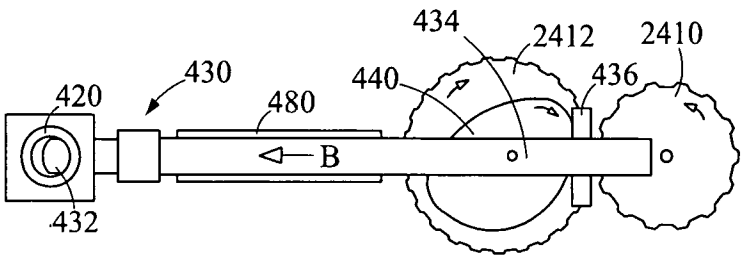

Further, in FIG. 19, a next stage of the second stroke of the operation cycle is shown, where the piston 140 has reached the BDC of the cylinder 2130. As the piston 140 reaches the BDC, the check valves 142 adopt the closed position to occupy the gas in the primary gas chamber 2142. At the same time, the movement of the bolt 430 is shown in FIG. 19A. The continued rotational movement of the bolt cam 440 causes is such that the bolt cam 440 further rotates away from the bolt contact bar 436 and the expansion of the spring 450 causes the movement of the bolt 430 towards the first position. It will be apparent to a person ordinary skilled in the art that the bolt contact bar 436 maintains contact with the bolt cam 440 while moving towards the first position.

Figure 20:
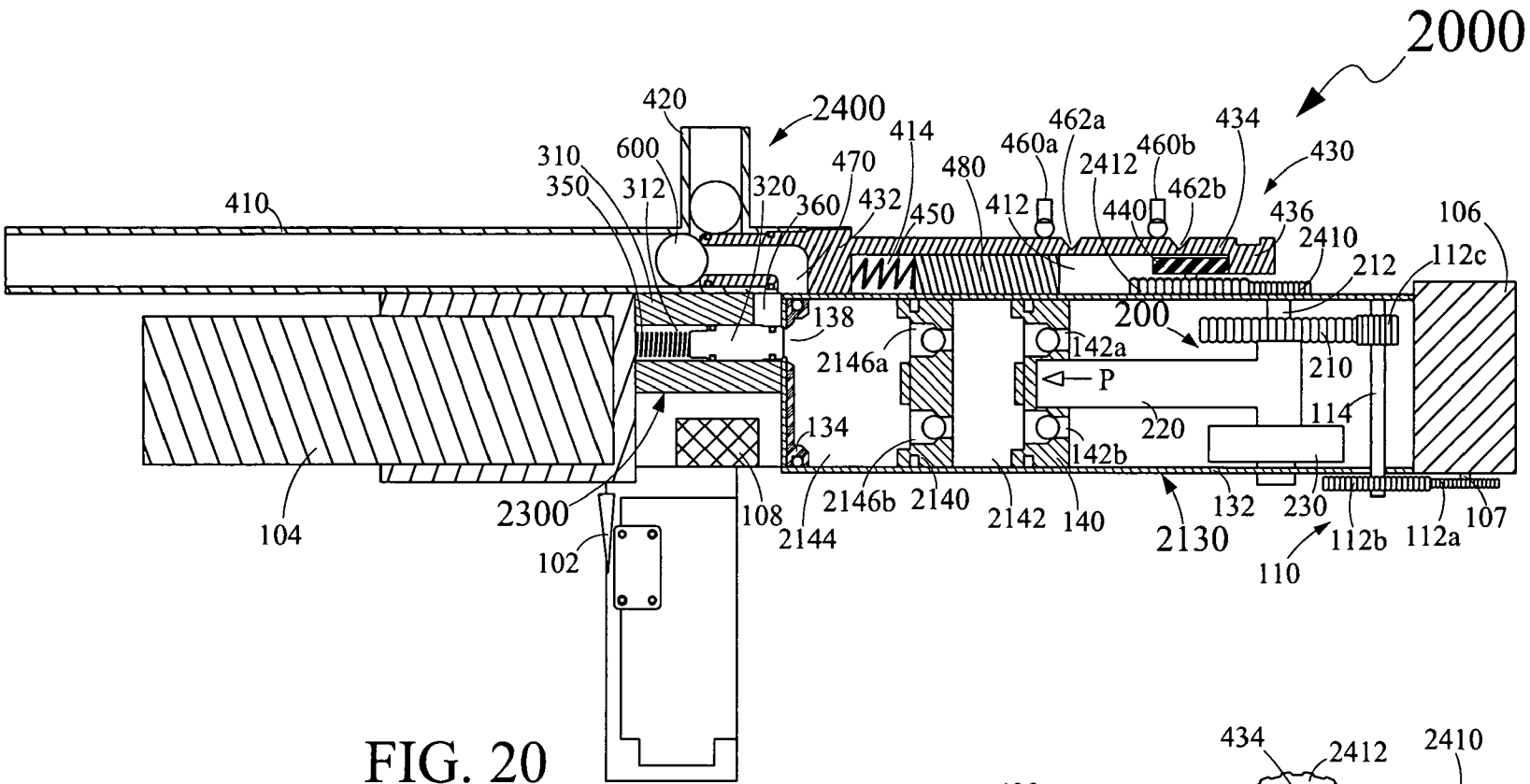

Further, in FIG. 20, a next stage of the second stroke of the operation cycle is shown, where the piston 140 is shown moving forward towards the proximity to the separator 2140. As previously described, during the forward movement of the piston 140 towards the proximity to the separator 2140, the check valves 142 remain in the closed position. The forward movement of the piston 140 causes the compression of the gas occupied in the primary gas chamber 2142, such that, the compression exponent of the compressed gas reaches at least 1.05 within the primary gas chamber 2142. Furthermore, as shown in FIG. 20, the bolt cam 440 continues rotating away from the bolt contact bar 436 and causes the spring 450 to expand more for moving the bolt 430 towards the first position. This is shown by the projectile inlet port 420 in FIG. 20A, which is a semi closed position.

Figure 21:
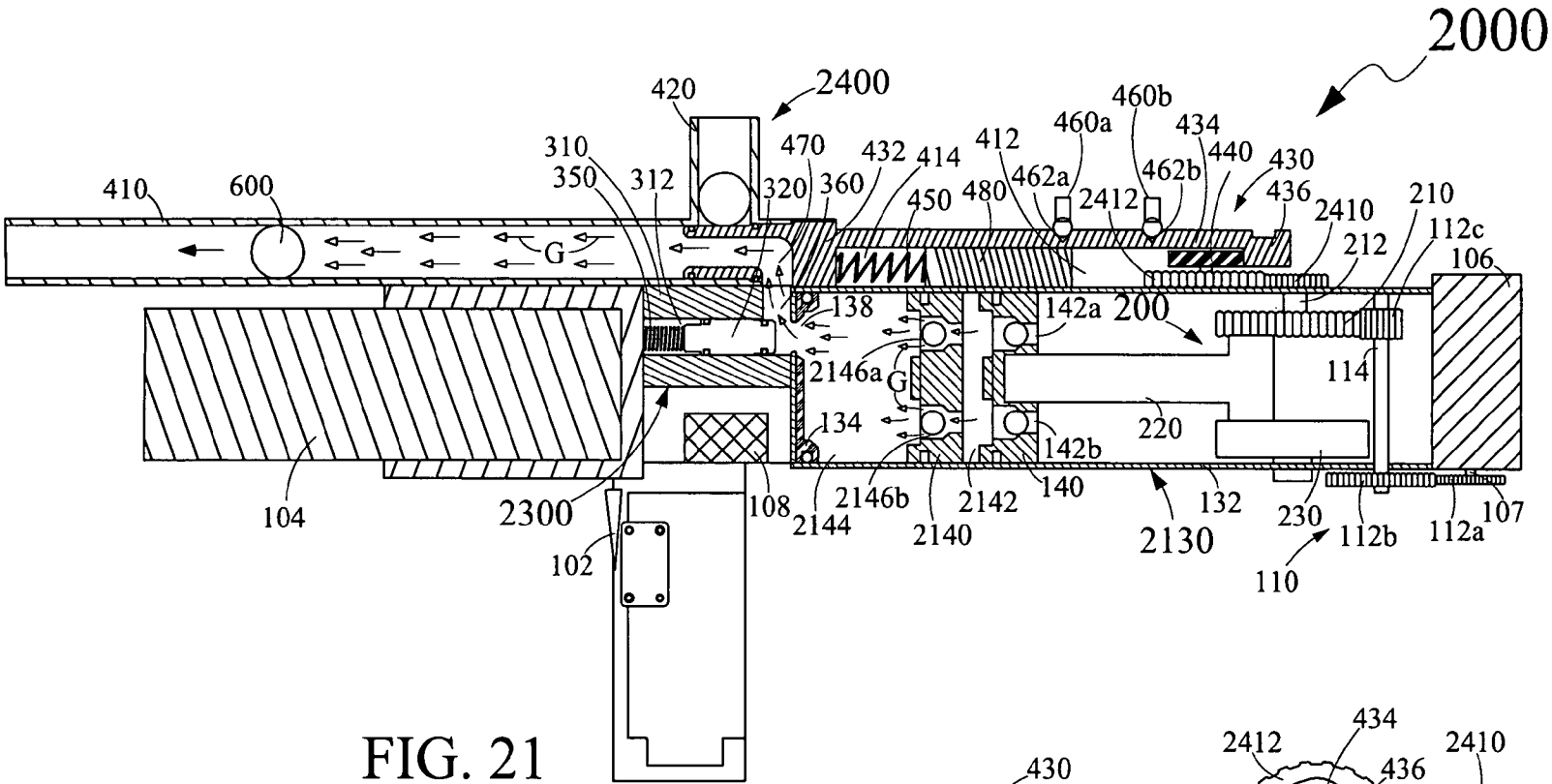
Figure 21A:
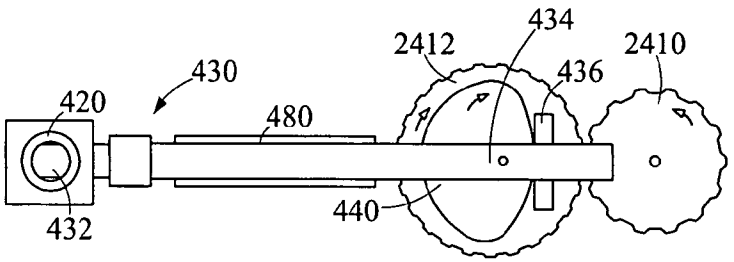

Further, referring to FIG. 21, a final stage, i.e., completion of the second stroke is shown, where the piston 140 is positioned at the proximity to the separator 2140. As the piston 140 reaches the proximity to the separator 2140, the piston 140 compresses the occupied gas in the primary gas chamber 2142 to an extent, such that, each of the check valves 2146 and the compression valve arrangement 2300 adopts the open position. Furthermore, as shown in FIG. 21A, additionally, the bolt cam 440 further rotates away from the bolt contact bar 436, and accordingly the spring 450 expands completely to move the bolt 430 to the first position. Thereafter, the front portion 432 of the bolt 430 closes the projectile inlet port 420, as shown in FIG. 21A. It will be apparent to a person skilled in the art that at this stage of the second stroke, the crank wheel 210 has completed almost two rotations (720 degrees), while the bolt cam 440 has completed a single rotation (360 degrees).

Thereafter, the compressed gas is transferred to the secondary gas chamber 2144, which is further added to the stored gas in the secondary gas chamber 2144 during the final stage of the first stroke. At the same time, compressed gas in the secondary gas chamber 2144 starts releasing into the barrel 410 through the gas passageway 360 of the compression valve arrangement 2300, as shown by arrows 'G' in FIG. 21. More specifically, the bolt 430 further includes the bolt passageway 470 configured on the front portion 432 of the bolt 430. The bolt passageway 470 is configured to align with the gas passageway 360, when the bolt 430 is in the first position. When the gas passageway 360 and the bolt passageway 470 align, the compressed gas is released from the gas chamber 136 into the barrel 410 through the gas passageway 360 and the bolt passageway 470. The compressed gas, after reaching the barrel 410 starts expanding in the barrel 410 and applies a high pressure on the projectile 500 to launch the projectile 500 from the barrel 410 with a high velocity.

A projectile launching apparatus for launching the larger projectiles require a liner motion converter stroked more than once for compressing the large amount of gas within a cylinder. In this situation, the compressed gas within the cylinder may achieve a very high a pressure. The highly compressed gas is transferred to a barrel from the cylinder through a compression valve arrangement. The compression valve arrangement must operate in an appropriate manner for launching the larger projectile. Additionally, the compression valve arrangement must adopt an open position and a closed position with appropriate timing for a safe operation of the projectile launching apparatus. Thus in one embodiment, the present invention provides a compression valve arrangement, which is a cam controlled compression valve arrangement. The opening and the closing of the compression valve arrangement is controlled in accordance with the movement of the linear motion converter using the cam. This compression valve arrangement, which is cam controlled, enables the projectile launching apparatus to operate in appropriate and safe manner for launching the larger projectile. The above projectile launching apparatus with the compression valve arrangement, which is cam driven, is illustrated in FIGS. 22-31.

FIGS. 22-29, are longitudinal cross-sectional views of a projectile launching apparatus 3000, which incorporates a slider crank arrangement as the linear motion converter and a compression valve arrangement, which is the cam controlled. Various stages of the operation cycle of launching the projectile 600 from the projectile launching apparatus 3000 are described in conjunction with FIGS. 22-29. The projectile launching apparatus 3000 is similar to the projectile launching apparatus 2000 except for a compression valve arrangement 3300 used herein in place of the compression valve arrangement 2300 of the projectile launching apparatus 2000. Therefore, the various components, which are same in both the projectile launching apparatuses 2000 and 3000, are referred by the same reference numerals. Hence, the corresponding description of these components may be entirely referred from their description in conjunction with FIGS. 14-21.

The projectile launching apparatus 3000 includes the compression valve arrangement 3300 components such as the start switch 102, the power source 104, the motor 106, the control circuit 108, the gear reduction mechanism 110, a slider crank arrangement such as the linear motion converter 200 (hereinafter referred to as the 'slider crank arrangement 200'), the cylinder 2130 and the breech assembly 2400. The projectile launching apparatus 3000 utilizes power of a gas, compressed within the cylinder 2130 with the help of the slider crank arrangement 200. The compressed gas is communicated to the barrel 410 of the breech assembly 2400 through the compression valve arrangement 3300. The compressed gas expands in the barrel 410 of the breech assembly 2400 for applying pressure on the projectile 600 in order to launch the projectile 600 out of the barrel 410.

The compression valve arrangement 3300 of the projectile launching apparatus 3000 is illustrated in detail in FIGS. 30-31. Referring to FIGS. 30-31, the compression valve arrangement 3300 includes a valve body, such as the valve body 310 having a groove, such as the groove 312 extending along a longitudinal axis X-X of the valve body 310. The groove 312 conforms to a hollow portion, such as the hollow portion 138 of the cylinder end cap 134 at a front end portion of the groove 312, while a rear end portion of the groove 312 has a hole (not shown). A valve spool, such as the valve spool 320 is disposed within the groove 312 along the longitudinal axis X-X and is capable of reciprocating linearly within the groove 312. In one embodiment of the present invention, the valve spool 320 has a cylindrical body having a stepped structure configured by a primary body portion, such as the primary body portion 322 and a concentric secondary body portion, such as the secondary body portion 324.

The compression valve arrangement 3300 further includes a valve driving mechanism which is coupled to the slider crank arrangement 200. The valve driving mechanism includes a valve spool link 3110, a rocker arm 3120 coupled to the valve spool link 3110, a valve push rod 3130 coupled to the rocker arm 3120 at one end of the valve push rod 3130, and a valve cam 3140 operatively coupled to the valve push rod 3130 at another end of the valve push rod 3130. The valve spool link 3110 is coupled to the secondary body portion 324 of the valve spool 320 and a portion of the valve spool link 3110 extends out of the valve body 310 through the hole. The rocker arm 3120 connects the valve spool link 3110 to the valve push rod 3130.

The valve push rod 3130 of the valve driving mechanism is configured on a longitudinal face of the body of the projectile launching apparatus 3000. The valve push rod 3130 operatively couples the valve cam 3140 with the valve spool 320 through the rocker arm 3120 and the valve spool link 3110. The valve cam 3140 is coupled to the slider crank arrangement 200 in a manner, such that, the rotation of the valve cam 3140 is controlled by the number of strokes of the piston 140 in the primary gas chamber 2142. The coupling of valve cam 3140 with the slider crank arrangement 200 is explained below in conjunction with the description of the breech assembly 2400.

The breech assembly 2400 includes the barrel 410, the projectile inlet port 420 and the bolt 430. The breech assembly 2400 further includes a bolt driving mechanism. The bolt driving mechanism enables the bolt 430 to move between the first position and the second position of the bolt 430. The bolt driving mechanism includes bolt gears, such as the bolt gear 2410 and the bolt gear 2412 and a bolt cam, such as the bolt cam 440, and a spring, such as the spring 450. The bolt gears 2410, 2412 and the bolt cam 440 are operatively coupled with the slider crank arrangement 200.

The bolt gear 2412 is coupled with the bolt cam 440 and the valve cam 3140 about a shaft (not shown), configured for the rotation of the bolt gear 2412. More specifically, as shown in FIG. 22, the bolt cam 440 is positioned at a top surface of the bolt gear 2412 and the valve cam 3140 is positioned underneath the bolt gear 2412. It will be apparent to a person skilled in the art that the rotational movement of the motor 106 is transferred to the bolt cam 440 and the valve cam 3140 through the bolt gears 2410 and 2412. In one embodiment of the present invention, two strokes of the piston 140 are used to compress the gas in the primary gas chamber 2142. Thus, the bolt cam 440 and the valve cam 3140 are allowed to make one revolution for every two revolutions of the crank wheel 210 of the slider crank arrangement 200. The completion of one revolution of the bolt cam 440 reciprocates the bolt 430 in between the first position and the second position of the bolt 430 for opening and closing of the projectile inlet port 420. The completion of one revolution of the valve cam 3140 pulls the valve spool link 3110 such that the valve spool 320 is moved towards the rear end portion of the groove 312 to open the gas passageway 360. Therefore, the compressed gas may be released into the barrel 410 from the secondary gas chamber 2144.

The bolt gears 2410 2412, the bolt cam 440 and the valve cam 3140 are accommodated in the first cavity 412 and the spring 450 is accommodated in the second cavity 414. The configurations of the first cavity 412 and the second cavity 414 are described in conjunction with FIG. 1.

The compression valve arrangement 3300 may also include a valve return spring in addition to the valve driving mechanism. The valve return spring may be the valve return spring 350 disposed within the groove 312 and towards the rear end portion of the groove 312, as discussed in conjunction with FIG. 2-5. The valve return spring 350 is coupled with the rear face portion 330 of the valve spool 320 in the groove 312. Additionally, the compression valve arrangement 3300 includes a gas passageway, such as the gas passageway 360 which extends from the groove 312 of the compression valve arrangement 3300 to the barrel 410 of the breech assembly 2400. The gas passageway 360 is configured to define a duct for communicating the gas from the secondary gas chamber 2144 to the barrel 410 through the compression valve arrangement 3300.

In the present embodiment, the operational cycle of the projectile launching apparatus 2000 may be described with two stokes such as a first stroke and a second stroke of the piston 140 in the primary gas chamber 2142. The first stroke and the second stroke of the piston 140 are responsible for compressing the gas in the primary gas chamber 2142 with a compression exponent greater than 1.05, transferring the compressed gas to the secondary gas chamber 2144 for storing the compressed gas with the compression exponent greater than 1.05, and releasing the compressed gas to the barrel 410 thought the compression valve arrangement 3300. It will be apparent to a person skilled in the art that a single operation cycle to launch the projectile 600 may also involve multiple strokes of the piston 140.

Referring now to FIGS. 22-25, the operation cycle of the projectile launching apparatus 3000, is described. Herein, various stages of the first stroke in the operation cycle are described in a sequential manner. The first stroke of the operational cycle of the projectile launching apparatus 3000 begins with the start switch 102 pressed ON for powering the motor 106 using the control circuit 108. In FIG. 22, an initial stage of the first stroke of the projectile launching apparatus 3000 is shown. In the initial stage of the first stroke, the piston 140 is positioned at the proximity to the separator 2140 and the bolt 430 may be positioned at the first position. The piston 140 moves backward, i.e., towards the BDC of the cylinder 2130 from the proximity to the separator 2140, as represented by the arrow mark 'P'. Specifically, upon receiving power from the power source 104, the motor 106 provides a rotational movement to the slider crank arrangement 200 through the gear reduction mechanism 110. The rotational movement of the crank wheel 210 causes the piston 140 to move linearly away from the separator 2140 and thereby opening the check valves 142 for the intake of the gas into primary gas chamber 2142.

Figure 22A:
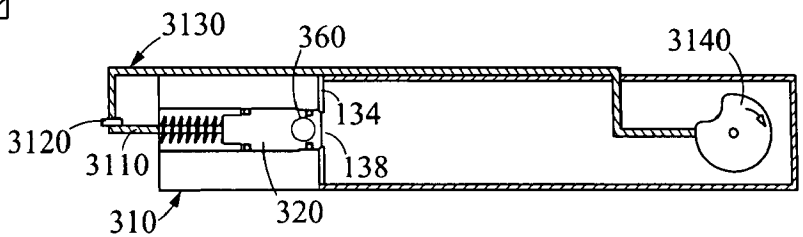

The intake of gas in the primary gas chamber 2142 through the check valves 142 continues until the piston 140 reaches the BDC of the cylinder 2130. The volume of the gas in the primary gas chamber 2142 ranges from 6 to 9 cubic inch at standard temperature and pressure conditions and, more preferably, 7 cubic inch. As shown in FIG. 22A, with the initial stage of the first stroke, the bolt 430 also starts moving from the first position towards the second position with the help of the rotational movement of the bolt cam 440. The movement of the bolt 430 and bolt cam 440 of the projectile launching apparatus 3000 when the piston 140 moves towards the BDC is described in conjunction with FIG. 14A and the corresponding description may be referred from there. Specifically, the bolt cam 440 touches the bolt contact bar 436 and pushes the bolt 430 backward, i.e., towards the second position alongwith with the rotational movement of the bolt cam 440. As the bolt 430 starts moving towards the second position, the spring 450 starts compressing in the second cavity 414 by the front portion 432 of the bolt 430.

The valve cam 3140 of the valve driving mechanism also rotates with the rotation of the bolt cam 440, when the piston 140 moves towards the BDC of the cylinder 2130. It will be apparent to a person skilled in that art that the rotational movement of the valve cam 3140 is synchronous with the rotational movement of bolt cam 440 as the valve cam 3140 and the bolt cam 440 rotates simultaneously with help of the rotational movement of the bolt gear 2412. Further, during the initial stage of the first stage of the operation cycle, the valve push rod 3130 of the valve driving mechanism remains static with the rotational movement of the valve cam 3140, thereby keeping the compression valve arrangement 3300 in the closed position. In this position, the valve spool 320 remains in the position such that the hollow portion 138 of the cylinder end cap 134 is closed, as shown in FIG. 22A.

Figure 23:
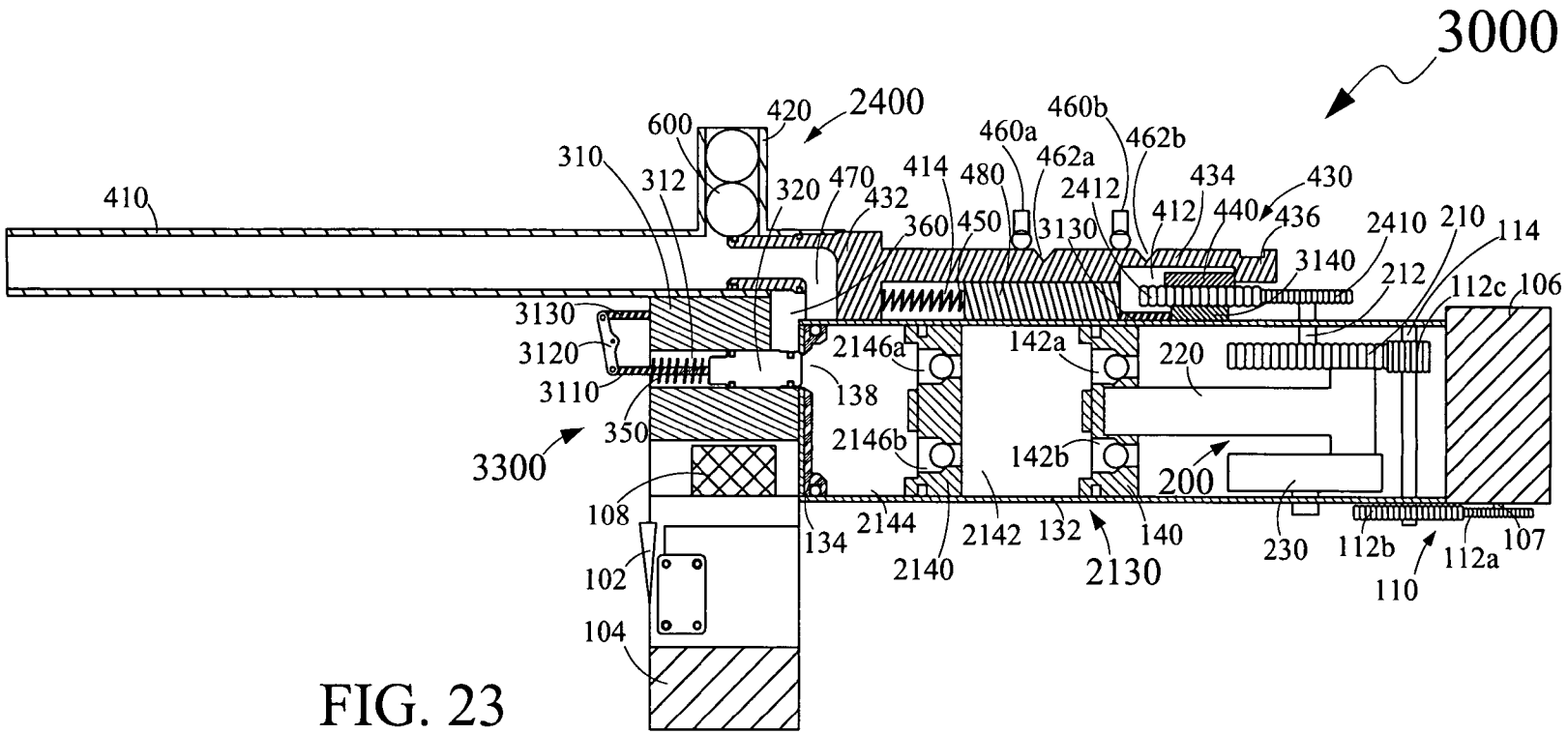

Referring to FIG. 23, a next stage of the first stroke of the operation cycle in the projectile launching apparatus 3000 is shown. In this stage, the piston 140 is shown at the BDC of the cylinder 2130. Once the piston 140 reaches the BDC, the check valves 142 adopt the closed position to occupy the gas, which is entered the primary gas chamber 2142 and thereby prevents the exit of the gas occupied within the primary gas chamber 2142. The movement of the bolt 430 and the bolt cam 440 of the projectile launching apparatus 3000, when the piston 140 is at the BDC of the cylinder 2130, may be referred from the description in conjunction with FIG. 15A. The bolt cam 440 further rotates with the rotational movement of the crank wheel 210. The continued rotational movement of the bolt cam 440 causes the bolt 430 to move backward, i.e., towards the second position for opening the projectile inlet port 420, as shown in FIG. 15A. The movement of the bolt 430 towards the second position further compresses the spring 450.

Figure 23A:
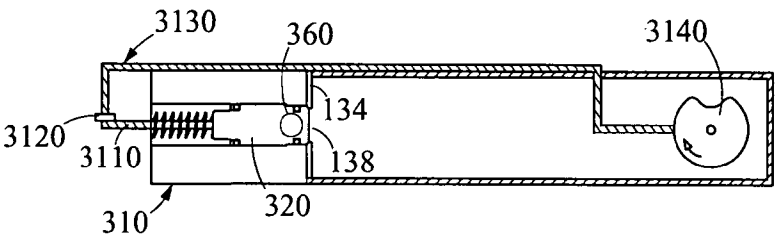

The valve cam 3140 further rotates with the continued rotational movement of the bolt cam 440, when the piston 140 is positioned at the BDC of the cylinder 2130. Further, the valve push rod 3130 remains static with the continued rotational movement of the valve cam 3140 keeping the compression valve arrangement 3300 in the closed position. In this position, the valve spool 320 closes the hollow portion 138 of the cylinder end cap 134, as shown in FIG. 23A.

Figure 24:
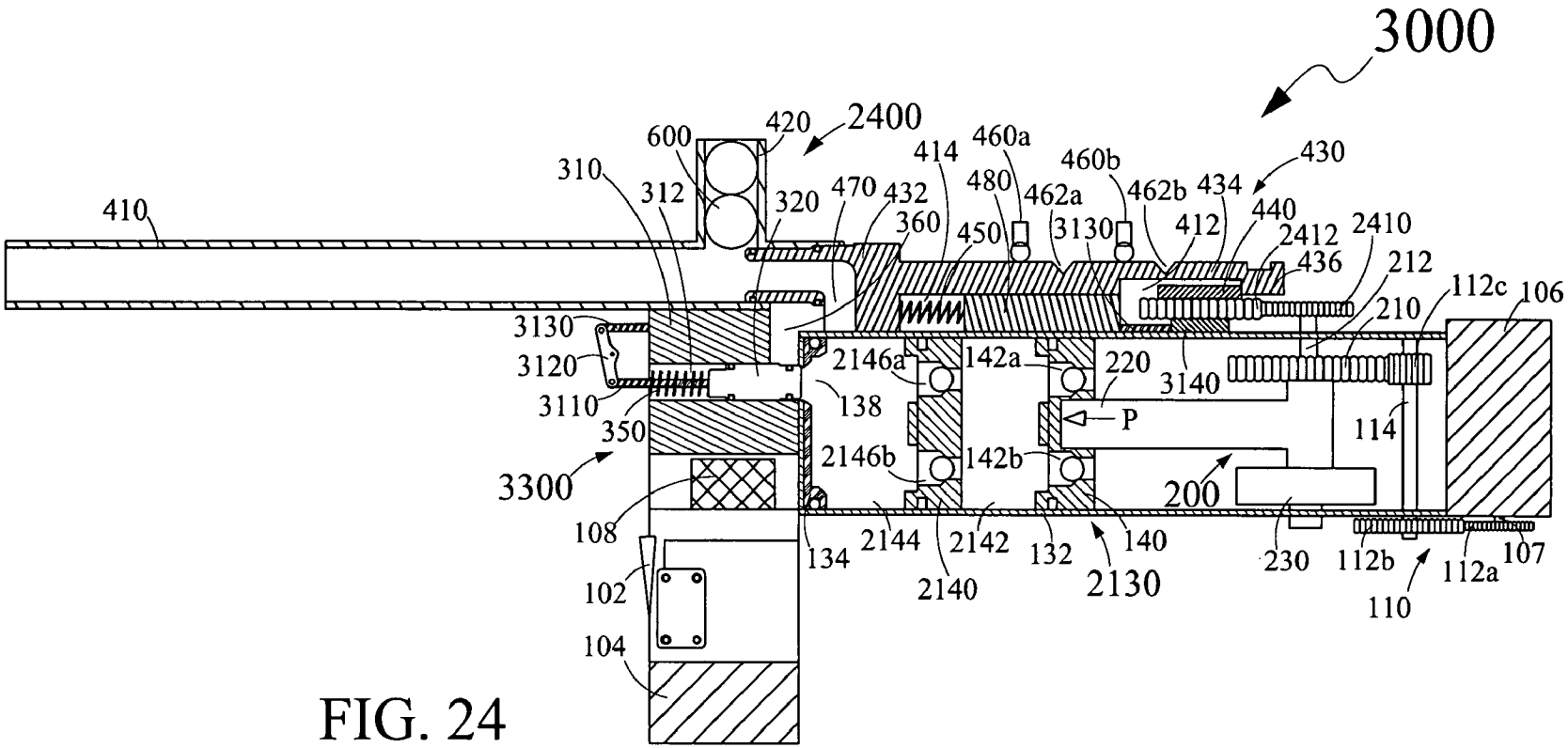

Further in FIG. 24, a next stage of the first stroke of the operation cycle in the projectile launching apparatus 3000 is shown, where the piston 140 is shown moving forward towards the proximity to the separator 2140. The forward movement of the piston 140 towards the proximity to the separator 2140 with the check valves 142 in the closed position causes the compression of the gas occupied in the primary gas chamber 2142. The compression exponent of the gas compressed within the primary gas chamber 2142 reaches at least equal to 1.05. The movement of the bolt 430 and bolt cam 440 of the projectile launching apparatus 3000, when the piston 140 moves forward towards the separator 2140, is described in conjunction with FIG. 16A. The continued rotational movement of the bolt cam 440 further moves the bolt 430 towards the second position for almost opening the projectile inlet port 420, as shown in FIG. 16A. Further, the movement of the bolt 430 towards the second position almost compress the spring 450.

Figure 24A:
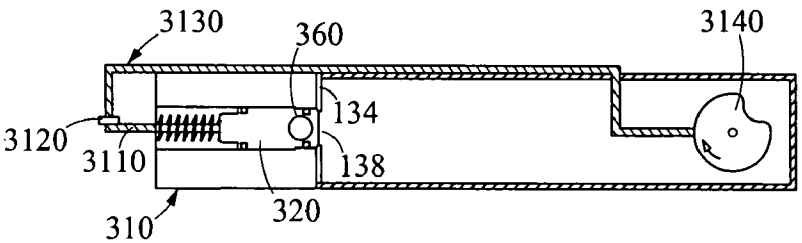

The movement of the valve cam 3140 is shown in FIG. 24A. The valve cam 3140 continues rotating with the continued rotational movement of the bolt cam 440, when the piston 140 is moving forwards towards the separator 2140. In this stage, the valve push rod 3130 again remains static keeping the compression valve arrangement 3300 in the closed position. Accordingly, the valve spool 320 closes the hollow portion 138 of the cylinder end cap 134 to keep the compression valve arrangement 3300 in closed position, as shown in FIG. 24A.

Figure 25:
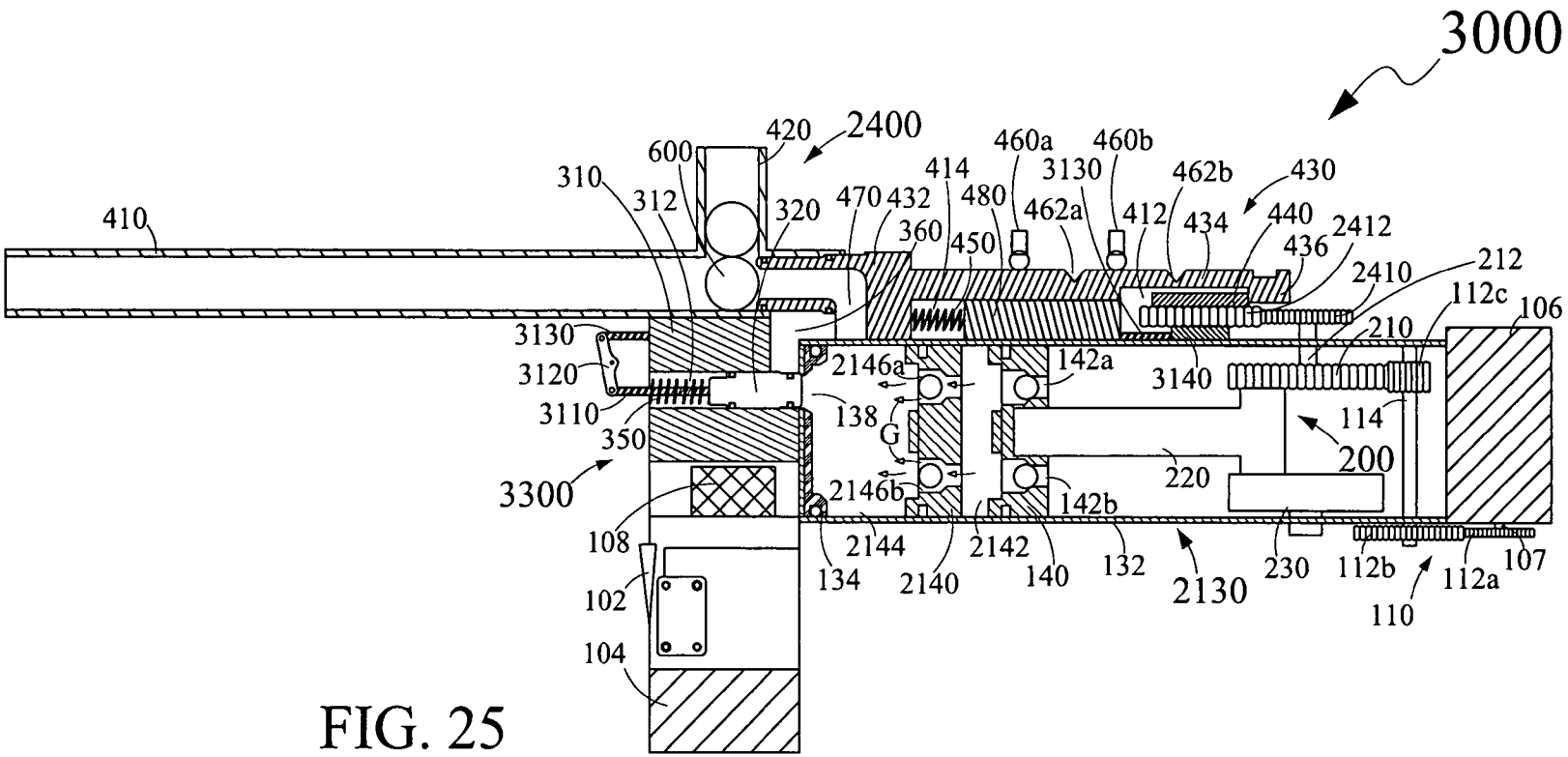

Further, referring to FIG. 25, a final stage, i.e., completion of the first stroke of the projectile launching apparatus 3000 is described. The piston 140 is positioned at the proximity to the separator 2140 at the completion of the first stroke. Once the piston 140 reaches the proximity to the separator 2140, the piston 140 compresses the gas in the primary gas chamber 2142 to an extent such that, the check valves 2146 adopt the open position and the compressed gas is transferred into the secondary gas chamber 2144. The compressed gas transferred to the secondary gas chamber 2144 includes a compression exponent of greater than about 1.05. Once the compressed gas of the primary gas chamber 2142 is transferred to the secondary gas chamber 2144, a pressure of compressed gas within the secondary gas chamber 2144 causes the check valves 2146 to adopt the closed position. The movement of the bolt 430 and the bolt cam 440 of the projectile launching apparatus 3000 when the piston is positioned at the proximity to the separator 2140 is explained in conjunction with FIG. 17A and the corresponding description may be referred from there. The continued rotational movement of the bolt cam 440 moves the bolt 430 to the second position for completely opening the projectile inlet port 420, as shown in FIG. 17A. The opening of the projectile inlet port 420 causes the projectile 600 to be fed into the barrel 410. Further, when the bolt 430 is in the second position, the bolt 430 completely compresses the spring 450.

Figure 25A:
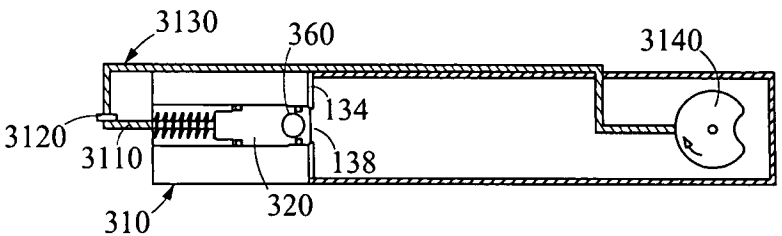

In the final stage of the first stroke of the operation cycle, the movement of the valve cam 3140 is shown in FIG. 25A. The valve cam 3140 continues rotating with the rotation of the bolt cam 440, when the piston 140 reaches the proximity to the separator 2140. At this position, the valve push rod 3130 is configured such that the valve push rod 3130 remains static keeping the compression valve arrangement 3300 in the closed position, which is shown in FIG. 25A.

Figure 26:
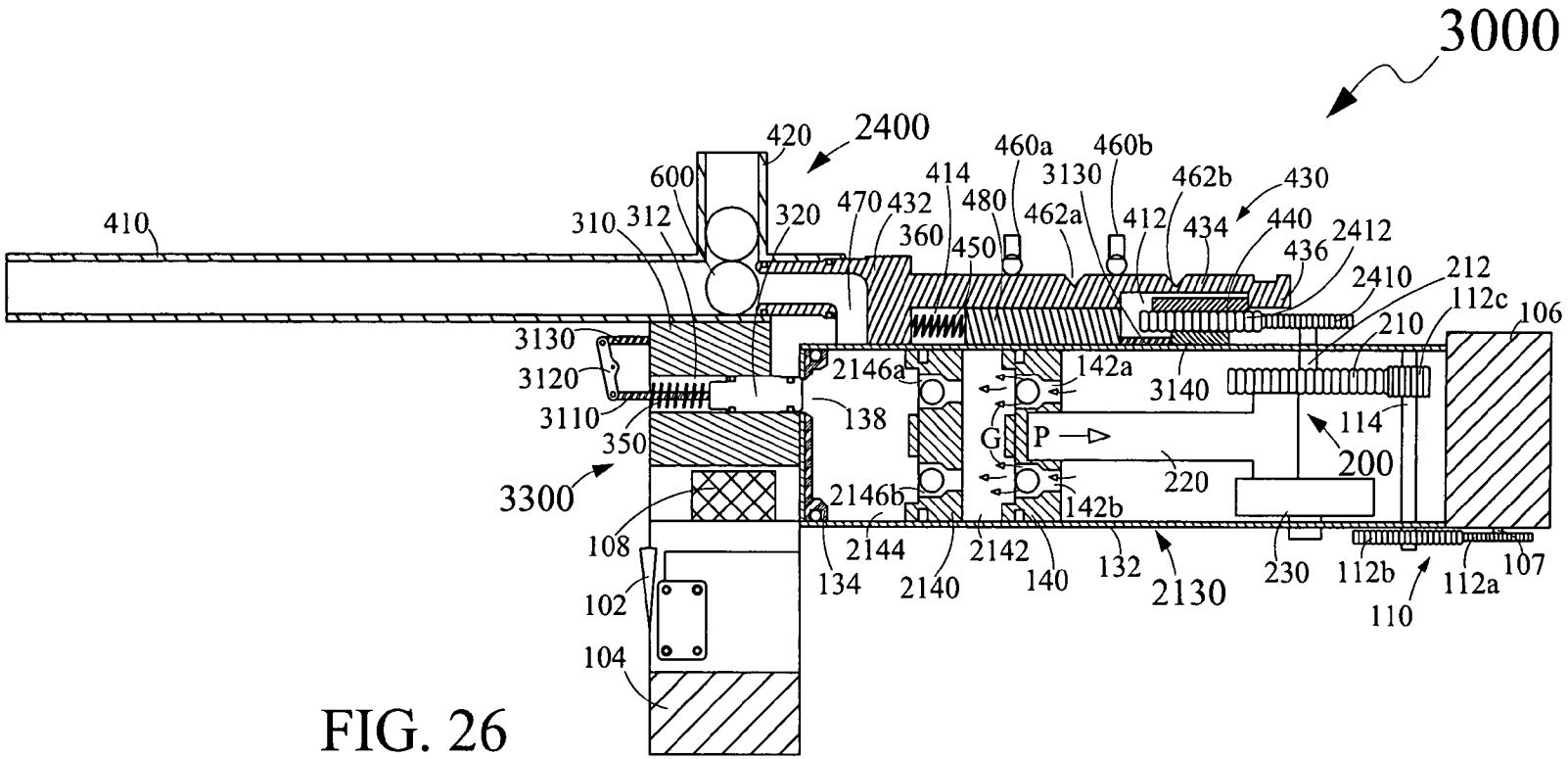

Further, referring to FIGS. 26-29, the second stroke of the projectile launching apparatus 3000 is described. Herein, various stages of the second stroke in the operation cycle are described in a sequential manner. In FIG. 26, an initial stage of the second stroke is shown, where the piston 140 is positioned at the proximity to the separator 2140 after the final stage of the first stroke. As the second stroke of the piston 140 commences, the piston 140 starts moving linearly away from the separator 2140 towards the BDC and the check valves 142 adopt the open position in order to intake the gas again into the primary gas chamber 2142. The intake of gas through the check valves 142 continues until the piston 140 reaches the BDC of the cylinder 2130. The movement of the bolt 430 and the bolt cam 440 of the projectile launching apparatus 3000, when the piston 140 moves away from the separator 2140, has already been explained in conjunction with FIG. 18A. In this stage of the second stroke, the bolt 430 starts moving from the second position towards the first position with the expansion of the spring 450. Specifically, the bolt cam 440 tends to rotate away from the bolt contact bar 436 and the spring 450 extends to move the bolt 430 forward to close the projectile inlet port 420, as shown in FIG. 18A.

Figure 26A:
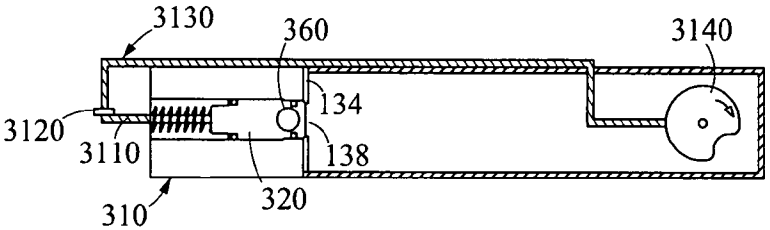

The movement of the valve cam 3140 at the initial stage of the second stroke, is shown in FIG. 26A. The valve cam 3140 continues to rotate with the continued rotational movement of the bolt cam 440. The valve push rod 3130 remains further static with the continued rotational movement of the valve cam 3140 that keeps the compression valve arrangement 3300 in the closed position, which is represented as the valve spool 320 closing the hollow portion 138 of the cylinder end cap 134, in FIG. 26A.

Figure 27:
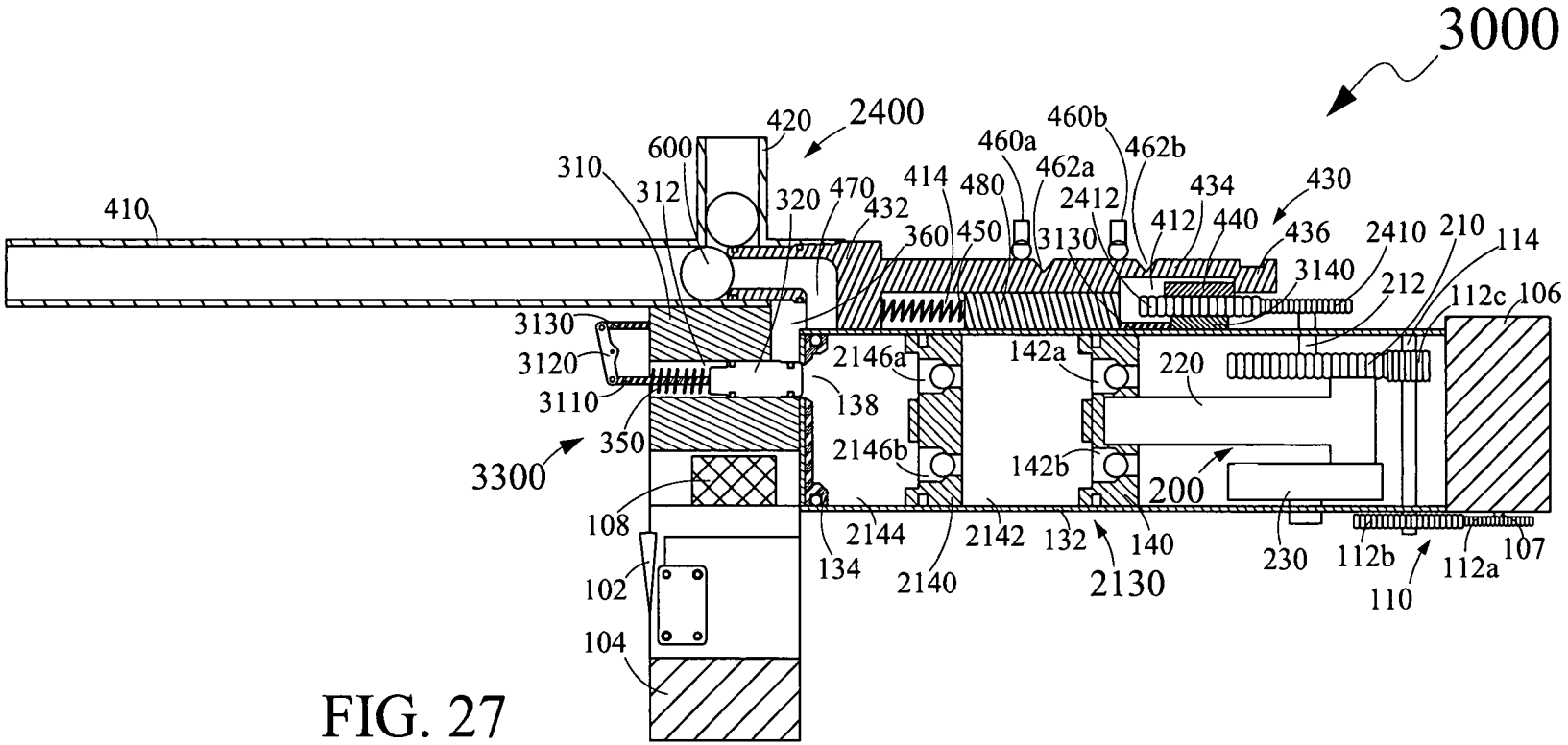

Further in FIG. 27, a next stage of the second stroke of the operation cycle in the projectile launching apparatus 3000 is shown, where the piston 140 is positioned at the BDC of the cylinder 2130. Once the piston 140 reaches the BDC, the check valves 142 adopt the closed position for occupying the gas in the primary gas chamber 2142 and prevent any exit of the gas occupied within the primary gas chamber 2142. The movement of the bolt 430 and the bolt cam 440 of the projectile launching apparatus 3000, when the piston 140 is at the BDC of the cylinder 2130, has already been explained in conjunction with FIG. 19A. Specifically, the bolt cam 440 further rotates away from the bolt contact bar 436 and causes the spring 450 to expand more for moving the bolt 430 towards the first position, as shown in FIG. 19A.

Figure 27A:
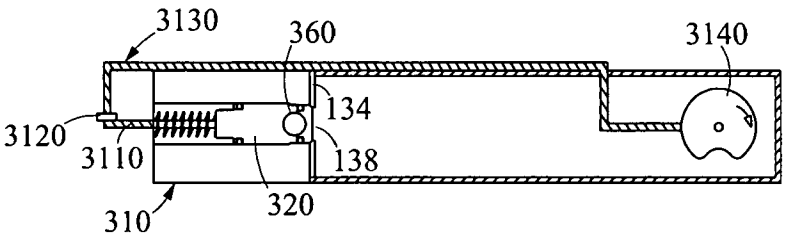

The valve cam 3140 continues to rotate with the continued rotational movement of the bolt cam 440, when the piston 140 reaches at the BDC of the cylinder 2130. The valve push rod 3130 further remains static with the rotation of the valve cam 3140, which keeps the compression valve arrangement 3300 in the closed position. In this position, the valve spool 320 closes the hollow portion 138 of the cylinder end cap 134, as shown in FIG. 27A.

Figure 20A:
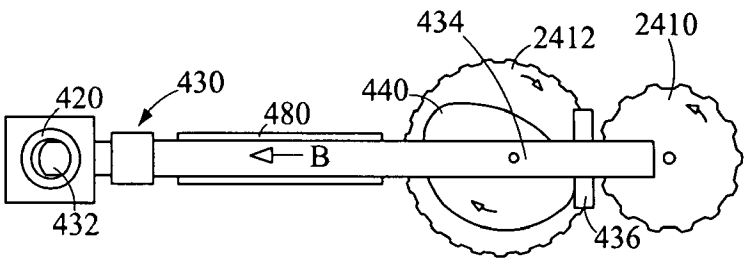
Figure 28:
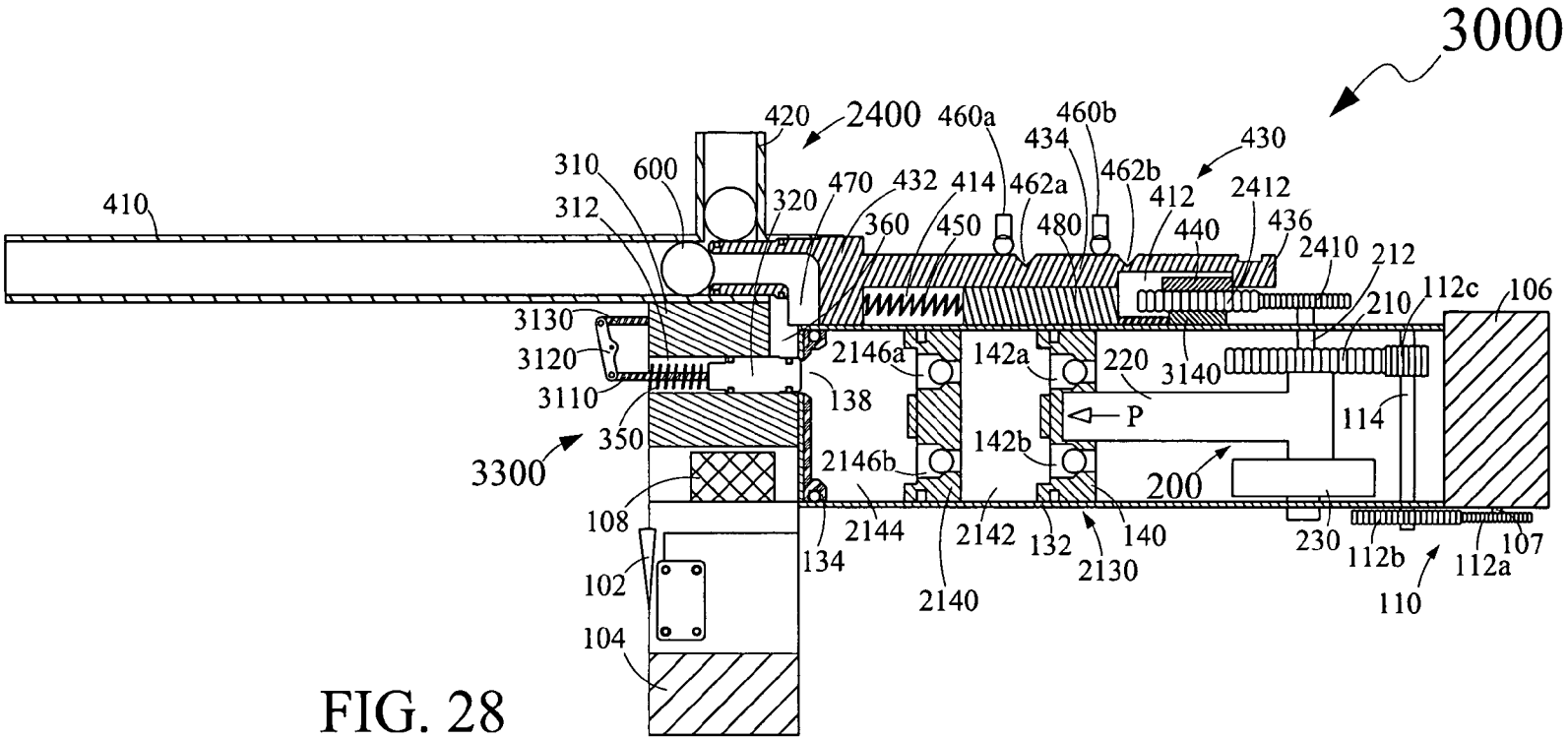

Referring to FIG. 28, a next stage of the second stroke of the operation cycle in the projectile launching apparatus 3000 is shown, where the piston 140 is shown as moving forward towards the separator 2140. The forward movement of the piston 140 towards the separator 2140 with the check valves 142 in the closed position causes the compression of the gas occupied within the primary gas chamber 2142. The compression exponent of the gas compressed within the primary gas chamber 2142 reaches at least equal to 1.05. The movement of the bolt 430 and the bolt cam 440 of the projectile launching apparatus 3000, when the piston 140 moves forward towards the separator 2140 has already been described in conjunction with FIG. 20A. The bolt cam 440 further rotates away from the bolt contact bar 436 and causes the spring 450 to expand more for moving the bolt 430 towards the first position and almost closing the projectile inlet port 420, as shown in FIG. 20A.

Figure 28A:
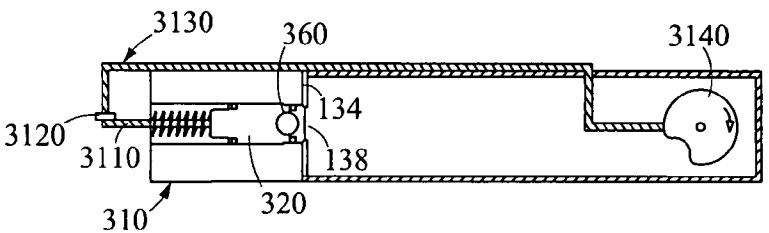

Further, the valve cam 3140 continues rotating with the continued rotational movement of the bolt cam 440, when the piston 140 moves forward towards the separator 2140. The valve push rod 3130 further remains static with the continued rotational movement of the valve cam 3140 to keep the compression valve arrangement 3300 in the closed position, which is represented by the valve spool 320 closing the hollow portion 138 of the cylinder end cap 134, as shown in FIG. 28A.

Figure 29:
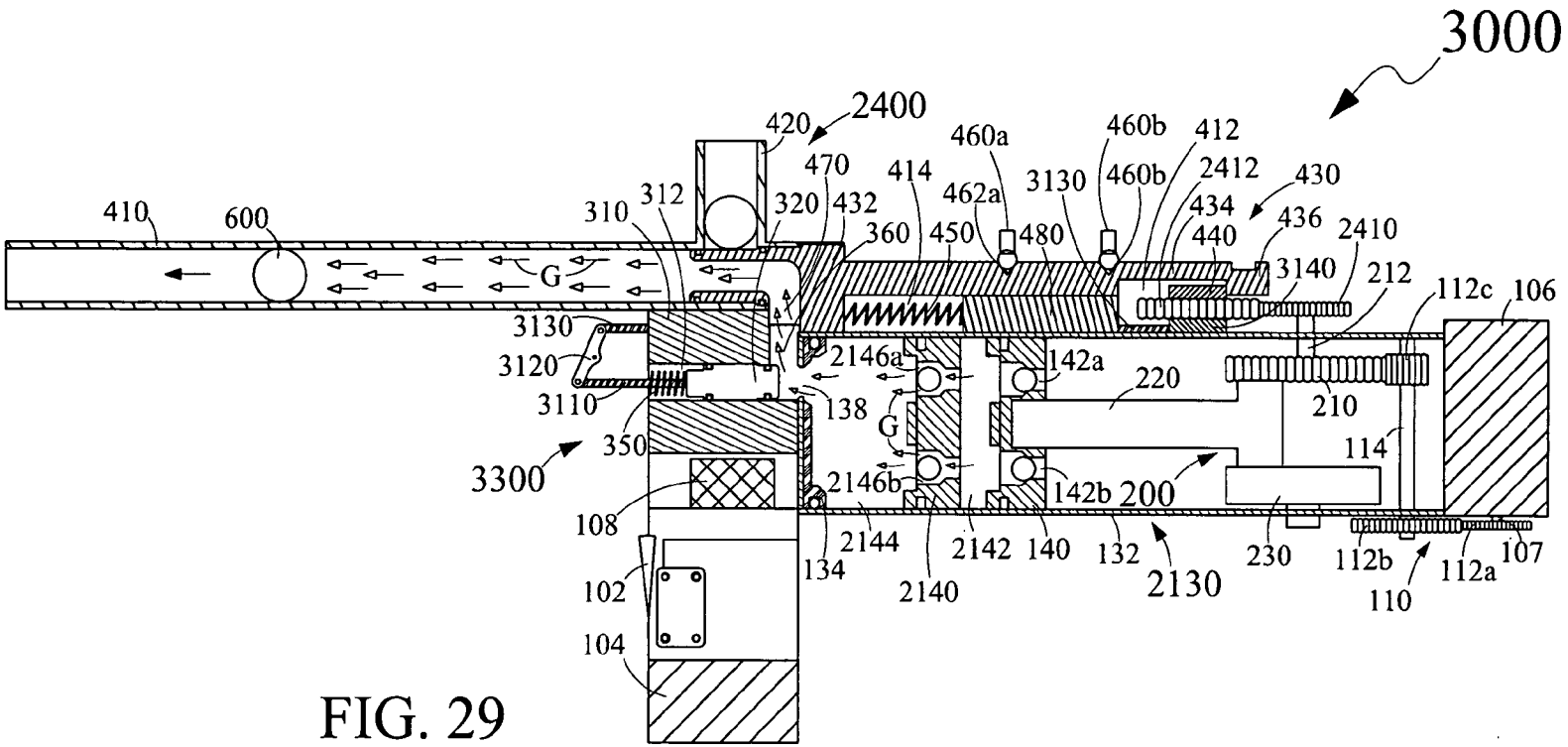
Figure 29A:
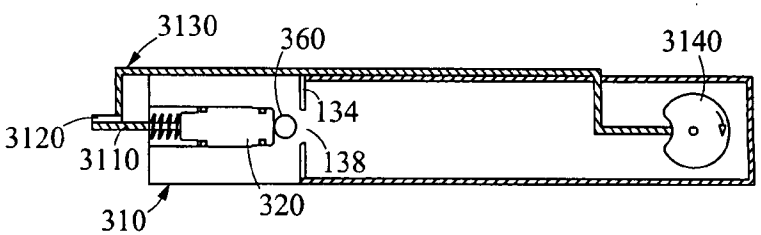

Further, referring to FIG. 29, a final stage, i.e., completion of the second stroke of the operation cycle of the projectile launching apparatus 3000 is described. In the final stage of the second stroke, the piston 140 reaches the proximity to the separator 2140. Once the piston 140 reaches the proximity to the separator 2140, the piston 140 is configured to compress the occupied gas in the primary gas chamber 2142 to an extent, such that, the check valves 2146 and the compression valve arrangement 3300 adopt the open position. The movement of the bolt 430 and the bolt cam 440 of the projectile launching apparatus 3000, when the piston 140 reaches the proximity to the separator 2140 has already been explained in conjunction with FIG. 21A. Specifically, the bolt cam 440 further rotates away from the bolt contact bar 436 causing the spring 450 to expand completely for moving the bolt 430 to the first position and closing the projectile inlet port 420, as shown in FIG. 21A. In this condition, the crank wheel 210 is about to complete two rotations (720 degrees) and the bolt cam 440 is about to complete a one rotation (360 degrees).

Referring to FIG. 29 A, at the end of the second stroke of the piston 140, the compression valve arrangement 3300 adopts the open position. The compression valve arrangement 3300 adopts the open position, as the pressure of the compressed gas inside the secondary gas chamber 2144 and a force applied by the valve push rod 3130 on the valve spool 320 exceeds the maintaining force of the valve spool 320. The valve push rod 3130 of the valve driving mechanism is configured such that the valve push rod 3130 moves the valve spool 320 away from the hollow portion 138 of the cylinder end cap 134. More specifically, herein, the valve push rod 3130 moves backward with the rotation of the valve cam 3140. In this exemplary embodiment of the present invention, the backward movement of the valve push rod 3130 applies a force on the rocker arm 3120 such that the rocker arm 3120 tends to rotate in a clock wise direction. Further, the clock wise rotation of the rocker arm 3120 is configured to pull the valve spool link 3110 away from the hole. Accordingly, the valve spool 320 is also pulled, alongwith the valve spool link 3110, linearly within the groove 312 such that the valve spool 320 opens the hollow portion 138 and accordingly the compression valve arrangement 3300 adopts the open position.

The open position of the compression valve arrangement 3300, i.e., the opening of the hollow portion 138 allows the compressed gas to be released through the gas passageway 360 to the barrel 410. More specifically, the gas passageway 360 aligns a bolt passageway, such as the bolt passageway 470, as shown in FIG. 29. More specifically, the bolt 430 includes the bolt passageway 470 that is configured on the front portion 432 of the bolt 430. The bolt passageway 470 is configured to align with the gas passageway 360 when the bolt 430 is in the first position and piston 140 is at the proximity to the separator 2140. Upon aligning the bolt passageway 470 and the gas passageway 360, the compressed gas from the secondary gas chamber 2144 is released into the barrel 410. The compressed gas reaching the barrel 410 through the bolt passageway 470 starts expanding in the barrel 410 for applying pressure on the projectile 600 to launch the projectile 600 from the barrel 410 with the high velocity.

Herein, the operation cycle of the projectile launching apparatus 3000 is described, with a consideration that one operation cycle is completed in the two strokes of the piston 140. However, it will be apparent to a person skilled in the art that the operation cycle of the projectile launching apparatus 3000 may be completed in the multiple strokes of the piston 140 as well. In such a case, the compressed gas is released into the barrel 410 in the last stroke of the multiple strokes.

The present invention provides a plurality of sensors (not shown) that enables a safe operation of a projectile launching apparatus of the projectile launching apparatuses 100, 1000, 2000 and 3000. These sensors determine the positions of a piston such as the piston 140 within a cylinder, such as the cylinder 130 or the cylinder 2130, during the operation cycle of the projectile launching apparatus. These sensors may be positioned on suitable places such as the piston, on any gear of the gear reduction mechanism of the projectile launching apparatus, on the cylinder guide of the cylinder, or on the compression valve arrangement used in the projectile launching apparatus. For example, a sensor may be placed in the compression valve arrangement and a magnet (not shown) is disposed on a piston head of the piston for detecting the positions of the piston with respect to the compression valve arrangement. More specifically, when the piston comes in proximity to the compression valve arrangement, the magnet disposed on the piston is detected by the sensor placed on the compression valve arrangement.

The control circuit 108 is configured to receive information of the position of the piston within the cylinder from these sensors. Therefore, the control circuit 108 has the exact information of the piston, such as, whether the piston is approaching or leaving the TDC of the cylinder. The information of the positions of the piston may be used by the control circuit 108 for the operation of the projectile launching apparatus. For example, when the operational cycle is underway, the control circuit 108 may continue to apply voltage to the motor 106 until the piston reaches the TDC of the cylinder. Based on the information of the position of the piston, for example, when the piston reaches the TDC of the cylinder, the control circuit 108 may apply a brake to the motor 106 to stop the operational cycle of the projectile launching apparatus at a predetermined location within the cylinder.

Further, the present invention provides a mechanism to increase the efficiency of a projectile launching apparatus, such as the projectile launching apparatuses 100, 1000, 2000 and 3000. In one embodiment of the present invention, the projectile launching apparatus may be coupled with a clutch (not shown) for increasing the efficiency of the projectile launching apparatus. As already described, the operation of the projectile launching apparatus begins with powering a motor, and then moving the linear motion converter, opening a compression valve arrangement and launching a projectile out of a barrel. The use of the clutch, allows the motor to run continuously for intermittently launching a plurality of projectiles from the projectile launching apparatus. More specifically, when the user presses ON a start switch, the clutch engages with the linear motion converter. As the motor is running continuously, i.e., the motor does not starting from a "dead stop," the energy can be extracted right away and much more quickly form the motor and transferred to the linear motion converter. The quick transferring of the rotational motion of the motor to the linear motion converter increases the efficiency of launching the projectile form the projectile launching apparatus.

Typically a motor has the ability to deliver more power in middle of its operating revolutions per minute (RPMs) range, i.e., in between a starting state and a stopping state of the motor. The motor tend to deliver less power in the starting state (not rotating yet) and the stopping state (stops rotating). Thus, the motor is less efficient at lower RPMs than at higher RPMs. Further, when the projectile launching apparatus is engaged with the clutch, the projectile launching apparatus provides a much more responsive feel. More specifically, by using the projectile launching apparatus with the clutch, a time from pressing ON the start switch to a time of launching the projectile at 280 fps may be reduced from about 100 milliseconds to about 50 milliseconds in order to provide the responsive feel to the user.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, and to thereby enable others skilled in the art to best utilize the invention and various embodiments with various modifications as are suited to the particular use contemplated. It is understood that various omissions and substitutions of equivalents are contemplated as circumstances may suggest or render expedient, but such are intended to cover the application or implementation without departing from the spirit or scope of the claims of the present invention.

What is claimed is:

1. A projectile launching apparatus, comprising:

a power source;

a motor electrically connected to the power source;

a control circuit configured to control a power supply to the motor from the power source;

a cylinder comprising a piston reciprocally movable within the cylinder to define a gas chamber within the cylinder, the gas chamber capable of accommodating gas therein;

a slider crank arrangement driven by the motor, the slider crank arrangement operatively coupled to the piston and configured to cause the piston to reciprocally move within the cylinder for compressing the gas within the gas chamber;

a breech assembly comprising a barrel, a projectile inlet port configured on the barrel, the projectile inlet port adapted to receive a projectile into the barrel, and a bolt comprising a front portion and a rear portion, the bolt operatively coupled to the slider crank arrangement and capable of reciprocating between a first position and a second position of the bolt, the bolt configured to be partially received within the barrel such that the front portion of the bolt shutting off the projectile inlet port in the first position and the bolt further configured to enable the projectile to enter the barrel from the projectile inlet port in the second position; and a compression valve arrangement operatively disposed between the cylinder and the barrel, the compression valve arrangement having an open position and a closed position, the open position of the compression valve arrangement configured to release the compressed gas within the gas chamber into the barrel, and the closed position of the compression valve arrangement configured to seal the compressed gas from the gas chamber to the barrel, wherein the gas received within the gas chamber is compressed by the piston in a single stroke of the slider crank arrangement in a manner such that the compressed gas is released from the gas chamber into the barrel, causing the compressed gas to expand in the barrel thereby causing the projectile to be launched from the barrel with the single stroke of the slider crank arrangement, and wherein the compression valve arrangement comprises a valve body having a groove;

a valve spool disposed within the groove, the valve spool comprising, a front face portion facing the cylinder, a rear face portion opposite to the front face portion, and a valve spool stem extending outwardly from the front face portion towards the cylinder;

a valve return spring disposed within a rear end portion of the groove and operatively coupled to the rear face portion of the valve spool; and a gas passageway extending from the groove to the barrel, the gas passageway configuring a duct for releasing the compressed gas from the gas chamber of the cylinder into the barrel.

2. The projectile launching apparatus of claim 1, wherein the compression valve arrangement is mechanically tripped by a pressure applied by at least one of the compressed gas and the valve spool stem with a single stroke of the piston.

3. The compression valve arrangement of claim 2, wherein the valve spool is further adapted to be cooperatively opened with an electric solenoid in addition to the pressure of the compressed gas.

4. The compression valve arrangement of claim 1, further comprises at least one valve retainer to retain the valve spool in the closed position of the compression valve arrangement, wherein in the closed position of the compression valve arrangement sum of a pressure applied by the at least one valve retainer and the restoration force applied by the valve return spring is greater than a pressure applied by the compressed gas to the front face portion of the valve spool.

5. The projectile launching apparatus of claim 1, wherein the gas passageway has a volume less than about 15 percent of a volume of the gas chamber in the cylinder.

6. The projectile launching apparatus of claim 1, wherein the cylinder comprises a cylinder guide configured on an inner surface of the cylinder for guiding the reciprocating movement of the piston thereon;

a cylinder end cap configured at an end of the cylinder adjacent to the compression valve arrangement for defining the gas chamber between the cylinder end cap, the piston and the cylinder guide; and a hollow portion configured in the cylinder end cap, the hollow portion adapted to receive the front face portion of the valve spool in the closed position of the compression valve arrangement.

7. A projectile launching apparatus, comprising:

a power source;

a motor electrically connected to the power source;

a control circuit configured to control a power supply to the motor from the power source;

a cylinder comprising a piston reciprocally movable within the cylinder to define a gas chamber within the cylinder, the gas chamber capable of accommodating gas therein;

a slider crank arrangement driven by the motor, the slider crank arrangement operatively coupled to the piston and configured to cause the piston to reciprocally move within the cylinder for compressing the gas within the gas chamber;

a breech assembly comprising a barrel, a projectile inlet port configured on the barrel, the projectile inlet port adapted to receive a projectile into the barrel, a bolt comprising a front portion and a rear portion, the bolt operatively coupled to the slider crank arrangement and capable of reciprocating between a first position and a second position of the bolt, the bolt configured to be partially received within the barrel such that the front portion of the bolt shutting off the projectile inlet port in the first position and the bolt further configured to enable the projectile to enter the barrel from the projectile inlet port in the second position;

a bolt driving mechanism coupled to the bolt for causing the bolt to move between the first position and the second position and a compression valve arrangement operatively disposed between the cylinder and the barrel, the compression valve arrangement having an open position and a closed position, the open position of the compression valve arrangement configured to release the compressed gas within the gas chamber into the barrel, and the closed position of the compression valve arrangement configured to seal the compressed gas from the gas chamber to the barrel, wherein the gas received within the gas chamber is compressed by the piston in a single stroke of the slider crank arrangement in a manner such that the compressed gas is released from the gas chamber into the barrel, causing the compressed gas to expand in the barrel thereby causing the projectile to be launched from the barrel with the single stroke of the slider crank arrangement, and wherein the bolt driving mechanism comprises a spring configured to move the bolt to the first position; and a bolt cam operatively coupled to the slider crank arrangement to move the bolt to the second position.

8. A projectile launching apparatus comprising:

a power source;

a motor electrically connected to the power source;

a cylinder comprising a piston reciprocally movable within the cylinder, the piston defining a gas chamber within the cylinder, the gas chamber having a separator dividing the gas chamber into a primary gas chamber and a secondary gas chamber, each of the primary gas chamber and the secondary gas chamber capable of accommodating gas therein;

a linear motion converter driven by the motor, the linear motion converter operatively coupled to the piston and configured to cause the piston to reciprocally move within the cylinder for compressing the gas within the gas chamber;

a breech assembly comprising a barrel;

a projectile inlet port configured on the barrel, the projectile inlet port adapted to receive a projectile, and a bolt comprising a front portion and a rear portion, the bolt operatively coupled to the linear motion converter and capable of reciprocating between a first position and a second position of the bolt, the bolt configured to be partially received within the barrel such that the front portion of the bolt shutting off the projectile inlet port in the first position and the bolt further configured to enable the projectile to enter the barrel from the projectile inlet port in the second position; and a compression valve arrangement operatively disposed between the cylinder and the barrel, the compression valve arrangement having an open position and a closed position, the open position of the compression valve arrangement configured to release the compressed gas within the gas chamber into the barrel, and the closed position of the compression valve arrangement configured to seal the compressed gas from the gas chamber to the barrel, wherein the gas received within the primary gas chamber is compressed by the piston in multiple strokes of the linear motion converter in a manner such that the compressed gas is released into the secondary gas chamber in less than or equal to about 250 milliseconds and with a compression exponent at least equal to about 1.05; and wherein in the multiple strokes of the linear motion converter, the compression valve arrangement adopts the open position once in less than or equal to about 250 milliseconds, thereby causing the compressed gas in the secondary gas chamber to be released into the barrel; and wherein the compressed gas expanding in the barrel causes the projectile to be launched from the barrel.

9. The projectile launching apparatus of claim 8, wherein the linear motion converter is one of a slider crank arrangement, a rack and pinion arrangement, a lead screw arrangement and a crankshaft and connecting rod arrangement.

10. The projectile launching apparatus of claim 8 further comprising a gear reduction mechanism, the gear reduction mechanism capable of transferring a rotational movement of the motor to the linear motion converter.

11. The projectile launching apparatus of claim 8 further comprising at least one check valve, the at least one check valve having an open position and a closed position, wherein the at least one check valve is configured to receive gas within the gas chamber in the open position and prevent exit of the compressed gas from the gas chamber in the closed position.

12. The projectile launching apparatus of claim 8, wherein the compressed gas in the gas chamber is compressed to a pressure with a compression exponent of at least equal to 1.05 before the compression valve arrangement changes adopts the open position from the closed position.

13. The projectile launching apparatus of claim 8, wherein the compression valve arrangement comprises a valve body having a groove;

a valve spool disposed within the groove, the valve spool comprising a front face portion facing the cylinder, and a rear face portion opposite to the front face portion; and a valve return spring disposed within a rear end portion of the groove and operatively coupled to the rear face portion of the valve spool; and a gas passageway extending from the groove to the barrel, the gas passageway configuring a duct for releasing the compressed gas from the gas chamber of the cylinder to the barrel.

14. The projectile launching apparatus of claim 13, wherein the compression valve arrangement is mechanically tripped by a pressure applied by at least one of the compressed gas and the an electric solenoid with multiple stroke of the piston.

15. The projectile launching apparatus of claim 13, wherein the gas passageway has a volume less than about 15 percent of a volume of the gas chamber in the cylinder.

16. The projectile launching apparatus of claim 13, wherein the cylinder comprises a cylinder guide configured on an inner surface of the cylinder for guiding the reciprocating movement of the piston thereon;

a cylinder end cap configured at an end of the cylinder adjacent to the compression valve arrangement for defining the gas chamber between the cylinder end cap, the piston and the cylinder guide; and a hollow portion configured in the cylinder end cap, the hollow portion adapted to receive the front face portion of the valve spool in the closed position of the compression valve arrangement.

17. The projectile launching apparatus of claim 8 further comprising a bolt driving mechanism coupled to the bolt for causing the bolt to move between the first position and the second position.

18. The projectile launching apparatus of claim 17, wherein the bolt driving mechanism comprises a spring configured to move the bolt to the first position; and a bolt cam operatively coupled to the linear motion converter to move the bolt to the second position.

19. The projectile launching apparatus of claim 8, wherein the compression valve arrangement is a snap acting valve and the compression valve arrangement takes less than about 20 milliseconds for opening from the closed position to a position enabling the release of the compressed gas with at least about 70 percent of an optimum flow of the release of the compressed gas.

20. The projectile launching apparatus of claim 8 further comprising a clutch configured to allow the motor to run continuously and enables storing energy in the motor necessary to launch the projectile in the motor before the movement of the linear motion converter is actuated by the motor.

21. The projectile launching apparatus of claim 8 further comprising at least one sensor configured to enable the control circuit to determine positions of the piston within the cylinder during the single stroke of the linear motion converter.

* * * * *